US006717515B1

(12) United States Patent
Osako et al.

(10) Patent No.: US 6,717,515 B1
(45) Date of Patent: Apr. 6, 2004

(54) SENSOR SYSTEM

(75) Inventors: Kazunori Osako, Kyoto (JP); Kiyoshi Imai, Kyoto (JP); Toshinori Sato, Kyoto (JP); Takashi Kamei, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/698,199

(22) Filed: Oct. 30, 2000

(30) Foreign Application Priority Data

| | | |
|---|---|---|
| Oct. 29, 1999 | (JP) | 11-346636 |
| Nov. 30, 1999 | (JP) | 11-341361 |
| Sep. 14, 2000 | (JP) | 2000-280358 |

(51) Int. Cl.[7] ..... G08B 21/00

(52) U.S. Cl. ..... 340/540; 340/540; 340/539; 340/505; 340/825; 340/66; 359/143

(58) Field of Search ..... 340/540, 539, 340/531, 505, 506, 3.1, 3.5, 825.66, 425.1; 359/143; 307/11; 361/679, 731, 733, 735

(56) References Cited

U.S. PATENT DOCUMENTS

| | | | | |
|---|---|---|---|---|
| 4,041,470 A | * | 8/1977 | Slane et al. | 364/900 |
| 4,542,496 A | * | 9/1985 | Takeyama et al. | 370/16 |
| 4,682,144 A | * | 7/1987 | Ochiai et al. | 340/48 |
| 4,724,425 A | * | 2/1988 | Gerhart et al. | 340/539 |
| 4,812,820 A | * | 3/1989 | Chatwin | 340/518 |
| 5,006,841 A | * | 4/1991 | Vines et al. | 340/825.07 |
| 5,229,975 A | * | 7/1993 | Truesdell et al. | 367/107 |
| 5,513,244 A | * | 4/1996 | Joao et al. | 379/58 |
| 5,517,429 A | * | 5/1996 | Harrison | 364/516 |
| 5,815,074 A | * | 9/1998 | Sasagawa et al. | 340/505 |
| 5,943,347 A | * | 8/1999 | Shepard | 371/31 |
| 5,971,597 A | * | 10/1999 | Baldwin et al. | 364/528.12 |
| 6,071,382 A | * | 6/2000 | Tsuchiya et al. | 162/252 |
| 6,252,501 B1 | * | 6/2001 | Tice et al. | 340/506 |

FOREIGN PATENT DOCUMENTS

| | | |
|---|---|---|
| JP | 61-118900 A | 6/1986 |
| JP | 02-306112 A | 12/1990 |
| JP | 04-000898 | 1/1992 |
| JP | 04-096103 | 3/1992 |
| JP | 04-207541 | 7/1992 |
| JP | 04-121132 | 10/1992 |
| JP | 04-121132 U | 10/1992 |
| JP | 05-075669 | 3/1993 |
| JP | 06-231386 | 8/1994 |
| JP | 07-006286 A | 1/1995 |
| JP | 07-011736 | 2/1995 |
| JP | 07-181216 A | 7/1995 |
| JP | 08-065770 A | 3/1996 |
| JP | 08-114463 | 5/1996 |
| JP | 08-194506 | 7/1996 |
| JP | 09-064712 | 3/1997 |
| JP | 10-149495 | 6/1998 |
| JP | 10-254524 | 9/1998 |
| JP | 10-332443 | 12/1998 |
| JP | 11-177405 | 7/1999 |
| JP | 11-225058 | 8/1999 |
| JP | 11-237904 | 8/1999 |

* cited by examiner

*Primary Examiner*—Daniel J. Wu
*Assistant Examiner*—Phung Nguyen
(74) *Attorney, Agent, or Firm*—Foley & Lardner

(57) ABSTRACT

Provided is a sensor system which allows setting and adjustment to be conducted in a simple manner. The sensor system comprises a plurality of sensor units which are adapted to be placed closely one next to another and each assigned with an individual address, and a mobile console which is adapted to be connected to at least one of the sensor units, each of the sensor units comprising a connector provided on each side for allowing communication with a corresponding one of the adjacent sensor units, and a data relaying arrangement for relaying data received from one of the adjacent sensor units via one of the connectors to the other adjacent sensor unit via the other connectors when the data is not intended for the particular sensor unit so as to permit a data communication from the mobile console to the sensor units or from the sensor units to the mobile console.

47 Claims, 53 Drawing Sheets

Fig.26

| | | | | | | | | | | | | | | | | |
|---|---|---|---|---|---|---|---|---|---|---|---|---|---|---|---|---|
| bank 1 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 2 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 3 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 4 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 5 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 6 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 7 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 8 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 9 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |
| bank 10 | 0 ch | 1 ch | 2 ch | 3 ch | 4 ch | 5 ch | 6 ch | 7 ch | 8 ch | 9 ch | 10 ch | 11 ch | 12 ch | 13 ch | 14 ch | 15 ch |

*Fig.28*

| |
|---|
| unit ID |
| unit version |
| threshold level |
| monitor output range |
| timer setting |
| flag 1 |
| flag 2 |
| flag 3 |
| flag 4 |
| sum |

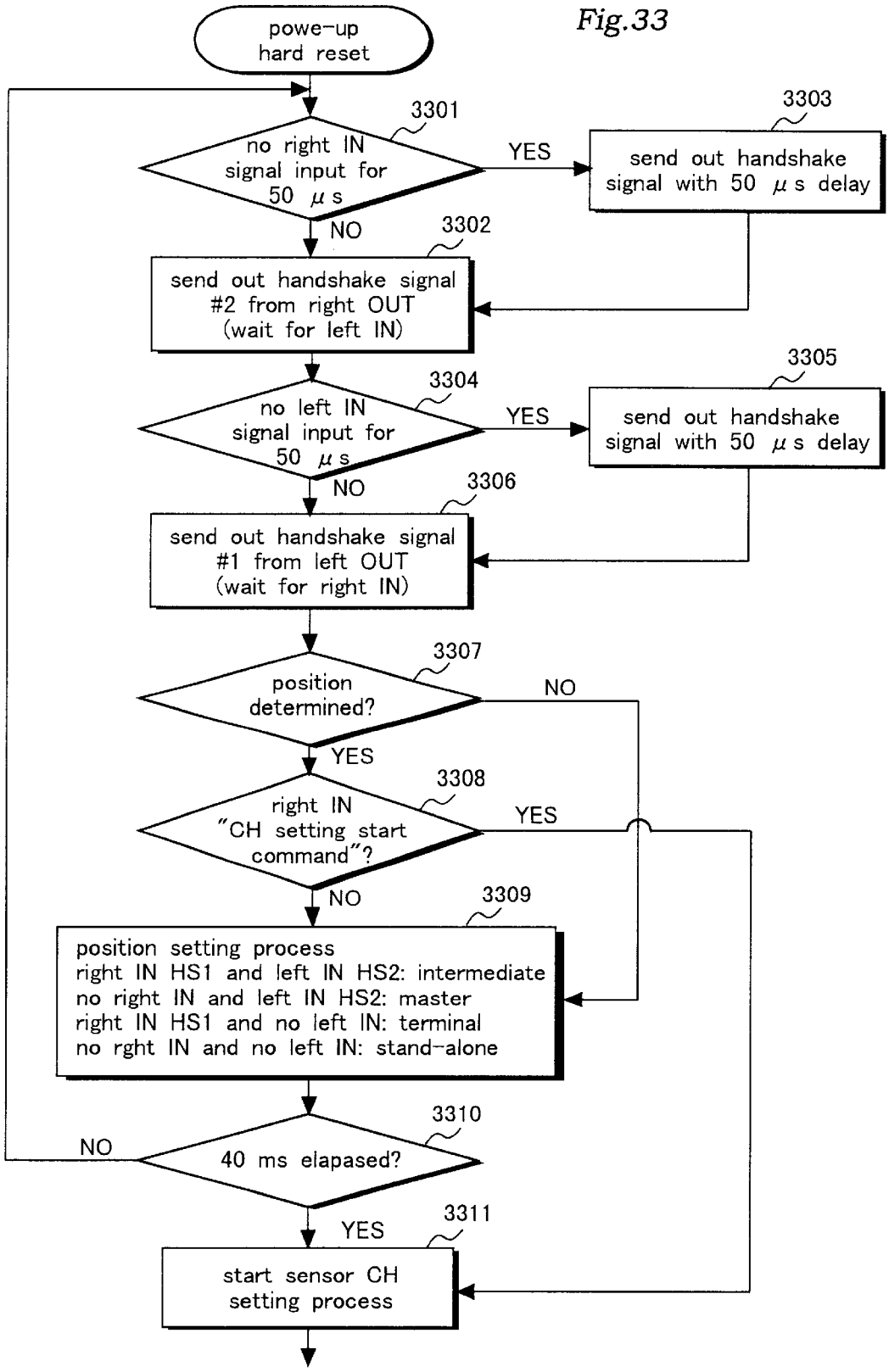
Fig.33
powe-up
hard reset
3301
no right IN
signal input for
50 μs
YES
NO
3303
send out handshake
signal with 50 μs delay
3302
send out handshake signal
#2 from right OUT
(wait for left IN)
3304
no left IN
signal input for
50 μs
YES
NO
3305
send out handshake
signal with 50 μs delay
3306
send out handshake signal
#1 from left OUT
(wait for right IN)
3307
position
determined?
NO
YES
3308
right IN
"CH setting start
command"?
YES
NO
3309
position setting process
right IN HS1 and left IN HS2: intermediate
no right IN and left IN HS2: master
right IN HS1 and no left IN: terminal
no rght IN and no left IN: stand-alone
3310
40 ms elapased?
NO
YES
3311
start sensor CH
setting process note) "No" in each flow branch leads to an error process.

*Fig.36*

| data | hexadecimal | binary |
|---|---|---|
| handshake signal #1 | 11h | 00010001 |
| handshake signal #2 | 55h | 01010101 |
| start CH setting command | 7Ah | 01111010 |
| ID resend request command | 0Ch | 00001100 |

*Fig.37*

1ST−9DATA−1PAR−1SP (total : 12bits)

ST : start bit
DATA : character bits (data)
PAR : parity bit
SP : stop bit (a) format for T1 and T2 signals 1ST−9DATA−1SP (total : 11bits)

ST : start bit
DATA : character bits (data)
PAR : parity bit
SP : stop bit (b) format for updata and downdata

*Fig.39*

| Bit | T 1 | T 2 |
|---|---|---|
| 1 (LSB) | ch 0 control output | ch 8 control output |
| 2 | ch 1 control output | ch 9 control output |
| 3 | ch 2 control output | ch 1 0 control output |
| 4 | ch 3 control output | ch 1 1 control output |
| 5 | ch 4 control output | ch 1 2 control output |
| 6 | ch 5 control output | ch 1 3 control output |
| 7 | ch 6 control output | ch 1 4 control output |
| 8 | ch 7 control output | ch 1 5 control output |

note) "1" when control output is on,
and "0" when control output is off.

*Fig. 40*

| | | | |
|---|---|---|---|
| 1 | target address | address of the object unit of the command | Add 1 |
| 2 | source address | address of the source unit of the command | Add 2 |
| 3 | command | command to the unit | Ope |
| 4 | Data 1 | data 1 attached to the command | Data 1 |
| 5 | Data 2 | data 2 attached to the command | Data 2 |
| 6 | SUM | SUM check value for data 1 to 4 | SUM |

(a) when data is required

| | | | |
|---|---|---|---|
| 1 | target address | address of the object unit ot the command | Add 1 |
| 2 | source address | address of the source unit ot the command | Add 2 |
| 3 | command 1 | command 1 to the unit (dummy command) | Ope 1 |
| 4 | command 2 | command 2 to the unit (dummy dommand) | Ope 2 |
| 5 | command 3 | command 1 to the unit (main command) | Ope 3 |
| 6 | SUM | SUM check value for data 1 to 4 | SUM |

(b) when data is not required

SENSOR SYSTEM

TECHNICAL FIELD

The present invention relates to a sensor system including a large number of sensor units (such as optical fiber photoelectric sensor units, proximate sensors or ultrasonic sensors) mounted closely one next to another typically on a DIN rail, and in particular to a sensor system which simplifies the setting operation and monitoring of settings of such sensor units by enabling a bi-directional data communication between the adjacent sensor units in the manner of a bucket brigade.

BACKGROUND OF THE INVENTION

Sensor systems including a large number of optical fiber photoelectric sensor units mounted closely one next to another on a DIN rail are conventionally known. The outer face of each of such sensor units is provided with a digital display unit consisting of seven-segment display devices and a keypad which may comprise function keys and increment keys. Such a display unit and keypad are used for adjusting the light receiving sensitivity and threshold level when installing the sensor.

The photoelectric sensor units of this type are given with a higher and higher functionality so that the setting items are increased in number and are each increased in complexity. The increasing demand for space-saving and compact design has resulted in extremely small housings for such photoelectric sensor units, and the keypad and display unit particularly suffer from the impact of the compact design.

Therefore, the display unit is required to be very small, and the number of the setting keys are limited in both size and number. This has increased the difficulty in the setting and adjusting operation. In particular, as the number of sensor units increases to 16, 32 and so forth, the setting and adjusting of each key becomes progressively difficult and time-consuming.

BRIEF SUMMARY OF THE INVENTION

In view of such problems of the prior art, a primary object of the present invention is to provide a sensor system which simplifies the setting and adjustment operation for the sensor units.

Another object of the present invention is to provide a sensor system which simplifies the setting and adjustment operation for the sensor units without requiring any substantial changes to the existing structure of the overall system or the shape of the individual sensor units.

Yet another object of the present invention is to provide a sensor unit which simplifies the setting and adjustment operation for the sensor unit.

Yet another object of the present invention is to provide a mobile console which simplifies the setting and adjustment operation for the sensor units.

Yet another object of the present invention is to provide a bus unit which allows the setting and adjustment operation for the sensor units from a programmable controller, personal computer or the like connected to a field bus.

Other objects and advantages of the present invention will become obvious for a person skill in the art from the following description.

The sensor system of the present invention comprises a plurality of sensor units which are adapted to be placed closely one next to another and each assigned with an individual address, and a mobile console which is adapted to be connected to at least one of the sensor units.

As can be readily appreciated by a person skilled in the art, the "sensor unit" may comprise any sensing means having a desired sensing capability. The sensing means may consist of optical fiber photoelectric sensor units, proximate sensors and ultrasonic sensors. If the sensor unit consists of an optical fiber photoelectric sensor, the sensing means comprises light emitting means (including both hardware and software), and light receiving means (including both hardware and software). The output signal from the sensing means may not necessarily consist of a binary output (switching output) but may also consist of an analog or digital value without being converted into a binary signal. In view of the fact that they are arranged closely one next to another, the sensor units would typically consist of sensors having separate sensor heads such as optical fiber photoelectric sensors.

Being "adapted to be placed closely one next to another" includes mounting the sensor units closely one next to another on a DIN rail. However, it is also possible to use other mounting arrangements.

Being "assigned with an individual address" may include making each sensor unit identify a particular address from the relation with the adjacent sensor units according to a free allocation scheme as well as the assigning of a fixed address by using a DIP switch.

According to a preferred embodiment of the present invention, each of the sensor units forwards a handshake signal to the adjacent sensor units. From the response to the handshake signal, each sensor unit can determined if it is at the right or left terminal end or at an intermediate position, and the sensor unit at a terminal end is identified as a master unit and the remaining units as slave units, and addresses are assigned to them accordingly.

The "mobile console" means any portable console (console board). More specifically, the mobile console is at least provided with functions to enter data and read data, and to display the data.

"At least one of" means that a connection can be made to one or more of the sensor units which are arranged in a series, and it may not necessarily be located at a terminal end, but may also be located in a middle of the series. The "connection" as used herein means any connection which allows communication, and may consist of wire connection using electric cables and wireless connection using radio wave, light such as infrared light, and so on.

Each of the sensor units may comprise a connector means on each side for allowing communication with a corresponding one of the adjacent sensor units and data relaying means for transmitting data received from one of the adjacent sensor units via the corresponding connector means to the other adjacent sensor unit via the other connector means. Thereby, the bi-directional transfer of data in the manner of a bucket brigade from the mobile console to the sensor units and from the sensor units to the mobile console is enabled.

Comprising "a connector means on each side" means that each sensor is provided with two connector means corresponding to the adjacent sensor units on either side. It means that the sensor units are all connected in a series, and it is distinct from the arrangement in which the I/O units of a programmable logic controller or the like are connected in a mutually parallel relationship with respect to a system bus. However, the sensor unit which is designed to be attached to a terminal end of a sensor unit array may be provided with only one connector means because it is not required to communicate with both of the adjacent sensor units. The "connector means" as used herein means any connector which is capable of signal transmission and reception, and may include a contact-type electric connector which establishes an electric connection by the contact of a plug and receptacle, and a contact-less connector which exchanges signals by using light (infrared light).

The "data relaying means" as used herein means both the means which relays data unconditionally and the means which relays data only if it meets a certain condition. A person skilled in the art would select either one of them according to the particular need. If the unconditional data relay means is selected, the execution of the process would be simplified because of the elimination of the need to analyze the condition, but the downstream sensors would be burdened by the data relaying action which may not be necessary. On the other hand, the conditional data relay means is selected, the downstream sensors would not be burdened by the data relaying action which may not be necessary if the data is accompanied with a condition that "if the data is not intended only for the particular sensor unit", but the execution of the process would cause a complication because of the need to analyze the condition. The "downstream" as used herein means the direction toward the position which is the last to receive data, and may be in either physical direction depending on the direction of data transfer.

"If the received setting data is not intended only for the particular sensor unit" includes the case where the data is intended for another sensor unit as well as the cases where the data is intended for both the particular sensor unit and another sensor unit, or for all of the sensor units.

When the data is relayed between adjacent senor units in the manner of "a bucket brigade" according to the present invention, if the arrived data is intended for all of the sensor units, the particular sensor unit has to execute the process of transferring the data to the adjacent sensor unit in addition to executing the process for the particular sensor itself. Associating each transmission data to all of the sensor units can be accomplished in a number of different ways. For instance, the transmission data may be attached with a code corresponding to a wildcard. Alternatively, the transmission data attached with no code may be assumed as being intended for all of the sensor units, or the transmission data may be attached with the addresses of all of the sensor units.

According to a preferred embodiment of the present invention, the sensor unit comprises monitoring data transmitting means for transmitting monitoring data intended for the mobile console to the adjacent sensor unit. The mobile console also comprises monitoring data displaying means for displaying monitoring data received from one of the sensor units.

The "monitoring data transmission means" as used herein may mean both the means for transmitting monitoring data spontaneously according to a timing determined by a timing signal which is forwarded from a timer or forwarded sequentially from the adjacent sensor unit, and the means for transmitting monitoring data passively in response to a monitoring command forwarded from the mobile console or the like.

Thereby, the state of each sensor unit (such as the set sensitivity level, detected value, and so forth) can be monitored from the mobile console according to the monitoring data relayed between the sensor units in the manner of a bucket brigade.

According to another preferred embodiment of the present invention, the mobile console comprises setting data transmission means for transmitting setting data to a designated sensor unit via one of the sensor units. Each sensor unit comprises data setting means for conducting a data setting action according to setting data if the data received from the adjacent sensor unit is intended for the particular sensor unit and consists of setting data transmitted from the mobile console.

The "designated sensor unit" as used herein may mean a single sensor unit, two or more sensor units or all of the sensor units which is or are designated. When designating a particular single sensor unit, the setting data of the particular sensor unit would typically contain an address corresponding to the target sensor unit. When a plurality of sensor units are to be designated, different setting data would be forwarded to the designated sensors, and the data for each designated sensor would contain an address corresponding to the target sensor unit. All of the sensor units can be designated in the same manner as designating a plurality of sensor units. It may include the case where a wildcard designating all of the sensor units is attached to a common setting data item.

The data "intended for the particular sensor unit" includes not only the data only for the particular sensor unit, but also the data intended for the particular sensor unit and another sensor unit, or all of the sensor units.

The "data setting means" of the sensor unit may not necessarily execute a setting action on the condition of reading a data setting command. In other words, it may include those which spontaneously execute a setting action unconditionally according to the setting data if the data received from the adjacent sensor unit is intended for the particular sensor unit and consists of data transmitted from the mobile console.

According to the above described structure, because the data setting action is executed according to the setting data transmitted from the mobile console in the manner of a bucket brigade, the setting of the sensitivity and functions can be conducted from the mobile console, and it is a significant improvement from the conventional arrangement which required each sensor unit to be set by a key operation.

According to yet another preferred embodiment of the present invention, the mobile console comprises command data transmitting means for transmitting data containing a command intended for a designated sensor unit to one of the sensor units. Each sensor unit comprises command data executing means for conducting a certain action according to a command if the data received from the adjacent sensor unit is intended for the particular sensor unit and contains such a command.

The data "intended for the particular sensor unit" includes not only the data only for the particular sensor unit, but also the data intended for the particular sensor and another sensor, or all of the sensor units.

The "command" used herein may comprise what is broadly defined as a command. Each sensor unit is provided with a capability to execute a process of analyzing the command and conducting a corresponding action. The command may come in a wide variety depending on the kind of the sensor unit (photoelectric sensor, proximate sensor, ultrasonic sensor and so forth), and the functions it performs.

Thereby, the action of each sensor unit can be conducted according to a command issued from the mobile console and passed on from one sensor unit to another in the manner of a bucket brigade.

In the case of a sensor system which allows the action of each sensor unit to be conducted according to a command issued from the mobile console according to a preferred embodiment of the present invention, the command may include various commands.

According to a preferred embodiment of the present invention, the command consists of a monitor command which is associated with the action to read the data of a monitor item designated by the monitor command, and return the data to the mobile console as monitor data.

According to this structure, the state of each sensor unit can be monitored from the mobile console. Each sensor unit may not provide an adequate space for the keypad and display unit because of the compact design for its housing, but the mobile console does not suffer from such a restriction. Therefore, a favorable handling and visibility can be achieved.

According to a preferred embodiment of the present invention, the command consists of a data setting command which is associated with the action to write the data attached to the data setting command into a setting item designated by the data setting command.

According to this structure, the state of each sensor unit can be set by a operation of the mobile console, and the handling can be improved for the reasons mentioned above.

According to a preferred embodiment of the present invention, the command consists of a disable command which is associated with the action to disable the manipulation of a key of the sensor unit corresponding to a function designated by the disable command.

Thus, by using such a disable command, a security is placed on a function which is not desired to be changed by the operator or other personnel on the site.

According to a preferred embodiment of the present invention, the command consists of a concealed function executing command which allows a concealed function to be executed, the concealed function being unable to be invoked by a key operation from the sensor unit.

By thus concealing the function which should not be entrusted to personnel other than the designer or administrator, the security of the system can be ensured.

The sensor system according to a different embodiment of the present invention comprises a plurality of sensor units which are adapted to be placed closely one next to another and each assigned with an individual address, and a bus unit which is adapted to be connected to at least one of the sensor units.

Each of the sensor units comprises a connector means each side for allowing communication with a corresponding one of the adjacent sensor units; and data relaying means for transmitting data received from one of the adjacent sensor units via the corresponding connector means to the other adjacent sensor unit via the other connector means.

The bus unit comprises protocol conversion means for converting a communication protocol between sensor unit communication system and field bus communication system which is connected to equipment such as a programmable controller and personal computer.

Thus, it permits a bi-directional data communication between the equipment such as a programmable controller and personal computer on the field bus and the sensor unit.

According to this structure, the data such as a detected value and switching output which otherwise issues from each individual sensor unit can be wholly obtained from the side of the bus unit, and forwarded to the programmable logic controller so that the output line extending from each individual sensor unit can be omitted. This contributes to the simplification of wiring requirement.

According to a preferred embodiment of the present invention, each sensor unit comprises command executing means for executing an action associated with the command if the received command data is intended for the particular sensor unit and contains a command.

Thereby, the action of each sensor unit can be executed according to a command from equipment on the field bus. In other words, because a programmable controller (PLC), a FA (factory automation) personal computer (FA PC) and so on can be connected to the field bus, it is possible to invoke the desired function of each sensor unit by issuing commands such as monitor commands and data setting commands from such equipment.

To realize such a sensor system, sensor units having a certain structure is used. This sensor unit comprises a connector means on each side for allowing communication with a corresponding one of adjacent sensor units; data relaying means for relaying data received from one of the adjacent sensor units via one of the connector means to the other adjacent sensor unit via the other connector means; and command executing means for receiving data from an adjacent one of the sensor units via one of the connector means, and executing a command if the received data is intended for the particular sensor unit, and when the received data contains the command.

In the case of the sensor units also, it is preferable to use a number of basic commands. According to a preferred embodiment of the present invention, the command consists of a monitor command which is associated with the action to read the data of a monitor item designated by the monitor command, and return the data to the mobile console as monitor data.

According to a preferred embodiment of the present invention, the command consists of a data setting command which is associated with the action to write the data attached to the data setting command into a setting item designated by the data setting command.

According to a preferred embodiment of the present invention, the command consists of a disable command which is associated with the action to disable the manipulation of a key of the sensor unit corresponding to a function designated by the disable command.

According to a preferred embodiment of the present invention, the command consists of a concealed function executing command which allows a concealed function to be executed, the concealed function being unable to be invoked by a key operation from the sensor unit.

In the sensor system of the present invention described above, a mobile console having a certain structure is used. According to a preferred embodiment of the present invention, the mobile console is adapted to be connected to one of a plurality of sensor units each adapted for a bi-directional communication with adjacent sensor units and a relaying function for data that is not intended for the particular sensor unit.

According to a preferred embodiment of the present invention, the mobile console may comprise command means for entering various commands; display means for displaying various items of data; monitor command transmitting means for transmitting a monitor command to a designated sensor unit in response to a command entered from the command means; and monitoring data display means for displaying on the display means monitoring data that is returned from the designated sensor unit in response to the transmission of the monitor command.

According to a preferred embodiment of the present invention, the mobile console comprises command means for entering various commands; display means for displaying various items of data; and setting data transmission means for transmitting setting data to a designated sensor unit in response to a command from the command means.

According to a preferred embodiment of the present invention, the mobile console comprises command means for entering various commands; display means for displaying various items of data; and disable command transmission means for transmitting a disable command to a designated sensor unit in response to a command from the command means.

According to a preferred embodiment of the present invention, the mobile console comprises command means for entering various commands; display means for displaying various items of data; and concealed function executing command transmission means for transmitting a concealed function executing command to a designated sensor unit in response to a command from the command means.

According to the sensor system of the present invention, data transfer can be accomplished by connecting thereto any control unit other than the mobile console and bus unit mentioned above. This is so because the sensor unit array is provided with the function to accomplish a bi-directional data transfer in the manner of a bucket brigade.

Essentially, the sensor system of the present invention comprises a plurality of sensor units which are adapted to be placed closely one next to another and each assigned with an individual address, and a mobile console which is adapted to be connected to at least one of the sensor units, each of the sensor units comprising: a connector means on each side for allowing communication with a corresponding one of the adjacent sensor units; and data relaying means for relaying data received from one of the adjacent sensor units via one of the connector means to the other adjacent sensor unit via the other connector means so as to permit a bi-directional data communication from the mobile console to the sensor units or from the sensor units to the mobile console in the manner of a bucket brigade.

Essentially, the bus unit of the present invention is adapted to be connected to one of a plurality of sensor units each adapted for a bi-directional communication with adjacent sensor units and a data relaying function comprising: protocol conversion means for converting a communication protocol between sensor unit communication means and field bus communication means which is connected to equipment such as a programmable controller and personal computer, so as to permit a bi-directional data communication between the equipment such as a programmable controller and personal computer on a field bus and the sensor unit.

In connection with the sensor system, sensor unit and mobile console which are described above, the sensor units preferably comprise optical fiber type photoelectric sensor units.

The connector means may comprise a light emitting element and a light receiving element so as to allow transmitting and receiving light signals.

By using such an optical connector, the side faces of the unit housing may be given with a flat surface, as opposed to the case using a male and female connector. This contributes to the improvement in the immunity against electromagnetic interferences and the elimination of poor contact problems.

One of the advantages of the mobile console of the present invention is found in the fact that although the sensor unit array is typically placed in a narrow and poorly accessible space in a control console or the like, because the mobile console may be placed in a highly accessible place remotely from the sensor array, the monitoring or other work related with the sensor system can be facilitated.

This advantages owes to the data collecting function of the mobile console based on communication, and does not rely on the use of the bucket brigade scheme or the common transmission line (bus) scheme. In this regard, the mobile console of the present invention can be characterized as given in the following.

The mobile console of the present invention is provided commonly for a number of sensor units arranged one next to another and each provided with a communication function. Being "provided commonly" means that it is not provided for each of the sensor units. The data communication between the sensor units may be based on the bucket brigade scheme or the common transmission line (bus) scheme.

The mobile console is provided with command means; display means; and control means for taking out data on each designated sensor unit from the sensor unit by communication according to a command entered from the command means, and displaying the data on the display means. The target for the communication by the mobile console is not limited to the sensor units in the array. It is also possible to provide an infrared communication function in each of the sensor units so that the mobile console may communicate directly with them, without the intervention of any other sensor units, to allow the data to be collected individually.

According to the mobile console of the present invention, the communication with the sensor units may be conducted via a single sensor unit or a common transmission line. In other words, it is possible to relay the data received by one of the sensor units to an adjacent sensor unit in the manner of a bucket brigade or by forwarding the data to a common transmission line.

According to the mobile console of the present invention, the communication with the single sensor unit or common transmission line is conducted via wire transmission using an electric cord, or wireless transmission using infrared light, radio wave and ultrasonic radiation so as to allow the data of the sensor units to be monitored remotely. According to such an arrangement, the mobile console may be easily separated from the sensor unit array so that the data of the sensor units can be easily monitored and adjusted remotely.

According to the mobile console of the present invention, the data of the sensor units comprises a detected analog value or a threshold level for a binary. As can be readily appreciated, the data may also comprise data of any other kind.

The external appearance of the mobile console of the present invention may characterized by a housing provided with a keypad serving as the command means and a display unit serving as the display means, the housing being so dimensioned and configured as to permit the keypad to be manipulated with one hand while holding the housing with the other hand. This obviously enhances the handling of the mobile console.

BRIEF DESCRIPTION OF THE DRAWINGS

Now the present invention is described in the following with reference to the appended drawings, in which:

FIG. 26 is a schematic view of the bank for storing the settings of the sensor units;

FIG. 28 is a diagram showing the structure of the data in the ch 1 bank;

FIG. 33 is a flowchart showing the sensor position identification process;

FIG. 36 is a diagram showing the structure of the transmission/reception data;

FIG. 37 is a diagram showing the format of the transmission/reception data;

FIG. 39 is a diagram showing the contents of the T1/T2 data;

FIG. 40 is a diagram showing the structure of the updata/downdata data;

DETAILED DESCRIPTION OF THE PREFERRED EMBODIMENTS

Figure 1:
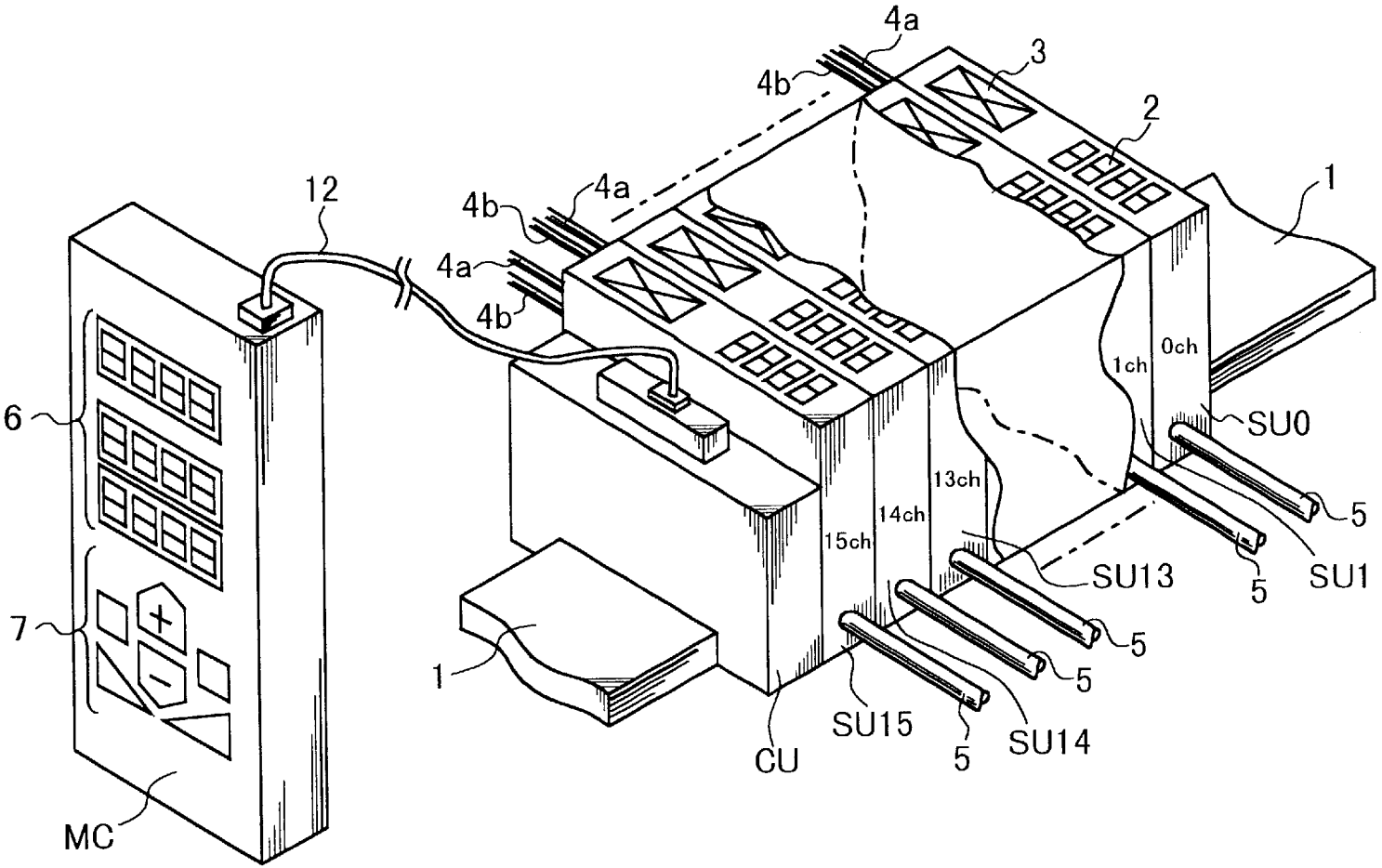
FIG. 1 is a perspective view of an embodiment of the sensor system according to the present invention.

FIG. 1 is a perspective view showing an embodiment of the sensor system according to the present invention. As shown in this drawing, this sensor system comprises a plurality (16 in the illustrated embodiment) of sensor units SU0 to SU15 which are adapted to be arranged closely one next to another and assigned with individual addresses, and a mobile console MC adapted to be connected to at least one of the sensor units SU0 to SU15. In this embodiment, the sensor units SU0 to SU15 consist of optical fiber photoelectric switches.

The illustrated sensor units SU0 to SU15 are mounted on a DIN rail 1 closely one next to another. The upper face of the housing of each sensor unit is provided with a display unit 2 consisting of four seven-segment display devices, and a keypad 3 including a plurality of function keys and increment keys. From the front face of the housing of each sensor unit extends an electric cord 5 for forwarding a switching output. From the rear face of the housing extend an outgoing optical fiber 4*a* and an incoming optical fiber 4*b*.

The front face of the mobile console MC is provided with a display unit 6 and keypad 7. An electric cord 12 extends from the upper end of the mobile console MC, and the other end of the electric cord 12 is connected to a connector unit CU. The connector unit CU is mounted on the DIN rail 1 adjacent to the left end of the array of the sensor units SU0 to SU15 in the same manner as the sensor units SU0 to SU15.

Figure 2:
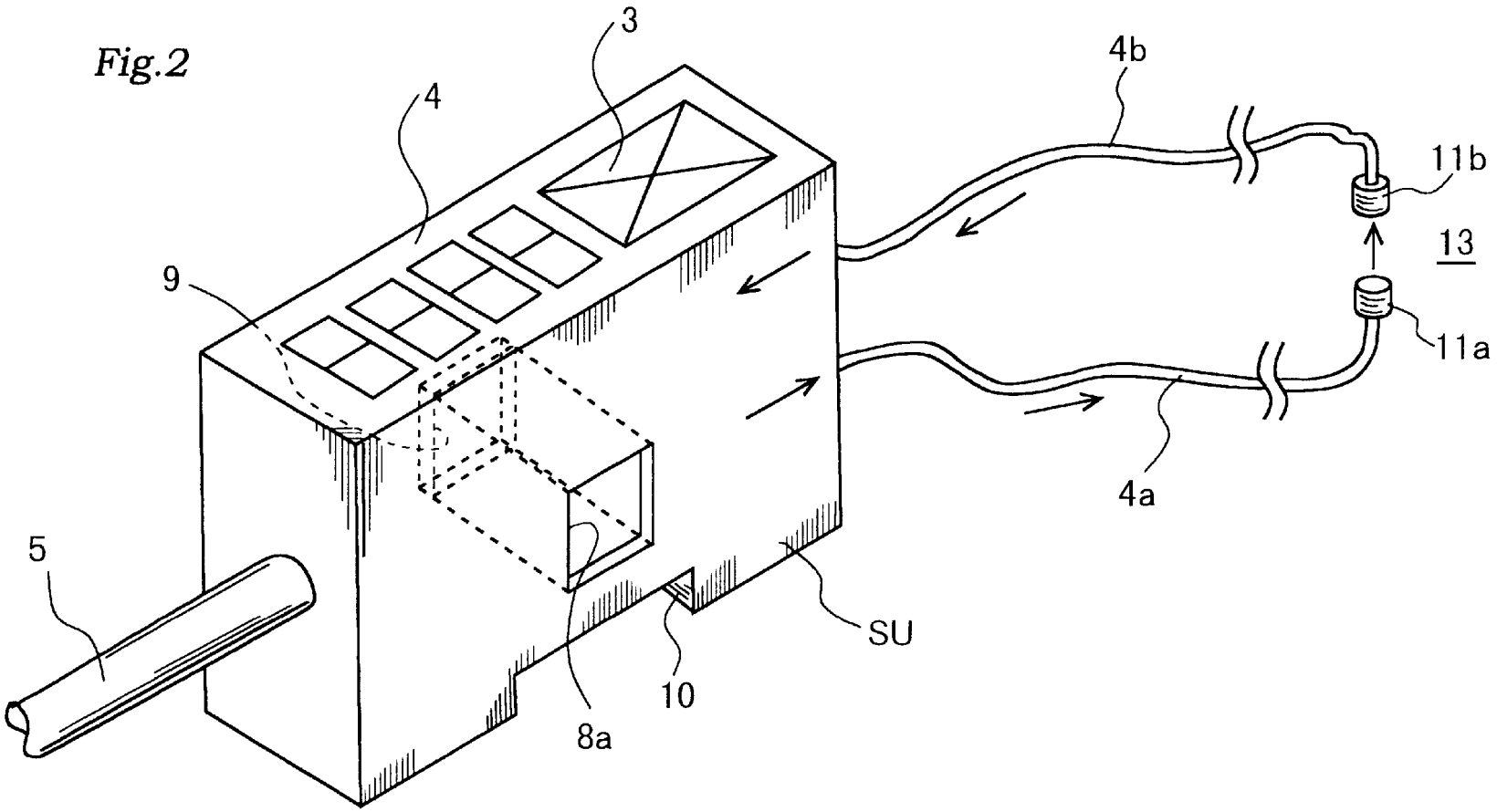
FIG. 2 is a perspective view of one of the sensor units.

FIG. 2 is a perspective view showing the external appearance of one of the sensor units.

As shown in the drawing, windows 8 and 9 for emitting and receiving light are formed on either side of the somewhat narrow, rectangular housing of the sensor unit SU. The windows 8 and 9 may appear as openings in the drawings, but are closed by filter members for shutting off visible light. In the drawing, numeral 10 denotes a mounting groove for the DIN rail, and numerals 11*a* and 11*b* denote a pair of sensor heads. More specifically, the light emitted from a light emitting device in the housing not shown in the drawing is forwarded to the sensor head 11*a* via the outgoing optical fiber 4*a*, and is then projected into a detection region 13. The light transmitted through the detection region 13 is detected by the detector head 11*b*, and is returned to the interior of the housing of the sensor unit to be detected by a light receiving element not shown in the drawing via the incoming optical fiber 4*b*.

Figure 3:
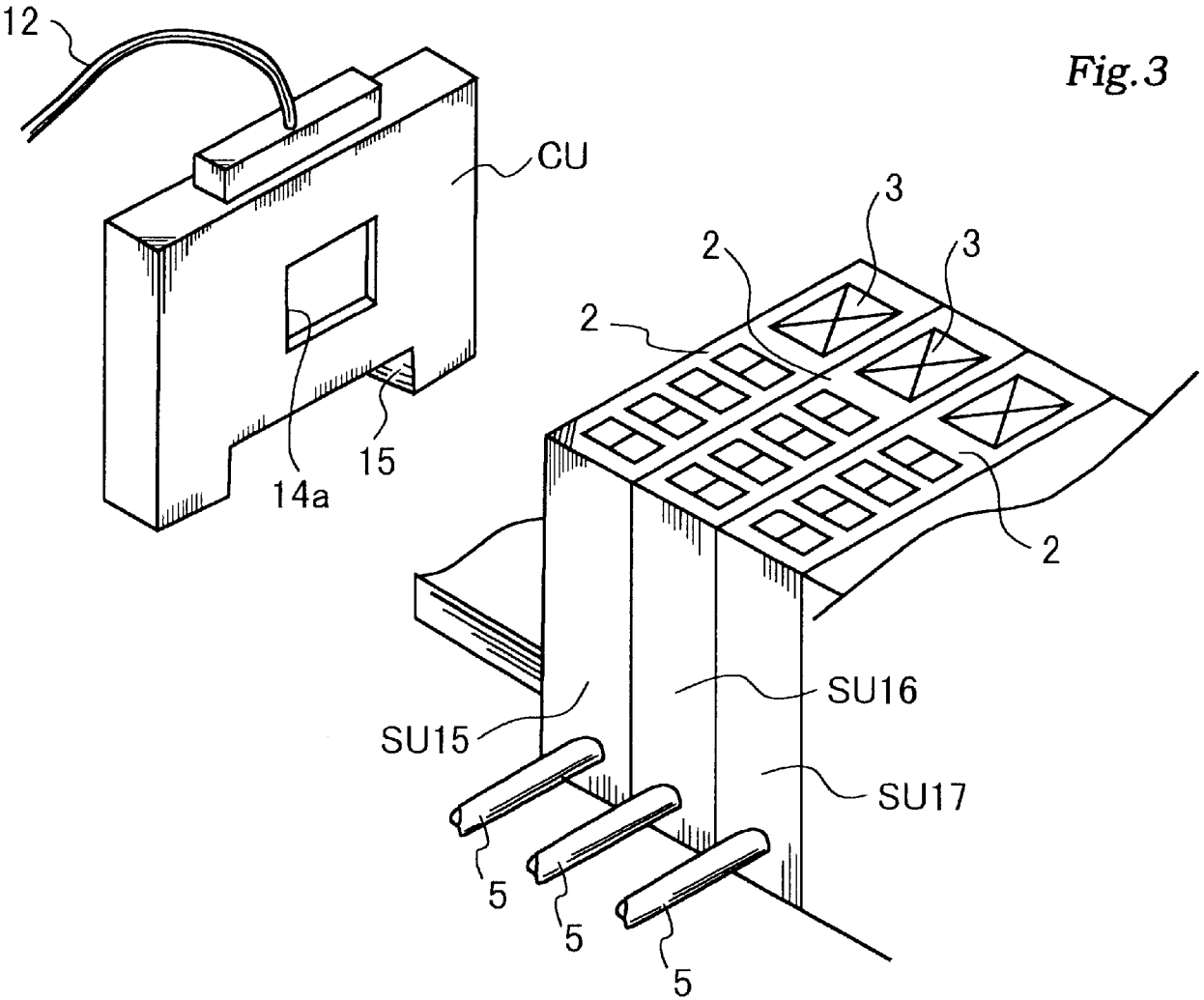
FIG. 3 is a perspective view of the connector unit leading to the mobile console.

FIG. 3 is a perspective view showing the connector unit CU connected to the mobile console MC. As shown in this drawing, a light emitting/receiving window 14 is formed on one side of the connector unit CU, and opposes the light emitting/receiving window 9 of the sensor unit SU15 located at the left end of the sensor unit array. The light emitting/receiving window 14 is also fitted with a filter for shutting off visible light.

The light emitting/receiving windows 8 and 9 of the sensor unit SU, and the light emitting/receiving window 14 of the connector unit CU are each incorporated with a pair of light emitting and receiving elements serving as an optical connector.

Figure 4:
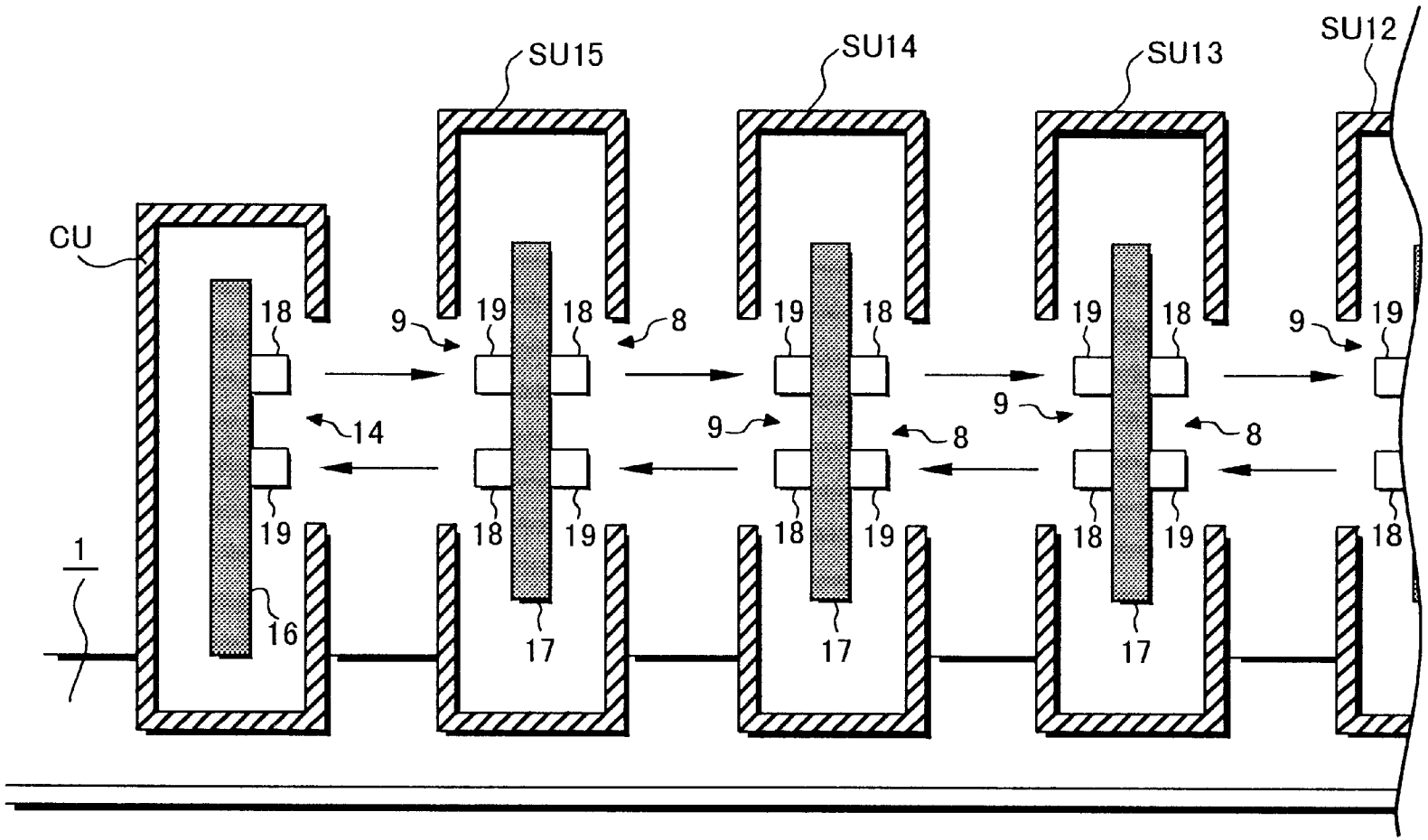
FIG. 4 is a schematic view of the arrangement of the connector unit and the light emitting/receiving elements of the sensor units.

FIG. 4 is a sectional view schematically illustrating the arrangement of the light emitting/receiving elements in the connector unit CU and the sensor unit array SU0 to SU15.

As shown in the drawing, the connector unit CU and the sensor units SU are each incorporated with a circuit board 16 or 17 carrying various electronic components. The circuit board 16 of the connector unit CU carries a light emitting element 18 and a light receiving element 19 one next to the other on one side thereof. The light receiving and emitting elements 18 and 19 directly oppose the light emitting/receiving window 14.

The circuit board 17 in each sensor unit SU carries two pairs of light emitting/receiving elements 18 and 19 on either side thereof which directly oppose the light emitting/receiving windows 8 and 9, respectively.

In other words, each of the sensor units SU0 to SU15 is provided with a pair of optical connectors which are capable of transmitting and receiving signals to and from the adjacent sensor units. Each of the optical connectors comprises a pair of light emitting/receiving elements (the upper light emitting/receiving elements 18 and 19 and the lower light emitting/receiving elements 18 and 19 of FIG. 4) in reversed arrangement from one pair to another so as to oppose the corresponding light emitting/receiving elements of the adjacent sensor units.

Therefore, appropriately activating the light receiving and emitting elements 18 and 19 enables a bi-direction communication between the adjacent sensor units, and between the sensor unit SU15 and the connector unit CU as indicated by the arrows in the drawing.

Figure 5:
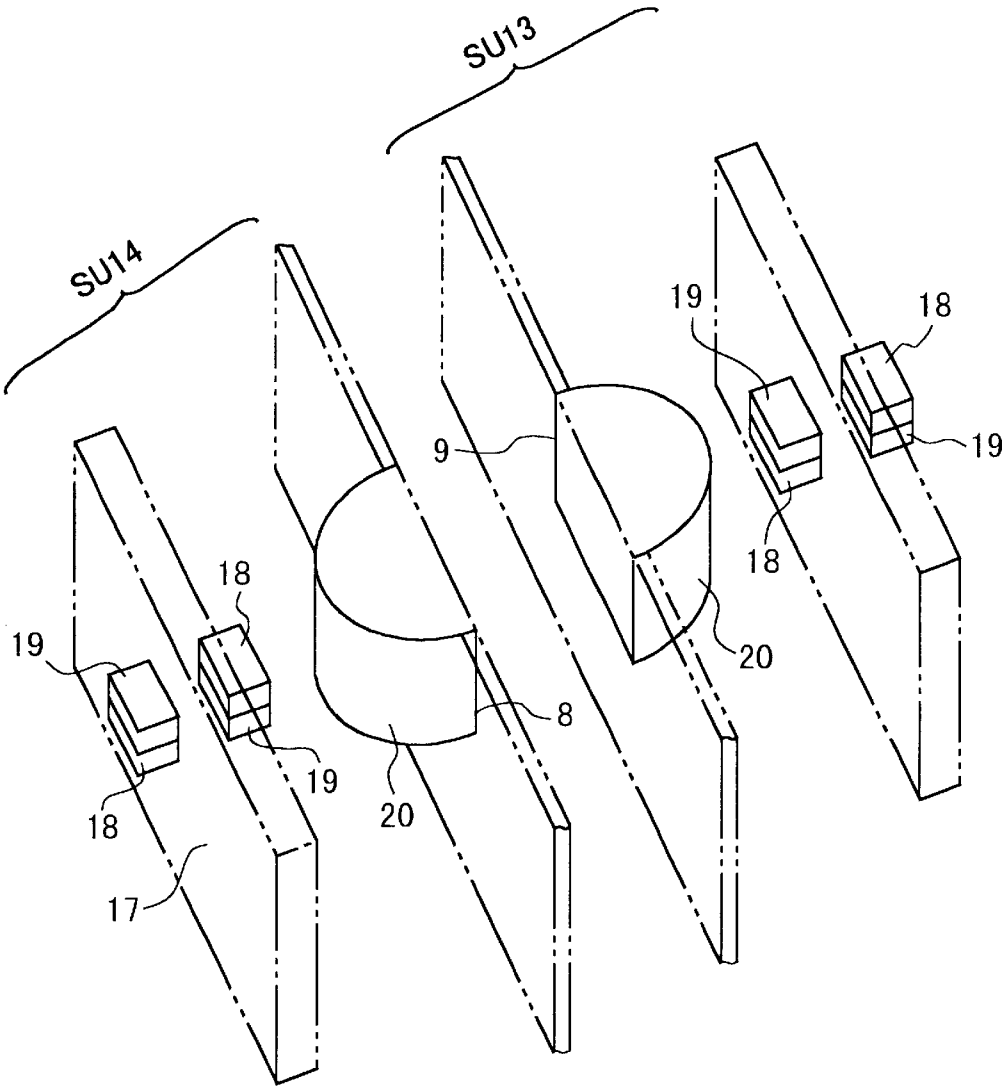
FIG. 5 is a perspective view of the arrangement of the light emitting/receiving elements and lenses of two adjacent sensor units.

FIG. 5 is a perspective view showing the arrangement of the light emitting/receiving elements and lenses of two adjacent sensor units.

As shown in the drawing, each of the adjacent sensor units SU13 and SU14 is incorporated with a circuit board 17 which carries a light emitting element 18 and a light receiving element 19 one next to the other on each side thereof. The light emitting/receiving elements 18 and 19 reverse their arrangement from one side of the circuit board 17 to another. Each light emitting/receiving window is fitted with a semi-cylindrical lens 20 so that the emission and reception of light can be effected via the light emitting/receiving window in an efficient manner. The light emitting element 18 in this embodiment consists of an infrared light emitting diode.

Figure 6:
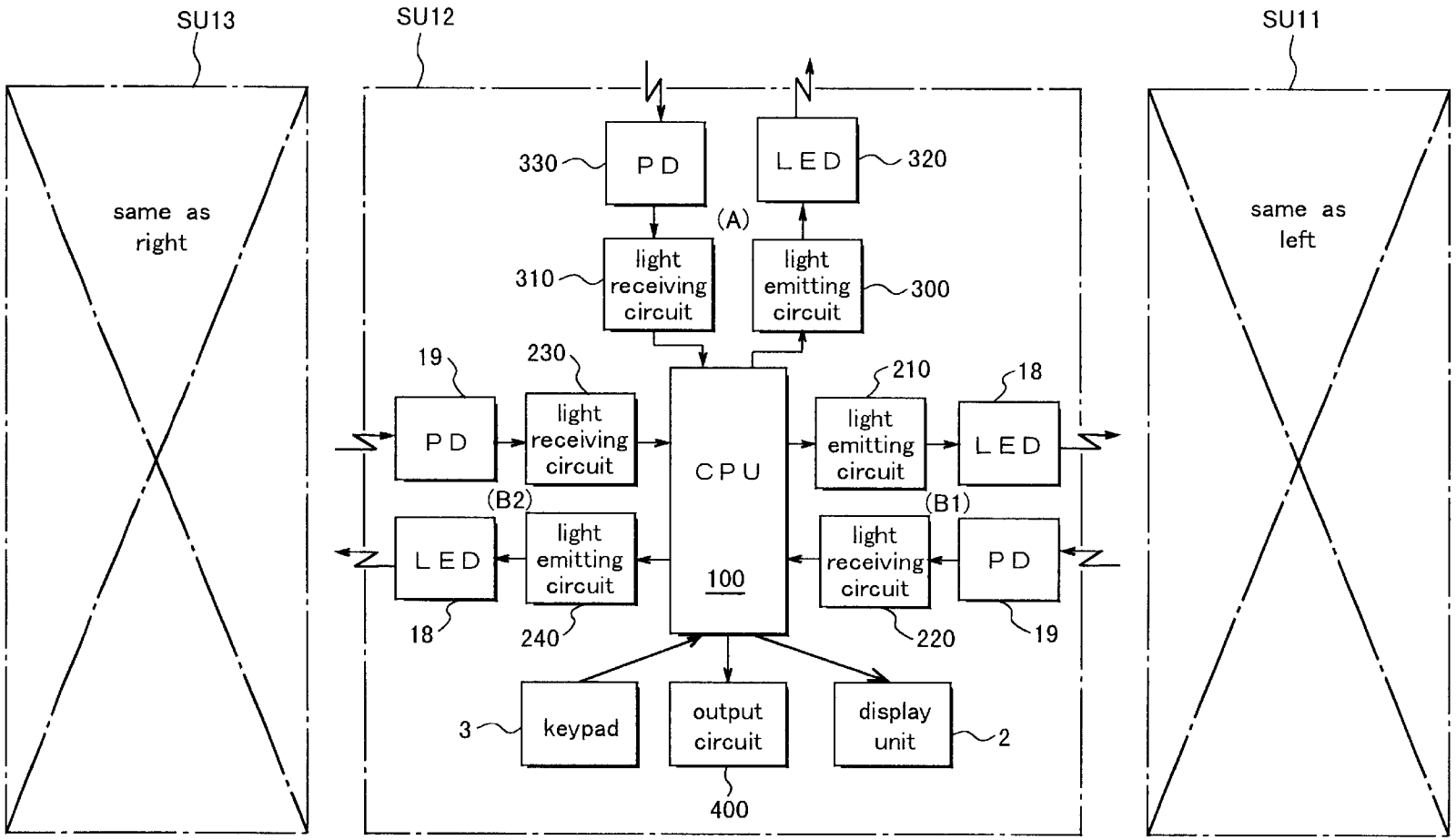
FIG. 6 is a simplified block diagram of the electric structure of each sensor unit.

FIG. 6 is a block diagram schematically illustrating the electric arrangement of each sensor unit.

This electric circuit essentially consists of a sensing circuit unit (A), a right communication circuit unit (B1), and a left communication circuit unit (B2).

The sensing circuit unit (A) comprises a light emitting circuit 300, a light emitting element (LED) 320, a light receiving element (PD) 330, and a light receiving circuit 310.

The right communication circuit unit (B1) comprises a light emitting circuit 210, a light emitting element (LED) 18, a light receiving element (PD) 19, and a light receiving circuit 220.

The left communication circuit unit (B2) likewise comprises a light emitting circuit 240, a light emitting element (LED) 18, a light receiving element (PD) 19, and a light receiving circuit 230.

The CPU 100 essentially consists of a microprocessor, and executes the various functions with the aid of software as described hereinafter.

The output circuit 400 produces the light reception data obtained from the aforementioned sensing circuit unit (A) simply as a digital value or as a binary signal serving as a switching signal according to a prescribed threshold level.

Figure 7:
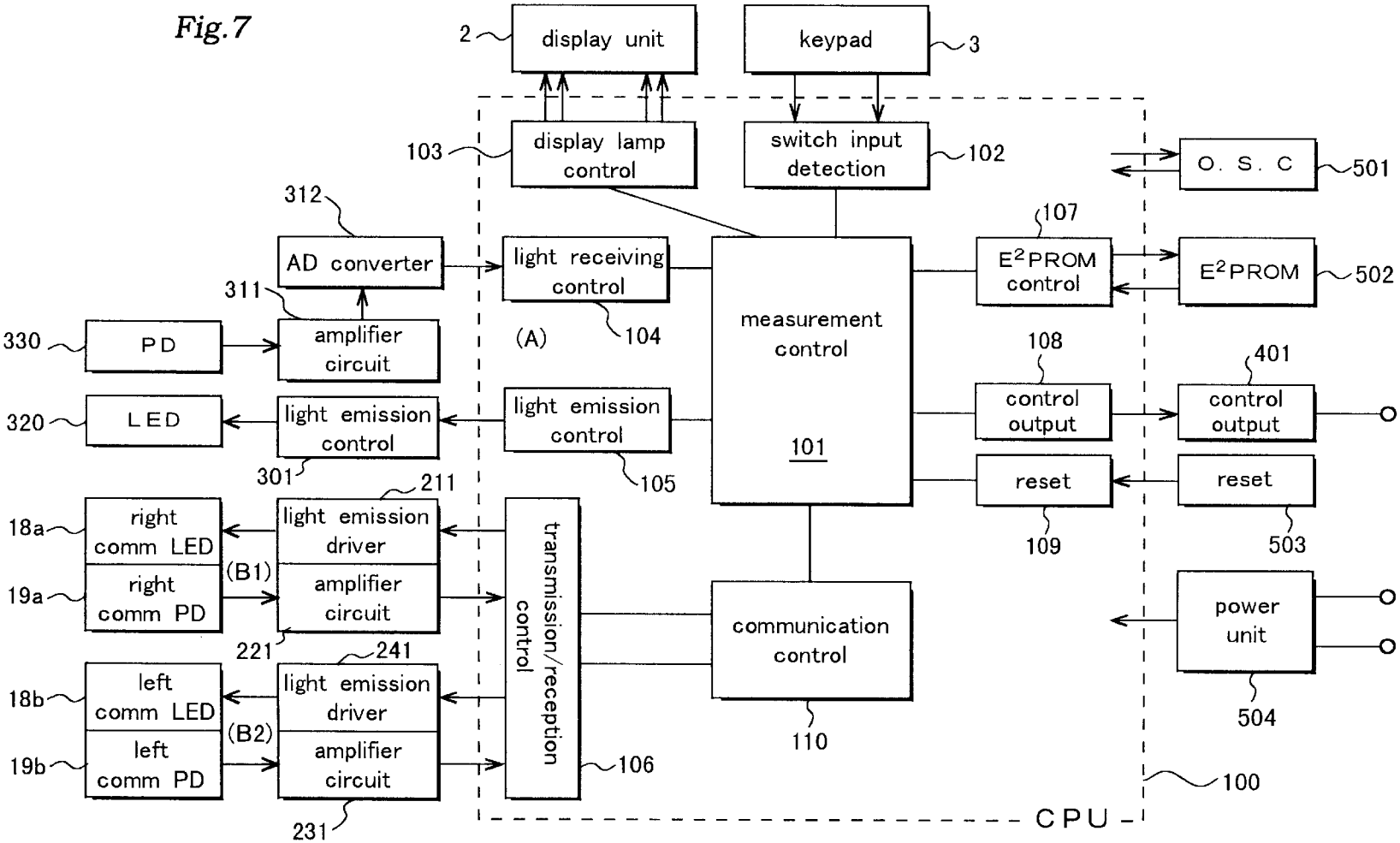
FIG. 7 is a more detailed block diagram of the electric structure of each sensor unit.

FIG. 7 is a block diagram illustrating the electric structure of the sensor unit in greater detail.

In the drawing, the blocks denoted with numerals in the one hundreds represent functions and processes accomplished by the microprocessor of the CPU 100 with the aid of software. The blocks denoted with numerals in the two hundreds represent functions and processes accomplished by hardware such as electric circuits.

As shown in the drawing, the CPU 100 is incorporated with a measurement control process unit 101, a switching input detection process unit 102, a display lamp control process unit 103, a light receiving control process unit 104, a light emitting control process unit 105, a transmission/reception control process unit 106, an EEPROM control process unit 107, a control output process unit 108 and a reset process unit 109 all of which are implemented by software.

First of all, the sensing circuit unit (A) is described in the following.

The measurement control process unit 101 controls a light emitting control circuit 301 via the light emitting control process unit 105 to drive the light emitting element (LED) 320, causing an infrared light beam to be produced therefrom. The infrared light beam is projected into the detection region via the outgoing optical fiber, and eventually reaches the light receiving element (PD) 330 via the incoming optical fiber. The output from the incoming optical fiber is amplified by an amplifier circuit 311, and is converted into a digital signal by an A/D converter 312. The digital signal is then forwarded to the control output process unit 101 via the light receiving control process unit 104.

The measurement control process unit 101 forwards the light reception data, via the control output process unit 108, to the control output circuit 401 as it is or after converting the light reception data into binary data according to a prescribed threshold level, and sends it out to the outside.

The right and left communication circuit units (B1 and B2) are described in the following.

The communication control process unit 110 controls the transmission/reception control process unit 106 so that the right communication light emitting element (LED) 18*a* may be driven by a light emitting driver circuit 211, and a light signal may be transmitted to the right adjacent sensor unit. The light signal transmitted from the right adjacent sensor unit is received by the right communication light receiving element (PD) 19*a*, and after being amplified by an amplifier circuit 221, is forwarded to the communication control process unit 110 via the transmission/reception control process unit 106.

Likewise, the transmission/reception control process unit 106 drives the left communication light emitting element (LED) 18*b* via a light emitting driver circuit 241, and transmits a light signal to the left adjacent sensor unit. The light signal transmitted from the left adjacent sensor unit is received by the left communication light receiving element (PD) 19*b*, and after being amplified by an amplifier circuit 231, is forwarded to the communication control process unit 110 via the transmission/reception control process unit 106.

In this manner, the communication control process unit 110 carries out a data communication between adjacent sensor units according to a prescribed protocol and transmission/reception format.

The display lamp control process unit 103 drives display lamps (LED) forming the display unit 2, and the switch input detection process unit 102 detects an input from the switches and buttons of the keypad 3. The EEPROM control process unit 107 controls the write/read operation on EEPROM 502 provided outside the CPU.

The reset process unit 109 executes a reset process on the measurement control process unit 101 according to the signal from a reset unit 503. A power unit 504 supplies electric power to the CPU 100 and external hardware circuits.

Figure 8:
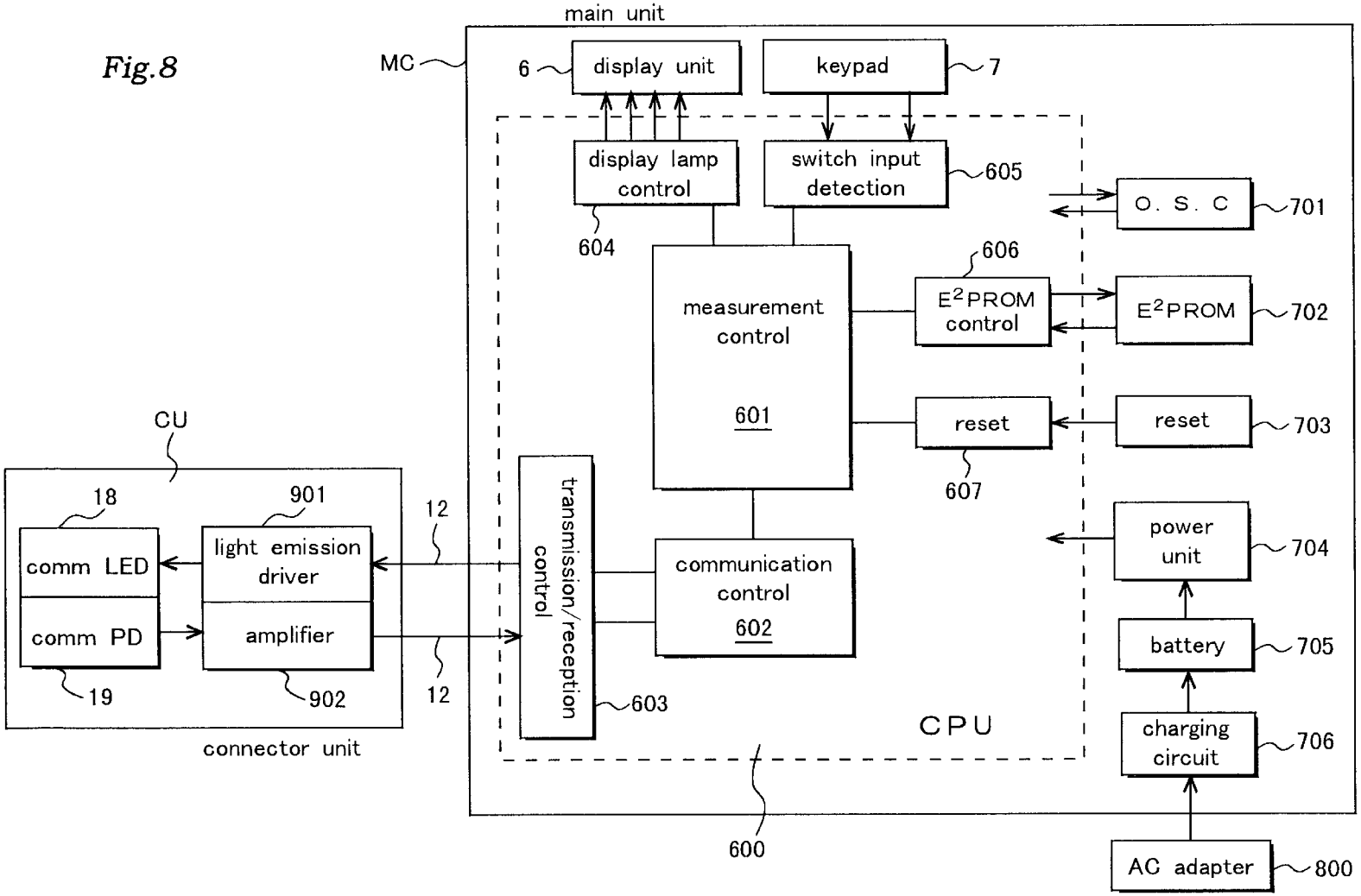
FIG. 8 is a block diagram of the electric structure of the mobile console.

FIG. 8 is a block diagram showing the electric structure of the mobile console.

As shown in the drawing, this electric circuit generally consists of a circuit portion corresponding to a mobile console MC and a circuit portion corresponding to a connector unit CU.

The circuit portion corresponding to the mobile console MC in turn comprises process units 601 to 607 which are realized by software and circuit units 701 to 706 which are realized by hardware consisting of electric circuits. Numeral 800 denotes an AC adapter for battery recharging.

The process units which are realized by the CPU 600 with the aid of software comprises a measurement control process unit 601, a communication control process unit 602, a transmission/reception control process unit 603, a display lamp control process unit 604, a switching input detection process unit 605, an EEPROM control process unit 606 and a reset process unit 607 which are formed by software.

The circuit units which are formed by hardware comprises an oscillation circuit (OSC) 701, EEPROM 702, a reset unit 703, a power unit 704, a battery unit 705 and a recharging unit 706.

The circuit portion corresponding to the connector unit (CU) comprises a light emitting driver circuit unit 901, a communication light emitting element (LED) 18, a communication light receiving element (PD) 19 and an amplifier circuit 902.

The above described structure operates as follows. The measurement control process unit 601 controls the transmission/reception control process unit 603 via the communication control process unit 602 so as to drive the communication light emitting element (LED) 18 via the light emitting driver circuit unit 901, and project a light signal to the sensor unit SU15 adjacent to the connector unit CU. The light signal from the sensor unit SU15 is received by the communication light receiving element (PD) 19, and the output therefrom is amplified by the amplifier circuit 902 before it is forwarded to the communication control process unit 602 via the transmission/reception control process unit 603.

In this manner, the communication control process unit 602 conducts signal transmission and reception to and from the sensor unit SU15 via the connector unit CU according to a prescribed protocol and communication format.

The mobile console MC can be recharged by the AC adapter 800. This can be accomplished by supplying the AC power from the AC adapter 800 to the battery unit 705 via the recharging circuit unit 706. The DC power obtained from the battery unit 705 is stabilized by the power unit 704, and is supplied to the internal circuits such as the CPU 600.

Figure 9:
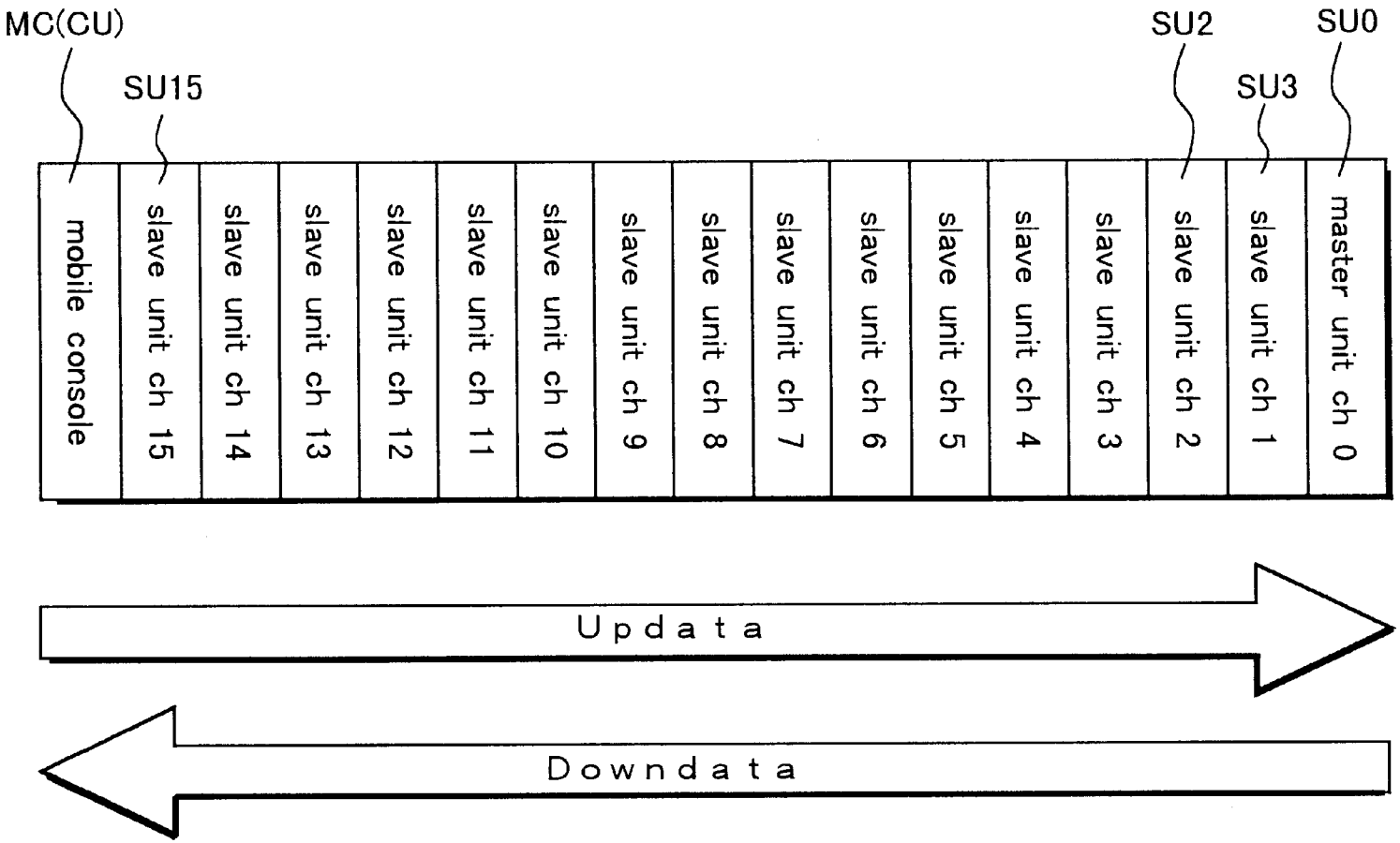
FIG. 9 is a schematic view illustrating the mode of allocating channels to the master and slave sensor units, and the mobile console.

FIG. 9 illustrates the mode of channel (address) allocation by the master and slave sensor units and the mobile console.

As can be appreciated from the drawing, when the sensor units SU0 to SU15 and the mobile console MC (CU) are arranged in that order, the channel allocation is effected in such a manner that the sensor unit SU0 is a master unit (ch 0), the sensor unit SU1 is a slave unit (ch 1), and the sensor units SU2 (ch 2) to SU15 (ch 15) are slave units. The mobile console MC is assigned with ch 63 as a fixed setting. Further, the data which is forwarded from the mobile console MC to the master sensor unit SU0 is called "updata", and the data which is forwarded from the master sensor unit SU0 to the mobile console MC is called "downdata".

The channel allocation can be accomplished either in a fixed manner by using a DIP switch or the like or in an automatic manner by incorporating the function to identified its own position in relation with the others into each sensor unit.

The optical fiber photoelectric sensor units forming the sensor unit array (SU0 to SU15) each repeat light emission for sensing purpose at the interval of 100 $\mu$s, for instance. For each particular pair of sensor units adjacent to each other, the timing of the sensing light emission is about 10 $\mu$us earlier for the sensor unit on the side of the master unit (ch 0) than the sensor unit on the other side of the master unit. This delay in the timing of light emission is created by sequentially delaying the light emission timing signal by 10 μs from the master unit to the mobile console (ch 16). This time delay of 10 μs prevents interferences of the light emissions between adjacent sensors.

Figure 10:
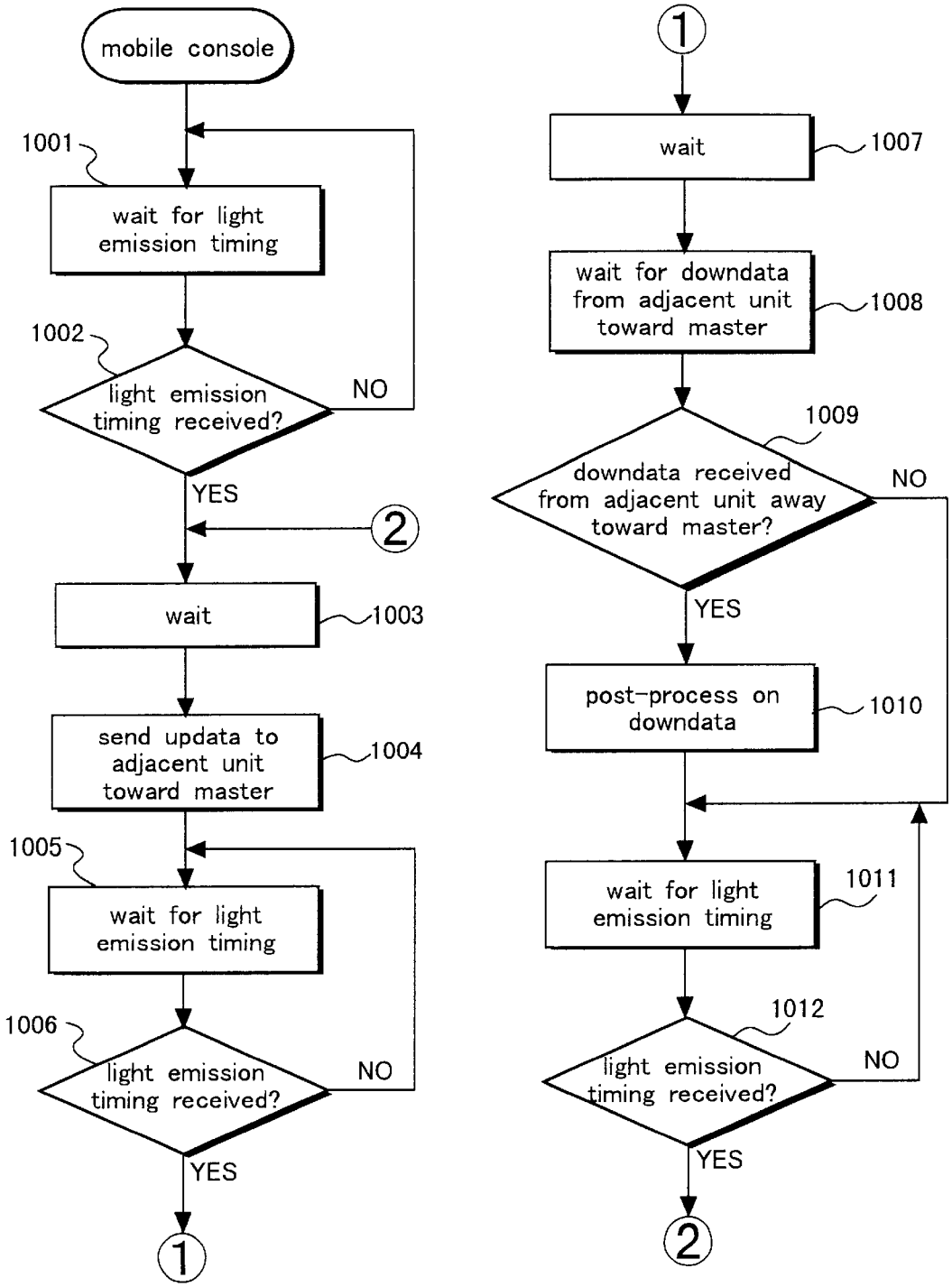
FIG. 10 is a flowchart showing the communication process at the mobile console.

FIG. 10 shows a flowchart of the communication process at the mobile console.

As shown in the drawing, this communication process is executed in response to the arrival of a light emitting timing signal from the sensor unit SU15 adjacent to the mobile console. As can be appreciated from the foregoing description, the light emission timing signals are sequentially transferred from the master unit (ch 0) to the mobile console (MC) in the manner of a bucket brigade. Referring to this drawing, when the process is started, the system waits for the arrival of a light emitting timing signal from the sensor unit SU15 adjacent to the mobile console (steps 1001 and 1002-no).

When a light emitting timing signal arrives from the sensor unit SU15 adjacent to the mobile console under this condition (step 1002-yes), after executing a wait process for a prescribed time period (step 1003), if required, updata is transmitted to the sensor unit SU15 which is adjacent to the mobile console on the side of the master sensor unit (step 1004). Thereafter, the system likewise waits for the arrival of a light emitting timing signal from the sensor unit SU15 adjacent to the mobile console MC (steps 1005 and 1006-no).

The updata may contain a monitor command, data setting command, disable command and concealed function executing command.

When a light emitting timing signal arrives from the sensor unit SU15 adjacent to the mobile console under this condition (step 1006-yes), after executing a wait process for a prescribed time period (step 1007), the system waits for the receipt of downdata from the sensor unit SU15 which is adjacent to the mobile console from the side of the master sensor unit (step 1008).

If downdata is received from the sensor unit SU15 which is adjacent to the mobile console MC during this waiting period (step 1009-yes), a prescribed post-process is performed on the received downdata (step 1010). The post process (step 1010) includes the storing process for the monitoring data or the like. On the other hand, if no downdata is received from the sensor unit SU15 which is adjacent to the mobile console MC during this waiting period (step 1009-no), the post-process on the downdata (step 1010) is skipped, and the system again waits for the arrival of a light emitting timing signal from the sensor unit SU15 adjacent to the mobile console (steps 1011 and 1012-no).

Thereafter, every time a light emitting timing signal arrives at the sensor unit SU15 (step 1012-yes), the program flow returns to step 1003, and the subsequent steps (steps 1003 to 1012) are repeated.

In this manner, the mobile console MC alternately repeats the transmission of updata to the sensor unit SU15 which is adjacent to the mobile console from the side of the master sensor unit (step 1004), and the post-process on the downdata from the sensor unit SU15 (step 1010) in response to each arrival of a light emitting timing signal.

FIGS. 11 to 14 show the flowchart of the communication process in the manner of a bucket brigade at each sensor unit.

The communication process at each sensor unit SU differs slightly depending on if the sensor unit is a master unit or a slave unit. The flowchart shown in FIGS. 11 to 14 describes both the cases where the sensor unit is a master unit and a slave unit. Each sensor unit may be identified as a master unit or a slave unit during the power-on initialization process in which each sensor unit sends a handshake signal to the two adjacent sensor units. If the two adjacent sensor units respond to the handshake signal, the sensor unit in question is identified as a slave unit. If there is no response from the right adjacent sensor unit, the sensor unit in question is identified as a master unit. If there is no response from the left adjacent sensor unit, the sensor unit in question is identified as a slave unit on the left end.

Figure 11:
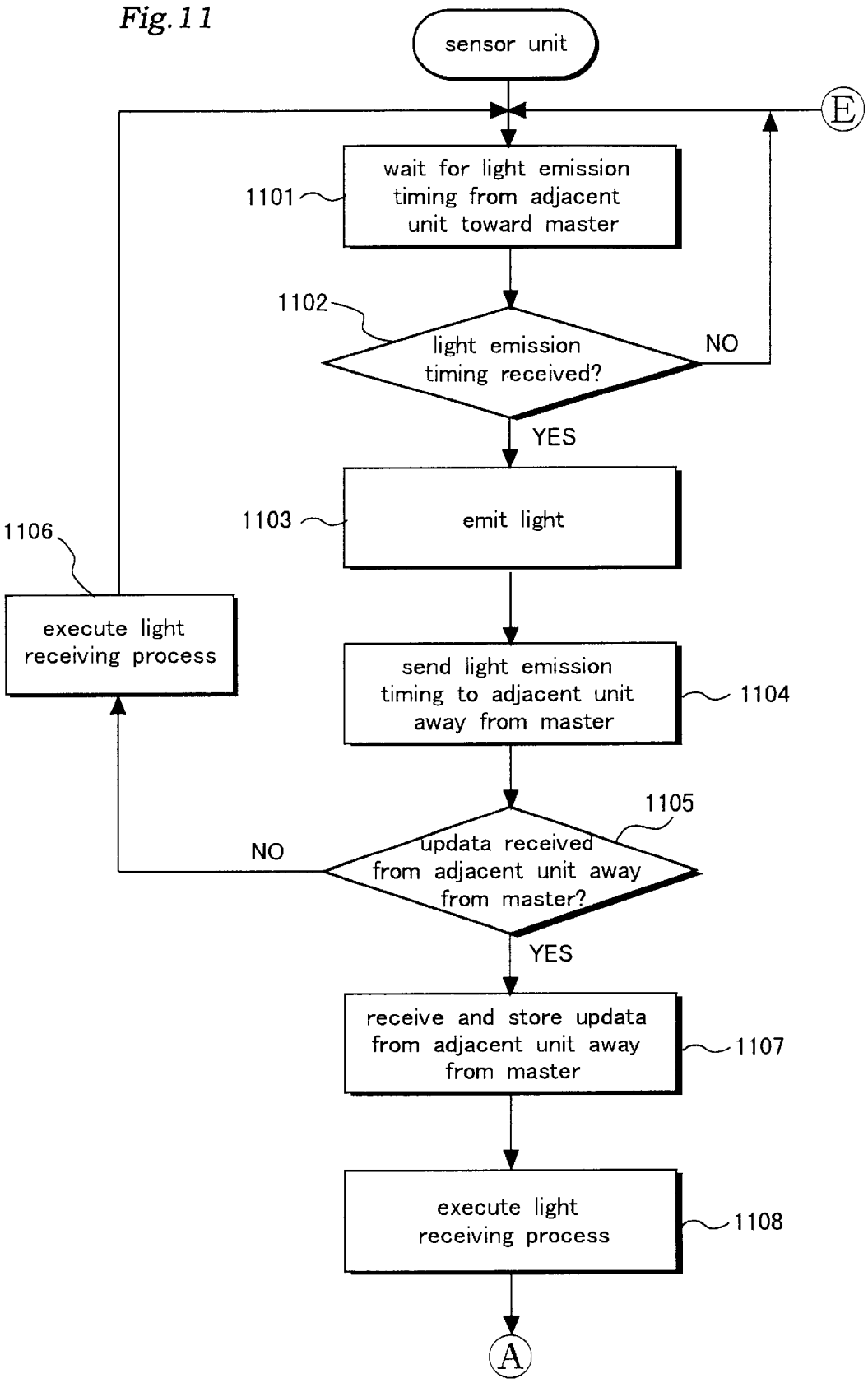
FIG. 11 is a flowchart showing the communication process at each sensor unit (part 1)

When the process shown in FIG. 11 is started, each slave sensor unit waits for the arrival of a light emitting timing signal from the adjacent sensor unit on the side of the master sensor unit (steps 1101 and 1102-no).

Under this condition, if a light emitting timing signal arrives from the adjacent sensor unit on the side of the master sensor unit (step 1102-yes), a light emitting process is executed for the light emitting element of the sensing system which was described earlier (step 1103), and, then, the process of transmitting a timing signal to the adjacent sensor unit on the other side of the master unit is executed (step 1104). As each sensor unit repeats this process, the aforementioned time delay (10 μs, for instance) for light emission is created.

Thereafter, it is determined if updata has been received from the adjacent sensor unit on the other side of the master unit (step 1105). If there was no reception of updata (step 1105-no), the light receiving process (conversion into binary data according to a threshold level, and external output process for the result of the binary conversion) is conducted on the output data (light receiving data) from the light receiving element (PD) (numeral 330 of FIG. 7) of the sensing system (step 1106), and the system again waits for the arrival of a light emitting timing signal from the adjacent sensor unit on the side of the master unit (steps 1101 and 1102-no). The master sensor unit on the other hand does not wait for the arrival of a light emitting timing signal, but executes the light emitting process at a regular interval which is set by a timer (step 1103).

If the sensor unit receives updata from the adjacent sensor unit on the other side of the master unit during the course of the execution of the above described processes (step 1105-yes), the updata from the adjacent sensor unit on the other side of the master unit is stored (step 1107), and, then, a light receiving process such as a binary process is conducted on the received light data from the light receiving element (PD) (indicated by numeral 330 in FIG. 7) of the sensing system (step 1108). In this example, the updata has issued from the mobile console MC in step 1004 of FIG. 10, and may contain various commands (such as a monitor command or the like).

Figure 12:
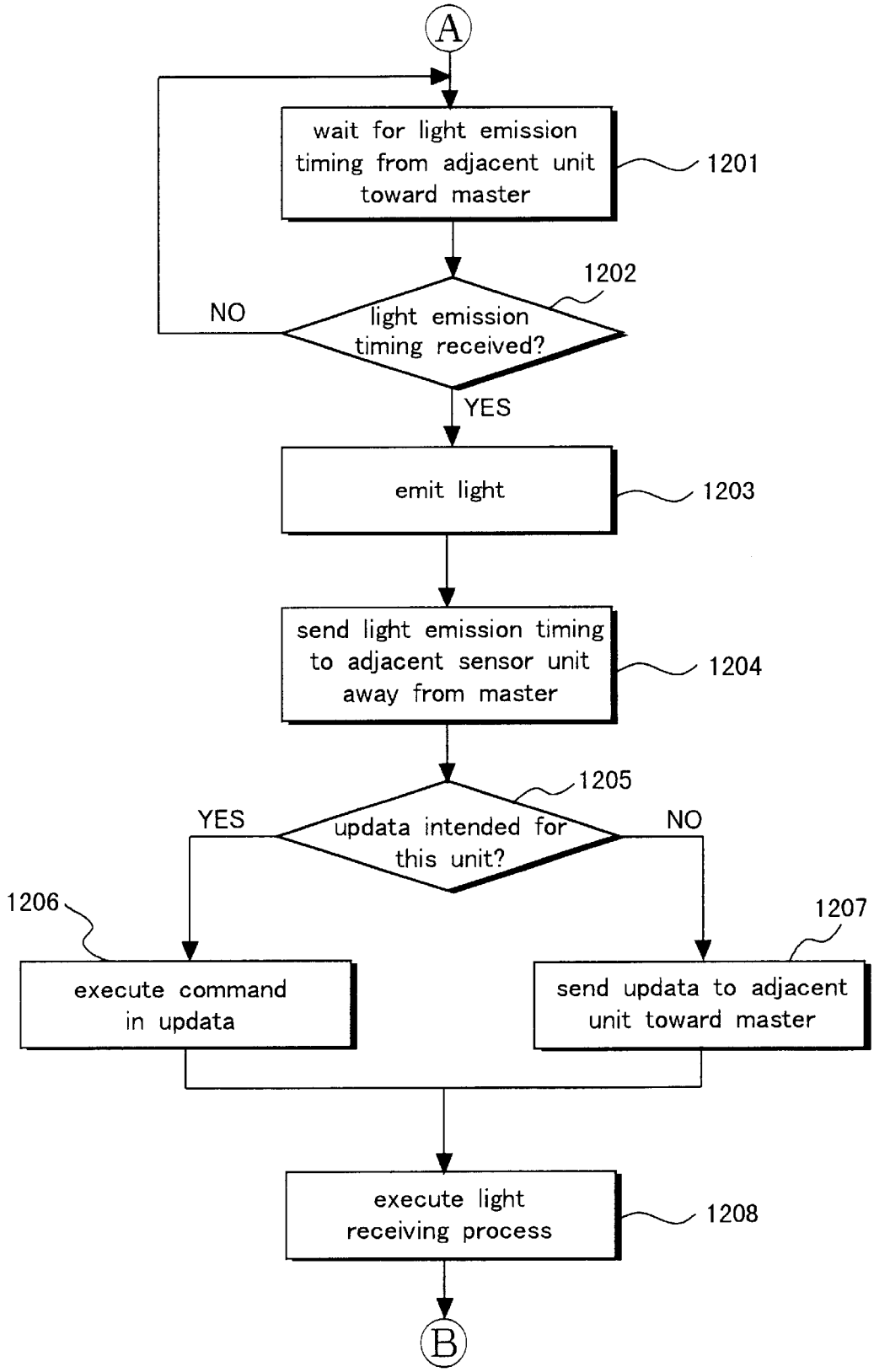
FIG. 12 is a flowchart showing the communication process at each sensor unit (part 2)

Referring to FIG. 12, the program flow advances to a stage where the sensor unit waits for the arrival of a light emitting timing signal from the adjacent sensor unit on the side of the master unit (steps 1201 and 1202-no).

If a light emitting timing signal arrives from the adjacent sensor unit on the side of the master unit under this condition (step 1202-yes), the light emitting process is conducted on the light emitting element (LED) (indicated by numeral 320 in FIG. 7) of the sensing system (step 1203), and it is followed by the transmission of a light emitting timing signal to the sensor unit on the other side of the master unit (step 1204).

Thereafter, it is determined if the updata stored in step 1107 is intended for the particular sensor unit or not (step 1205).

If the data which is received and stored is determined to be intended for the particular sensor unit (step 1205-yes), the process corresponding to the command included in the updata is executed (step 1206). The command may comprise a monitor command, data setting command, operation disable command and concealed function executing command.

If the command consists of a monitor command, the data corresponding to a monitoring item designated by the monitor command is read out, and is edited as monitoring data. The monitoring items may include the current received light level, threshold level and so on.

If the command consists of a data setting command, the data attached to the data setting command is written into a setting item designated by the command. The setting items may include the threshold level for binary conversion of the detected value, the set times for the output on-delay timer and output off-delay time, detection mode and so on.

If the command consists of an operation disable command, the key operation of the sensor unit corresponding to the function designated by the operation disable command is disabled. The operation that may be disabled may comprise the teaching for automatically setting a threshold level, zero resetting for the offsetting of the detected value relative to the background level, and changing the set times for the output on-delay timer and output off-delay timer.

If the command consists of a concealed function executing command, the concealed function which cannot be invoked by the key operation on the sensor unit is executed. The concealed functions may comprise changing the timer mode, and conducting a communication test. The timer modes may include an off-delay timer for delaying the change from on to off of the output to extend the on time, on-delay timer for delaying the change from off to on of the output to eliminate short on-outputs, and one shot timer mode for producing an on output of a prescribed time duration upon each change from off to on.

On the other hand, if the updata is not determined to be intended for the particular sensor unit (step 1205-no), the updata is transmitted to the adjacent sensor unit on the side of the master unit (step 1207). Thereby, the updata transfer function is achieved by the slave sensor unit.

Thereafter, the light receiving process such as the binary convenrsion process and outside output process is conducted according to the light data received from the light receiving element (PD) (step 1208).

Figure 13:
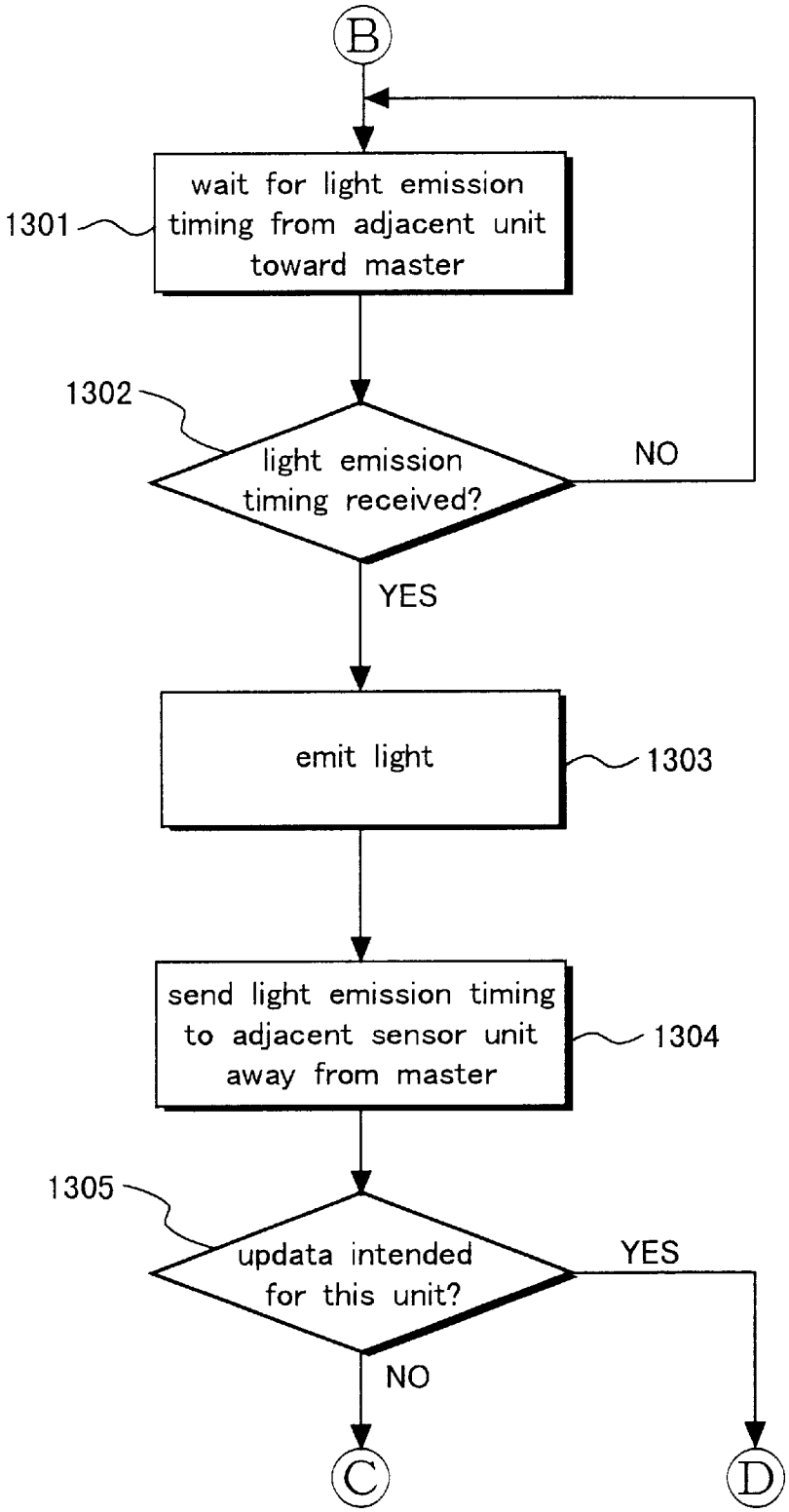
FIG. 13 is a flowchart showing the communication process at each sensor unit (part 3)

Then, referring to FIG. 13, the sensor unit waits for the arrival of a light emitting timing signal from the adjacent sensor unit on the side of the master unit (steps 1301 and 1302-no).

If a light emitting timing signal arrives from the adjacent sensor unit on the side of the master unit under this condition (step 1302-yes), a light emitting process is executed (step 1303), and a light emitting signal is transmitted to the adjacent sensor unit on the side of the master unit (step 1304). Then, it is determined if the updata stored in step 1107 is intended for the particular sensor unit or not (step 1305).

Figure 14:
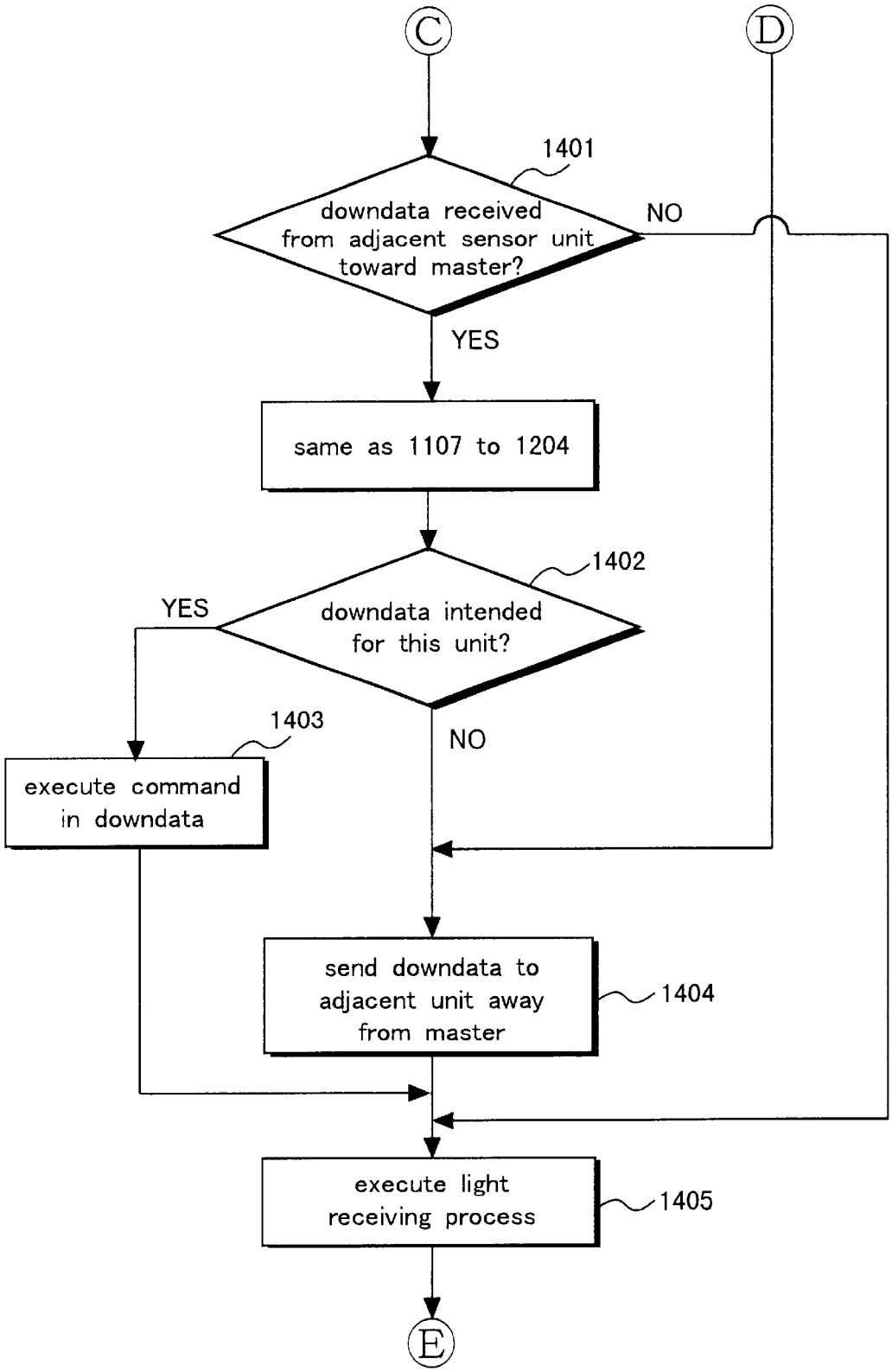
FIG. 14 is a flowchart showing the communication process at each sensor unit (part 4)

If the updata is determined to be intended for the particular sensor unit (step 1305-yes), the program flow advances to the flowchart of FIG. 14. The downdata is transmitted to the adjacent sensor unit on the other side of the master unit (step 1404), and a light receiving process is executed again (step 1405) before the program flow returns to the flowchart of FIG. 11.

On the other hand, if the updata is determined to be not intended for the particular sensor unit in the flowchart of FIG. 13 (step 1305-no), it is then determined if the downdata is received from the adjacent sensor unit on the side of the master unit or not (step 1401). If downdata is received from the sensor unit on the side of the master unit (step 1401-yes), it is then determined if the downdata is intended for the particular sensor unit or not (step 1402).

If the downdata is determined to be intended for the particular sensor unit (step 1402-yes), the process corresponding to the downdata command is executed (step 1403), and a light receiving process is executed (step 1405) before the program flow returns to the flowchart of FIG. 11. Thereby, the downdata transfer function is achieved by the slave sensor unit.

On the other hand, if the downdata is not determined to be intended for the particular sensor unit (step 1402-no), downdata corresponding to a response to a command from the mobile console is transmitted to the adjacent sensor unit on the other side of the master unit (step 1404), and the light emitting process is executed (step 1405) before the program flow returns to the flowchart of FIG. 11.

If it is determined that no downdata is received from the adjacent sensor unit on the side of the master unit (step 1401-no), the light receiving process is simply executed (step 1405) before the program flow returns to the flowchart of FIG. 11.

Referring to the flowchart shown in FIGS. 11 to 14, the master sensor unit executes the light emitting process based on a timer without waiting for the arrival of a light emitting timings signal (steps 1103, 1203 and 1303).

In this manner, the sensor unit which may be assigned either as a master unit or a slave unit relays the updata and downdata if they are not intended for the particular sensor unit. On the other hand, if the updata and downdata are intended for the particular sensor unit, the sensor unit executes the process corresponding to the command contained in the updata (step 1206) and the process corresponding to the command contained in the downdata (step 1403), and transmits the response to such a command to the adjacent sensor unit on the other side of the master unit (step 1404).

The command that may be contained in the downdata command may include a channel allocation command which sequentially arrives from the master unit (SU0) following power-up. When such a channel allocation command arrives as downdata, each sensor unit executes the process of transmitting a channel number (ch N+1) which is incremented by one from the channel number (ch N) attached to the received command to the adjacent sensor unit on the other side of the master unit in step 1403. Repeating this process at each of the sensor units accomplishes the automatic channel allocation function based on free allocation.

The updata and downdata are received in a prescribed order in the embodiment illustrated in FIGS. 10 to 14, but it should be understood only as an example of implementing the data reception process of the present invention. Various modifications from the illustrated embodiment should be obvious for a person skilled in the art, and such modifications may include the process of constantly waiting for the arrival of data either from the adjacent sensor unit on the side of the master sensor unit or the adjacent sensor unit on the other side of the master sensor unit, and executing either the downdata process or updata process depending on which of the adjacent sensor units the data has come from.

Figure 15:
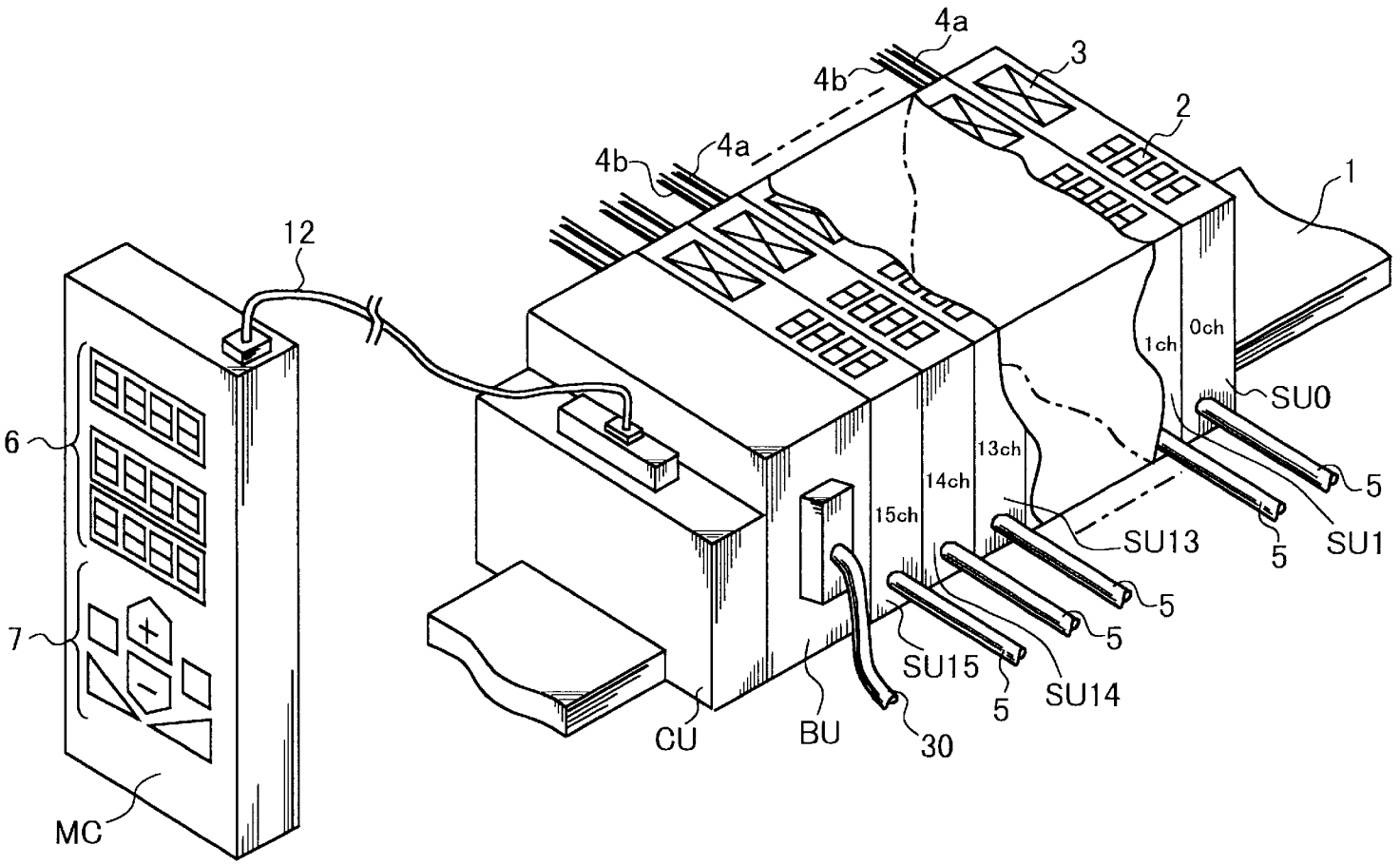
FIG. 15 is a perspective view showing an alternate embodiment of the sensor system according to the present invention.

FIG. 15 is a perspective view showing an alternate embodiment of the sensor system according to the present invention.

Referring to this drawing, the illustrated sensor system comprises a plurality (16 in the case of the illustrated embodiment) of sensor units SU0 to SU15 which are adapted to be arranged closely one next to another and assigned with individual addresses, a bus unit BU which is adapted to be connected to at least one of the sensor units (the left most sensor unit SU15 in the illustrated embodiment), a connector unit CU placed adjacent to the bus unit BU, and a mobile console MC connected to the connector unit CU by an electric cord 12.

The bus unit BU is connected to a field bus not shown in the drawing via an electric cord 30. The "field bus" as used herein means the field network including LAN which is commonly used in the industry of factory automation (FA). The typical types of field bus include ASI, DEVICE Net, Profibus and so on. Typically, PLCs and FA personal computers are connected to such field buses.

The bus unit BU conducts a protocol conversion between the protocol for the optical communication used in the sensor unit array used in the present invention and the field bus which is used for FA (such as ASI, DEVICE Net and so on). Using such a bus unit BU achieves (1) the function to forward the control output of the sensor units SU0 to SU15 to the field bus, (2) the function to receive data on the modification of setting of each sensor unit forwarded from PLC or the like via the field bus, and modifying the setting of the sensor unit according to the data, and (3) the function to transmit the setting condition and detected condition to a PLC of the like via the field bus. In other words, the bus unit BU essentially performs the same functions as the mobile console, and the only different may be found in the party which changes the setting, a human or a PLC (or a FA PC).

Figure 16:
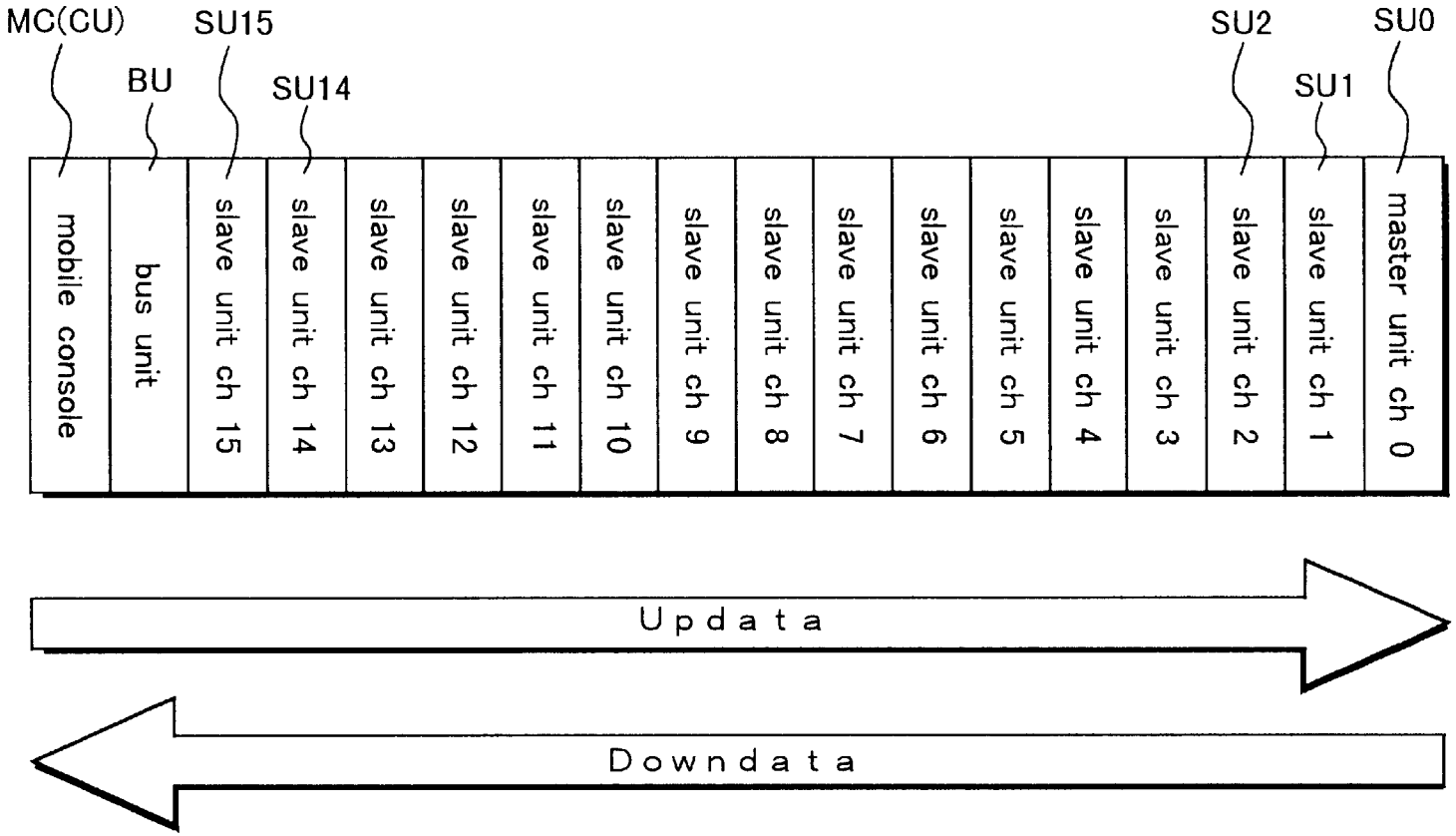
FIG. 16 is a schematic view illustrating the mode of allocating channels to the master and slave sensor units, bus unit and the mobile console.

FIG. 16 illustrates the mode of allocating different channels to the master unit, slave units, bus unit and mobile console.

As shown in the drawing, when the sensor units SU0 to SU15, bus unit BU and mobile console MC are arranged in that order, the sensor unit SU0 is assigned as a master unit (ch 0), the sensor unit SU1 is assigned as a slave unit (ch 1), and the sensor units SU2 to SU15 (ch 2 to ch 15) are assigned as slave units. The bus unit BU is assigned with ch 16, and the mobile console MC is assigned with ch 63 as a fixed setting. The data which is transmitted from the mobile console MC to the master sensor unit SU0 is called as updata, and the data which is transmitted from the master sensor unit SU0 to the mobile console MC is called as downdata.

Figure 17:
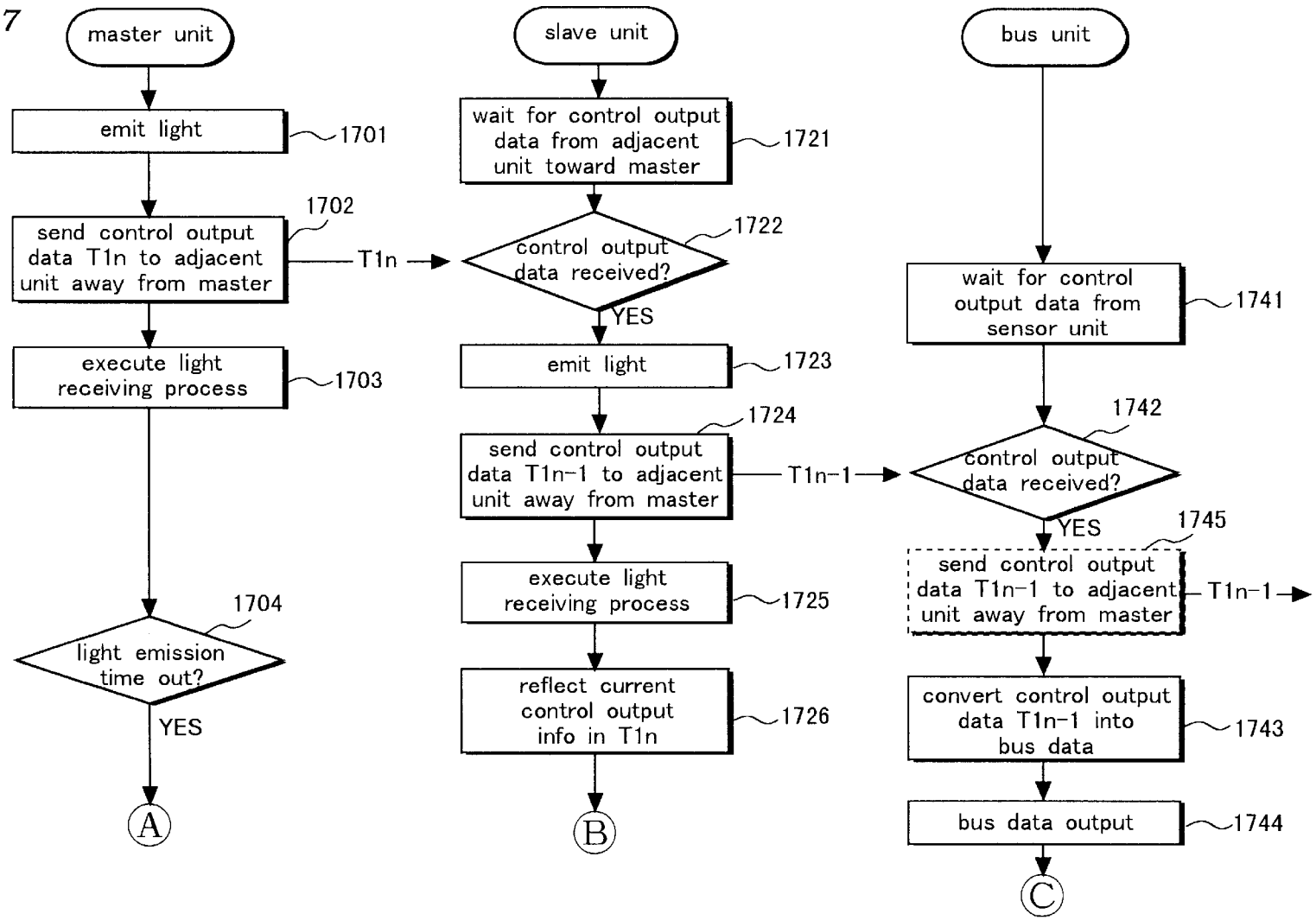
FIG. 17 is a flowchart showing the communication process using the bus unit (part 1)
Figure 18:
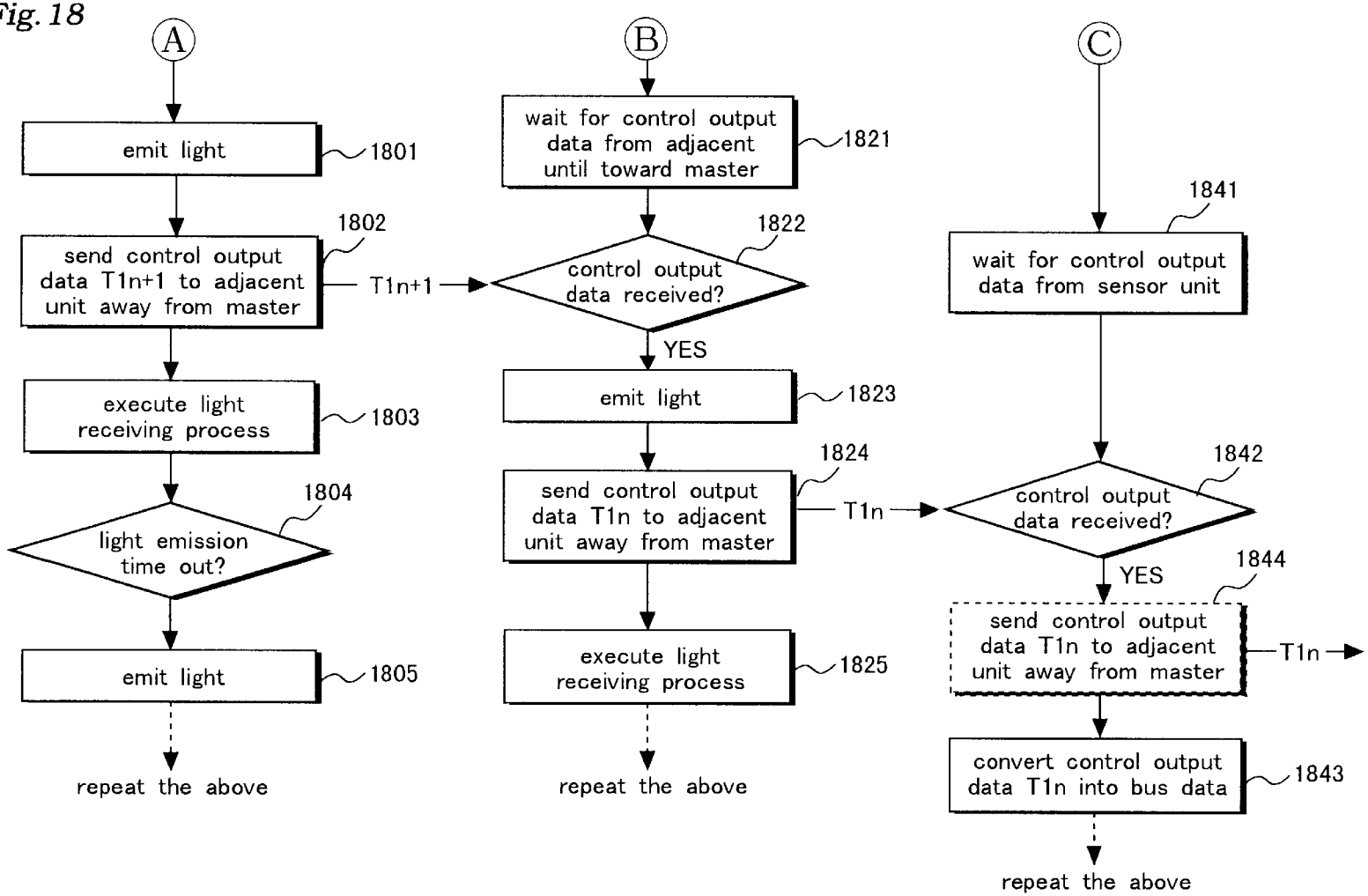
FIG. 18 is a flowchart showing the communication process using the bus unit (part 2)

FIGS. 17 and 18 show a flowchart of the communication process using the bus unit. In FIGS. 17 and 18, the data transfer process for updata and downdata is omitted for the ease of understanding.

Referring to FIG. 17, as the process begins, the master sensor unit executes a light emitting process at a regular interval as a timer controlled process (steps 1701 and 1801). Following each light emitting process, control output data ($T1_n$ and $T1_{n+1}$) is transmitted to the sensor unit on the other side of the master unit (steps 1702 and 1802), and a light receiving process is executed (steps 1703 and 1803). The control output data as used herein comprises switching data obtained by performing a binary conversion on the detected light value. The transmitted control output data also serves a light emitting timing signal.

These processes are repeated at a regular interval determined by the light emitting timing timer (steps 1704 to 1804).

Each slave sensor unit constantly waits for control output data from the adjacent sensor unit on the side of the master unit (steps 1721 and 1821), and executes a light emitting process (steps 1723 and 1823), transmits control output data to the adjacent sensor unit on the other side of the master unit (steps 1724 and 1824), and executes a light receiving process (steps 1725 and 1825) every time control data arrives (steps 1722 and 1822). During the intervals between these actions, a process of reflecting the current control output information of the particular sensor unit in the control output data is executed (step 1726).

The bus unit also constantly waits for control output data from the sensor units (steps 1741 and 1841), and upon arrival of control output data (steps 1742 and 1842), executes the process of converting the control output data into bus data having a prescribed protocol (such as ASI BUS, COMPO BUS/S—tradename of OMRON Co., Ltd of Kyoto, Japan, and DEVICE NET) (steps 1743 and 1843). The obtained bus data is forwarded to the field bus to which a programmable logic controller or FA PC is connected (step 1744).

As a result of executing the aforementioned processes, the output data produced from the sensor units SU0 to SU15 is subjected to a protocol conversion, and is forwarded to the programmable logic controller or FA PC on the field bus via the electric cord 30.

Thus, the use of the bus unit eliminates the need for the output cords 5 otherwise extending from the individual sensor units SU0 to SU15 (the drawing shows the case where the electric cords are not omitted), and thereby substantially simplifies the wiring requirement.

In other words, although an electric cord 5 extends from each sensor unit SU0 to Su15, these electric cords 5 can be replaced with the single electric cord 30.

Figure 19:
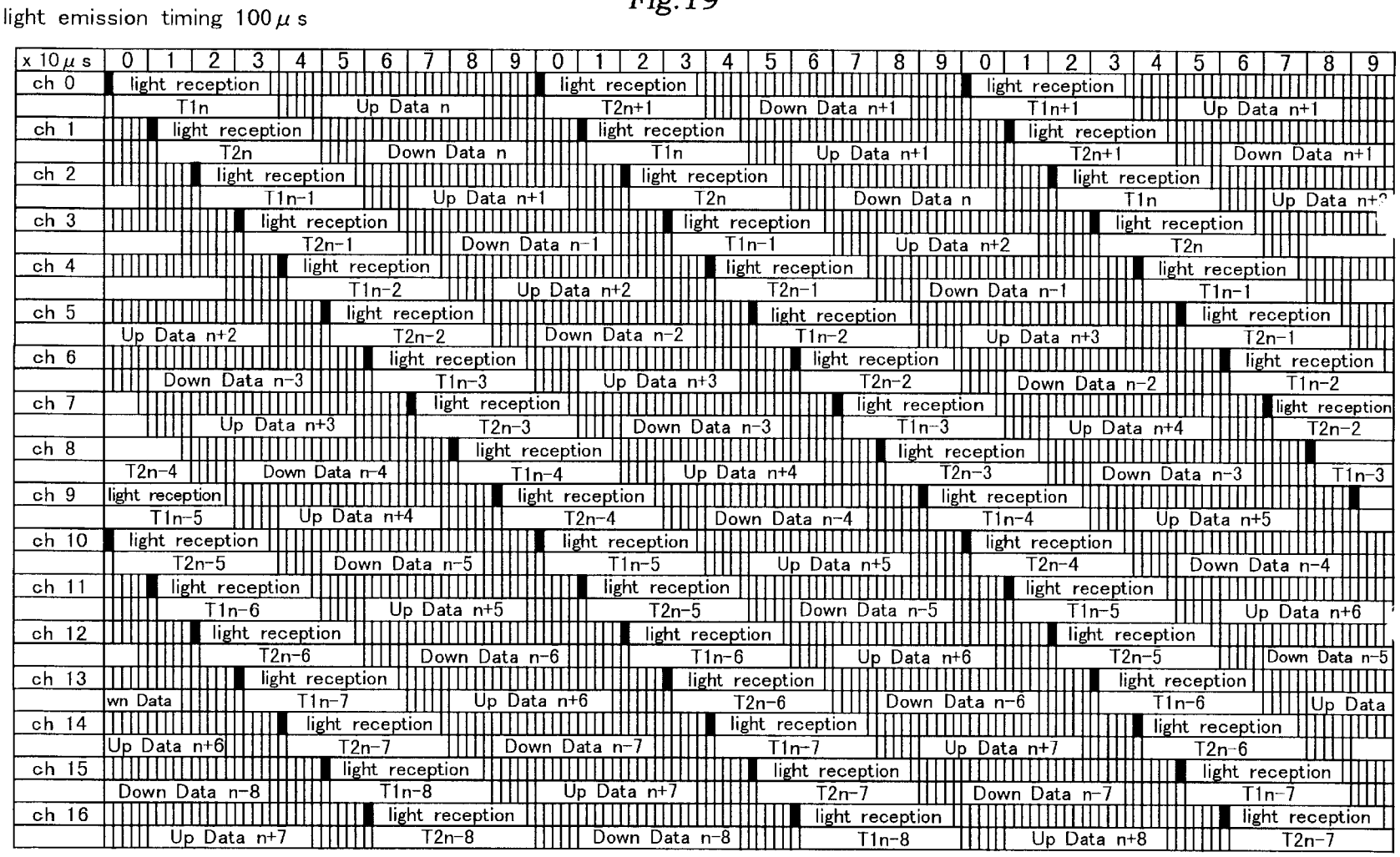
FIG. 19 is a time chart showing the mode of data transfer between adjacent sensor units.

FIG. 19 shows a combined time chart showing the mode of data transfer between different channels in the sensor system using the bus unit BU.

The time chart of FIG. 19 shows the channel number (ch 0 to ch 16) on the ordinate, and time on the abscissa. The region for each channel includes two strips. The upper strip denotes the timing for the basic operation of the optical fiber photoelectric sensor such as the light emitting process (solid black region) and light receiving process. The lower strip denotes the timing for the data transfer between the adjacent sensor units.

As shown in the drawing, the sensor unit on each channel repeats a light emitting process at the interval of about 100 $\mu$s, and each light emitting process is followed by a light receiving process (which includes a binary conversion of the received light value and the forwarding of the data to the external output). The timing of the light emitting process is controlled by the timer of the master sensor unit (SU0) on ch 0. In other words, the slave sensor units on ch 1 to ch 15 execute a light emitting process after a time delay of 10 $\mu$s from the timing of the master unit on ch 0 or the adjacent slave sensor unit on the side of the master sensor unit. This time delay (which is included in the control data T1 or T2) is created by the sequential forwarding of the light emitting timing signal which originally issued from the master sensor unit.

$T1_n$ or $T2_n$ is 9-bit control data which is obtained on the n-th light emitting cycle. The output of each sensor is represented by a single bit, and $T1_n$ represents the sensor outputs of ch 0 to ch 7 while $T2_n$ represents the sensor outputs of ch 8 to ch 15. The remaining single bit is a flag for distinguishing between $T1_n$ and $T2_n$ in each case.

During the period for the light receiving process following each light emitting process, the master and slave sensor units conduct the transmission/reception process (T1 and T2) in cooperation with the adjacent sensor units simultaneously. During a remaining period of the time period for the light receiving process, the process on updata (command execution or the like) and the process on downdata are conducted alternately.

Figure 53:
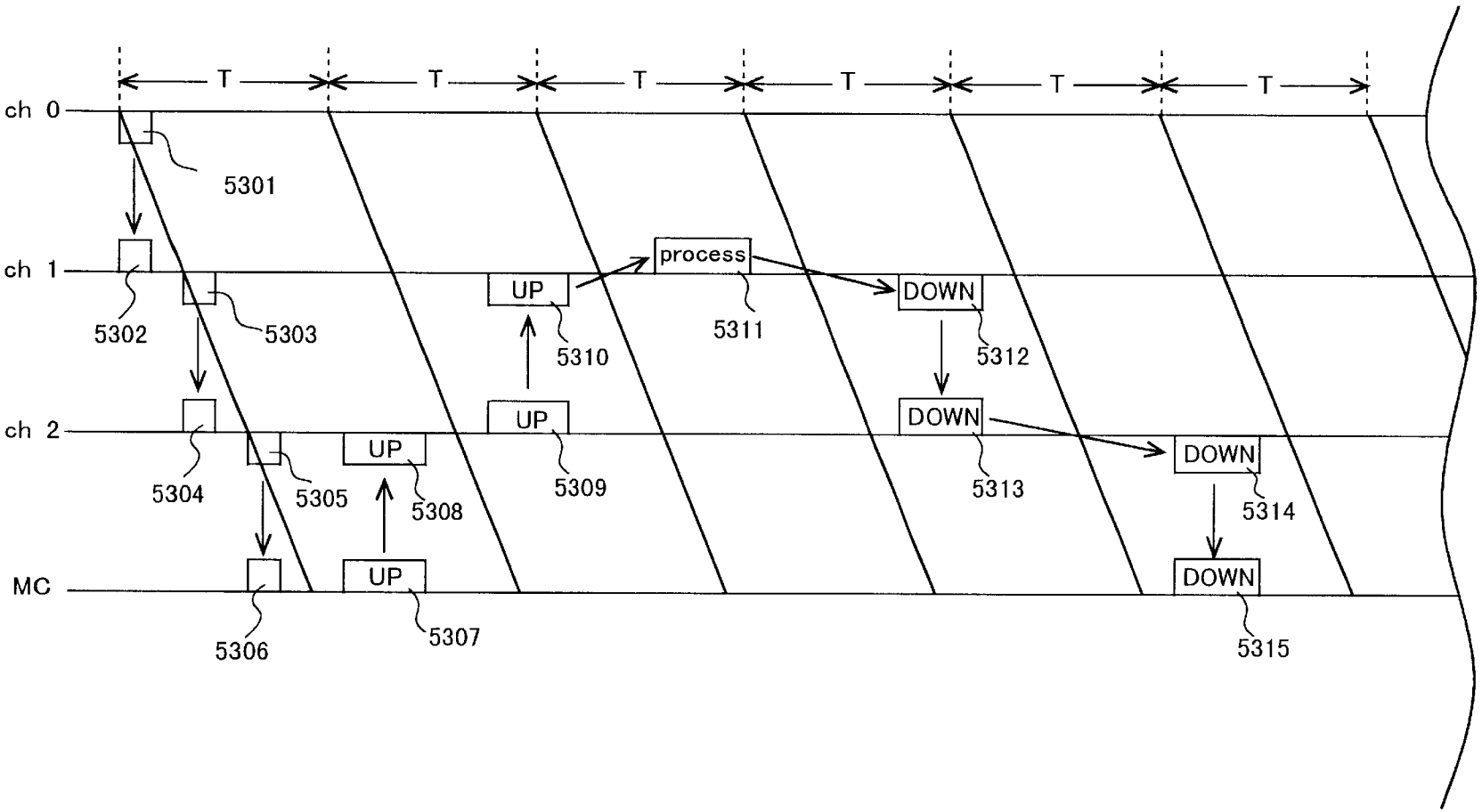
FIG. 53 is a time chart illustrating the data transfer protocol.

The data transfer protocol that may be used in the present invention is described in the following with reference to the time chart shown in FIG. 53. To simplify the description, FIG. 53 only shows three sensor units which are connected to a single mobile console MC. The sensor unit SU (ch 0) is the master unit while the sensor units SU (ch 1 and 2) are slave units.

As described earlier, a light emitting timing signal is cyclically (only the first cycle is illustrated in the drawing) forwarded from the master sensor unit SU (ch 0) to the adjacent slave sensor unit SU (ch 1) at the timer interval of T (step 5301).

As the sensor unit SU (ch 1) receives this signal (step 5302), a light emitting timing signal is cyclically (only the first cycle is illustrated in the drawing) forwarded from the slave sensor unit SU (ch 1) to the adjacent slave sensor unit SU (ch 2) on the other side of the master sensor unit with a time delay of 10 $\mu$s, for instance (step 5303).

Once the sensor unit SU (ch 2) receives this signal (step 5304), a light emitting timing signal is cyclically (only the first cycle is illustrated in the drawing) forwarded from the slave sensor unit SU (ch 2) to the adjacent unit on the other side of the master sensor unit consisting of the mobile console MC with a time delay of 10 $\mu$s, for instance (step 5305).

Once the mobile console MC receives this signal (step 5306), after a prescribed waiting time period, updata containing various commands is forwarded from the mobile console MC to the adjacent unit on the side of the master unit consisting of the sensor unit SU (ch 2).

Once the sensor unit SU (ch 2) receives this signal (step 5308), the slave sensor unit SU (ch 2) stores it in memory, and upon elapsing of the transmission cycle time T, transmits it to the adjacent unit on the side of the master unit consisting of the sensor unit SU (ch 1) (step 5309).

Once the sensor unit SU (ch 1) receives this signal (step 5310), the slave sensor unit SU (ch 1) stores it in memory, and upon elapsing of the transmission cycle time T, executes the commands contained in the updata (step 5311). Then, upon arrival of the next cycle time T, the downdata is transmitted to the adjacent unit on the other side of the master unit consisting of the sensor unit SU (ch 2) (step 5312).

Once the sensor unit SU (ch 2) receives this signal (step 5313), the slave sensor unit SU (ch 2) stores it in memory, and upon elapsing of the transmission cycle time T, transmits the downdata to the mobile console MC (step 5314). The mobile console MC receives this signal (step 5315), and it means the receipt of the objective data by the mobile console MC from the sensor unit SU (ch 2).

As a result of the preceding procedure, for instance, when the mobile console MC forwards a monitor command as updata to the slave sensor unit SU (ch 1), the data reaches the slave sensor unit SU (ch 1) through a bucket brigade transfer between the adjacent sensor units. Thereafter, the sensor unit SU (ch 1) decodes and executes the monitor command, and takes out the designated monitor item data which is then transmitted to the mobile console MC as downdata. The mobile console MC receives and displays the downdata, and this completes the monitor function.

As can be appreciated from the foregoing description, the master sensor unit, slave sensor units, bus unit and mobile console operate as summarized in the following. Bi-directional data transfer is conducted between the various units while the light emitting/receiving processes are being executed. The mobile console or PLC carries out a data setting process on each sensor unit, and the operating condition of each sensor unit is monitored by the mobile console. Various functions which are desired to be given to each sensor unit are defined as corresponding commands so that the operation of each sensor unit may be individually and remotely controlled by sending a corresponding command to the corresponding sensor unit from the mobile console (or PLC or FA PC).

One of the advantages of the mobile console of the present invention is found in the fact that although the sensor unit array is typically placed in a narrow and poorly accessible space in a control console, a gap in a machine or the like, because the mobile console may be placed in a highly accessible place remotely from the sensor array, the monitoring or other work related with the sensor system can be facilitated.

This advantage owes to the data collecting function of the mobile console based on communication, and does not rely on the use of the bucket brigade scheme or the common transmission line (bus) scheme. In this regard, the mobile console and sensor system of the present invention can be developed in a number of different ways as exemplified in the following.

Figure 44:
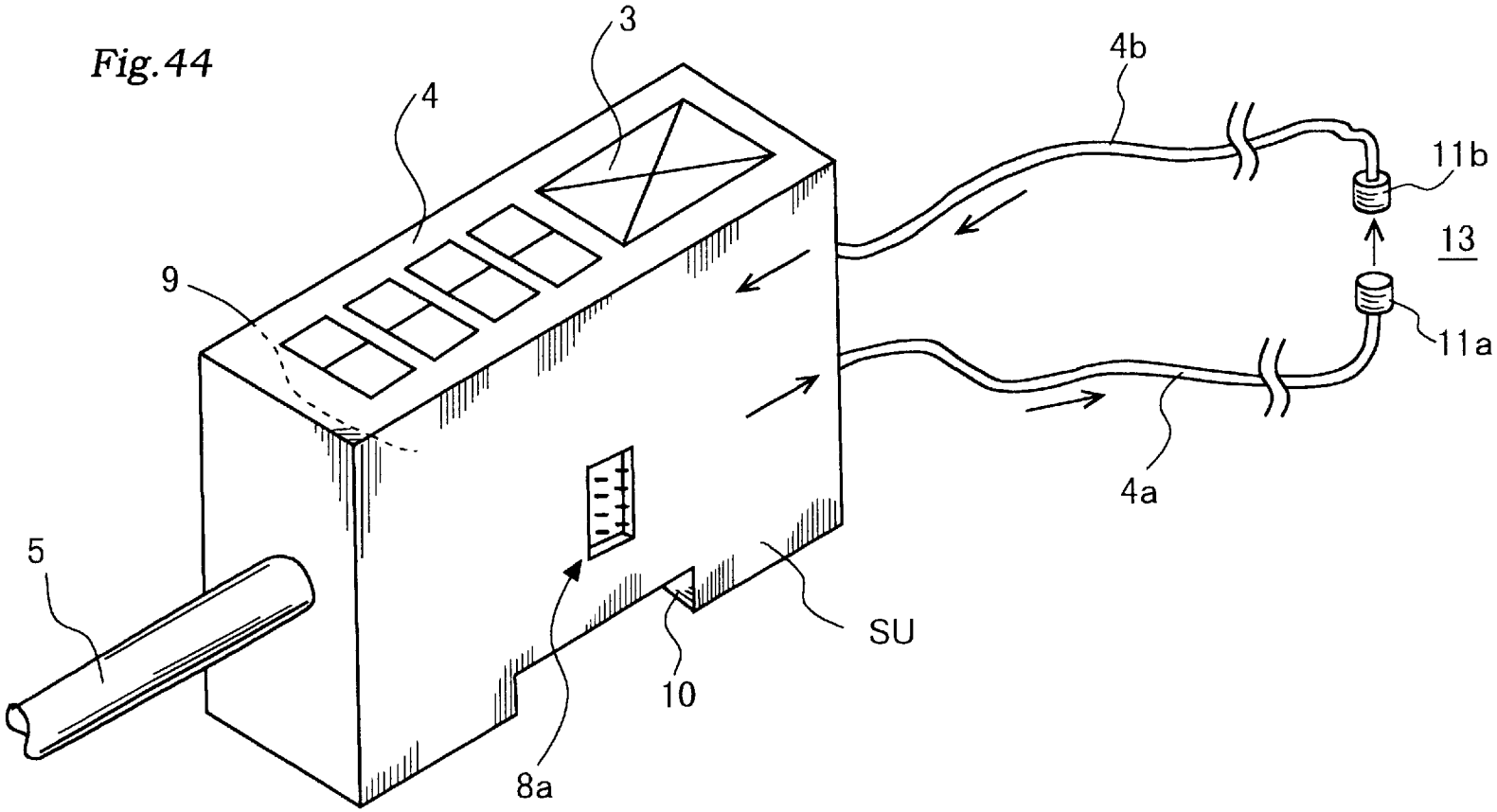
FIG. 44 is a perspective view of a sensor unit.
Figure 45:
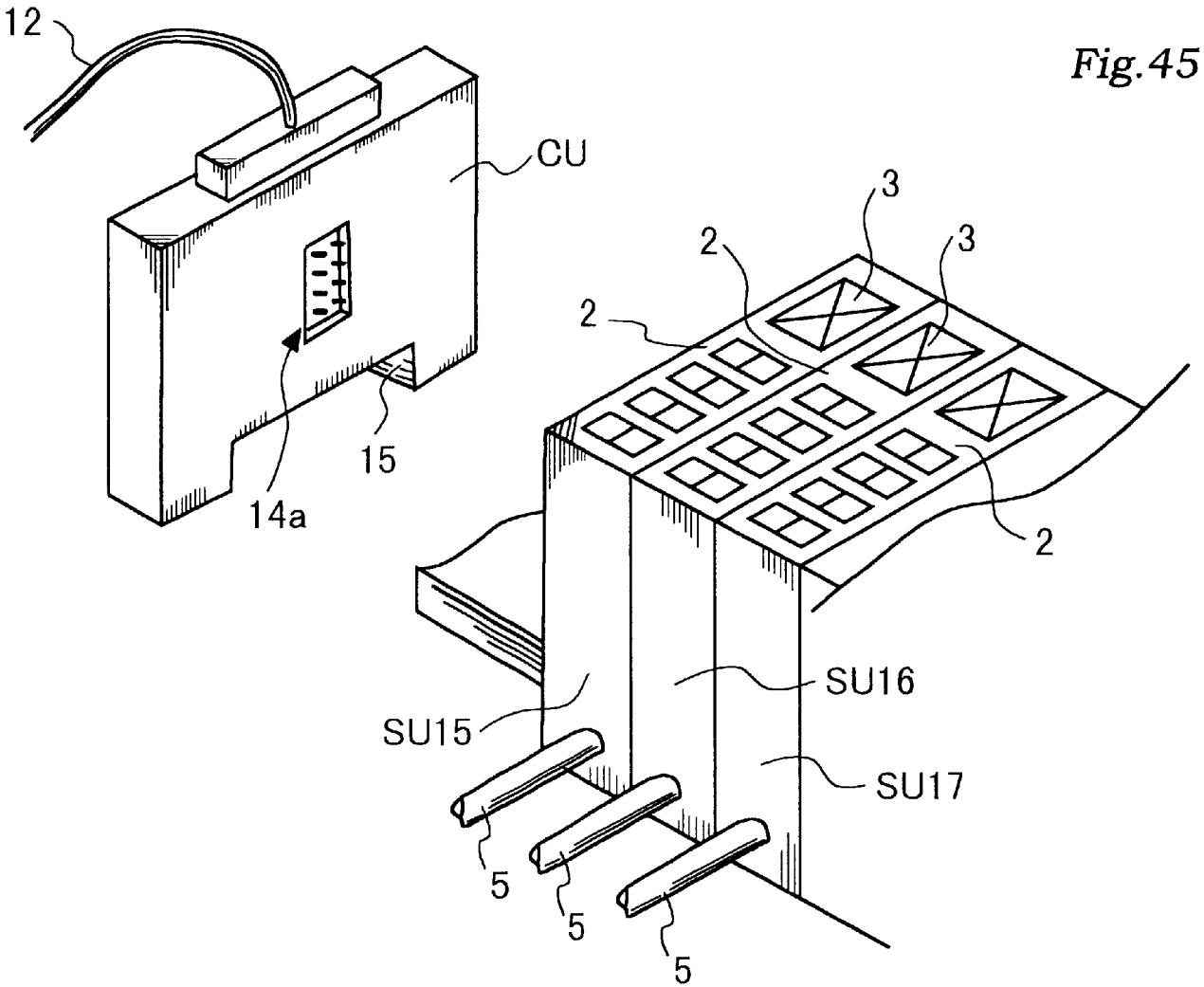
FIG. 45 is a perspective view of a connector unit which is connected to a mobile console.

As a first development, it is possible to use a (either serial or parallel) bus system for communication or data transmission between the sensor units forming the sensor system. In this case, as illustrated in FIGS. 44 and 45, it is preferable to use a male and female (contact) type electric connector to connect the connector unit CU with the sensor unit SU. In FIG. 44, numeral 8*a* denotes one half of the male and female type electric connector provided on either side of the sensor unit SU. In FIG. 45, numeral 14*a* denotes the other half of the male and female type electric connector provided on one side of the connector unit CU. Obviously, a male half of the connector is provided on one side of the sensor unit SU, and the female half of the connector is provided on the other side of the sensor unit SU.

These electric connector halves 8*a* and 14*a* are each provided with a required number of connector pins or receptacle pieces corresponding to the number of signal lines. All or most of the pins or receptacle pieces of the electric connector halves 8*a* and 14*a* are electrically connected with one another inside the sensor unit SU. Therefore, as described in connection with FIG. 1, when the connector unit CU and an array of sensor units SU, SU, . . . are mounted closely next to one another on the DIN rail 1, two serial buses (UDB for updata and DDB for downdata) are formed across the senor unit array.

Figure 46:
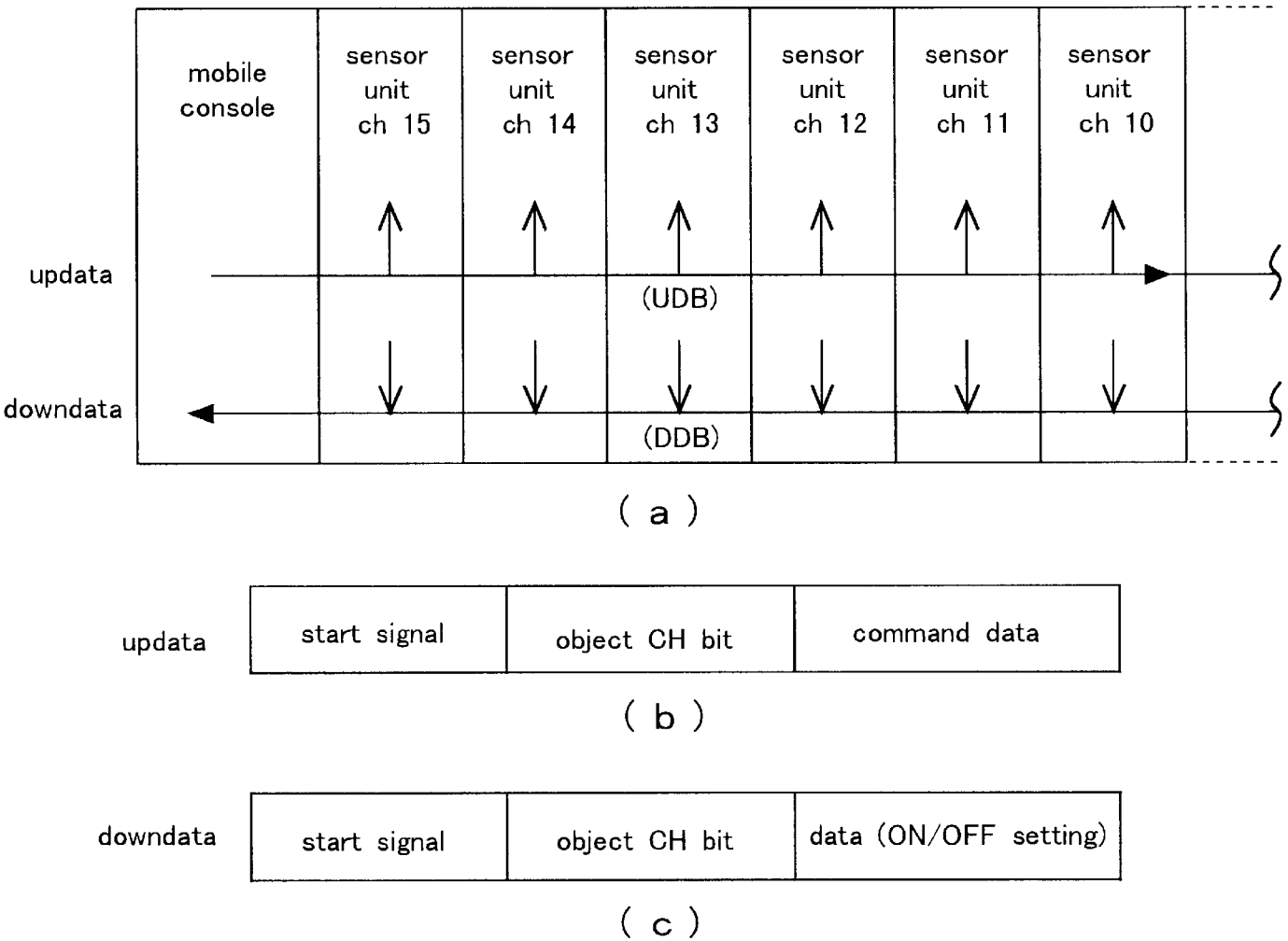
FIG. 46 is a diagram showing the relationship between the sensor system and transmission format.

FIG. 46(*a*) shows the structure of the serial buses UDB and DDB which are formed in this fashion. As shown in FIG. 46(*b*), the format of the updata conducted through the updata bus UDB may consist of a start signal, target channel bit and command data. As shown in FIG. 46(*c*), the format of the downdata conducted through the downdata bus DDB may consist of a start signal, target channel bit and data (such as ON/OFF and setting values).

Figure 47:
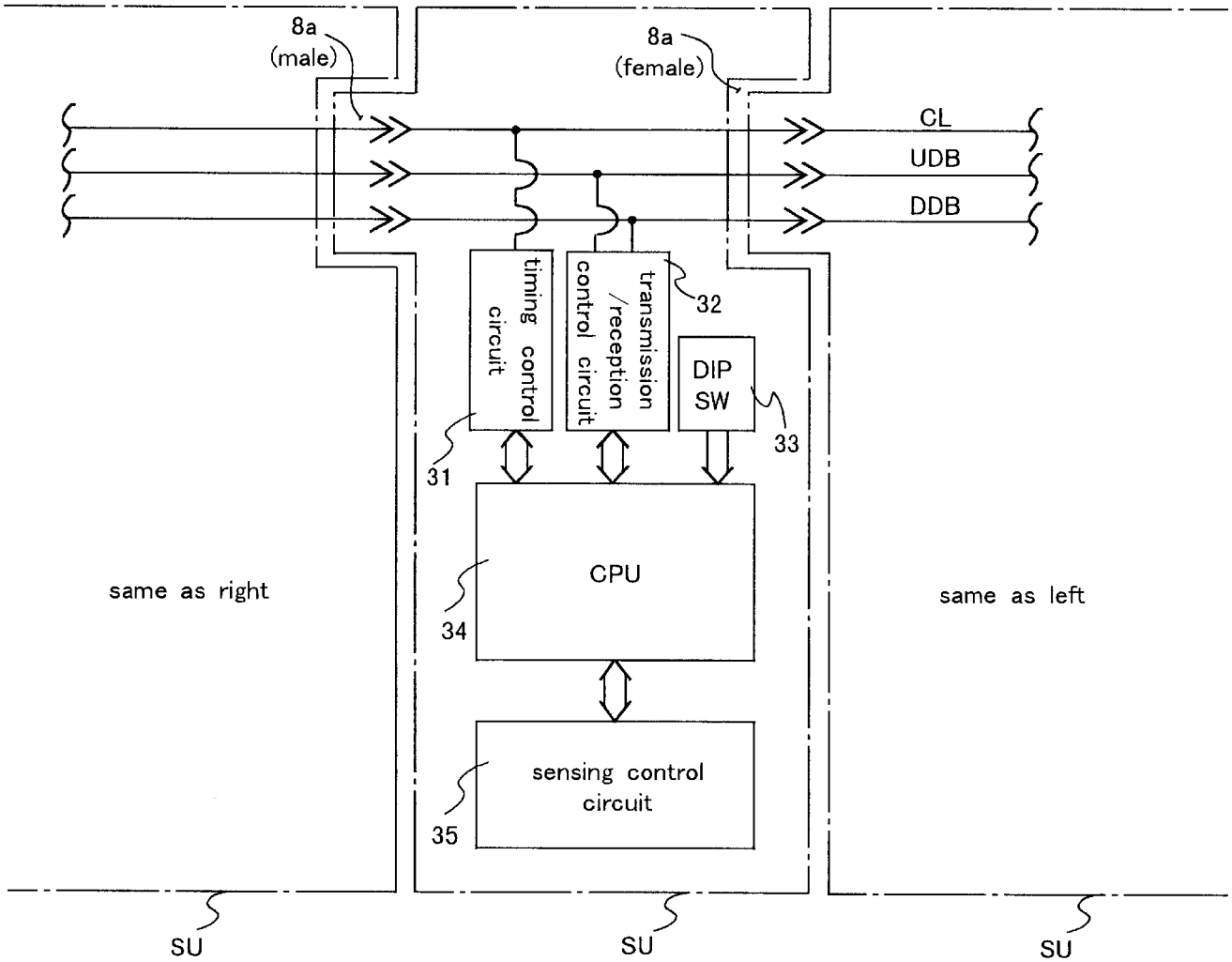
FIG. 47 is a block diagram showing the circuit structure of the sensor unit.

Each sensor unit SU is incorporated with a circuit device for controlling the sensing function and data transmission/reception function in association with the aforementioned bus structure and data structure. An exemplary circuit device is schematically illustrated in FIG. 47.

As shown in the drawing, the sensor unit SU is incorporated with a timing control circuit 31 which is connected to a control line CL, a transmission/reception circuit 32, a DIP switch 33 for address setting, CPU 34 and a sensing control circuit 35.

The timing control circuit 31 generates various timing signals which are required for the basic operation of the sensor units SU such as light emission timing signals and transmission/reception signals according to a timing reference signal passed along the control line CL. The generated timing signals are used for the operation of the CPU 34.

The transmission/reception circuit 32 is provided with the functions to receive updata intended for the particular unit such as commands which are transmitted onto the updata bus UDB from the mobile console MC, and to transmit its own data (ON/OFF, set values, and so on) to the mobile console MC via the downdata bus DDB. More specifically, the transmission/reception circuit 32 is formed by a device such as UART, and executes the transmission and reception process according to the command from the CPU 34.

The DIP switch (DIP SW) 33 is used for setting up the address of the particular sensor unit SU, and, for instance, may consist of 4-bit switch to meet the need of a 16-channel sensor unit.

The CPU 34 essentially consists of a microprocessor, and is incorporated with system program memory consisting semiconductor ROM devices and work memory consisting of semiconductor RAM devices. The CPU 34 generally controls the functions of the sensor unit (such as the sensing function, data transmission/reception function, and command execution function).

The sensing control circuit 35 provides the basic sensing function which is required of the particular sensor unit. The contents of the sensing function may vary depending on whether the sensor unit is a photoelectric sensor, proximate sensor or ultrasonic sensor. When the sensor unit consists of a photoelectric sensor, every time a light emission timing signal generated by the timing control circuit 31 arrives, detection light is emitted into a detection region by driving a light emitting diode not shown in the drawing, and the state of the target object is detected by receiving the reflected or transmitted detection light.

Figure 48:
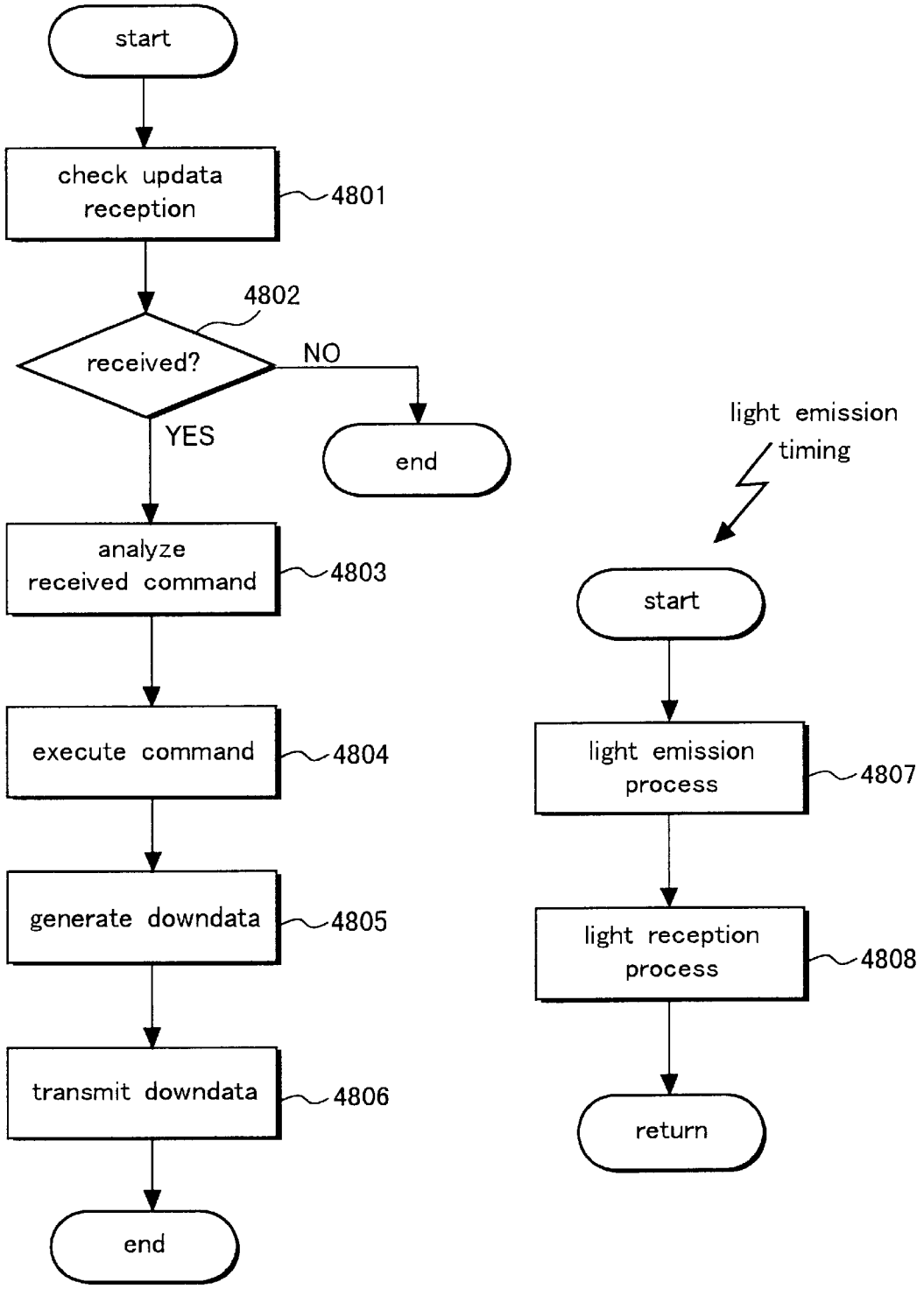
FIG. 48 is a flowchart showing the sensor unit process.

FIG. 48 is a flowchart schematically illustrating the sensor unit process executed by the CPU 34. As shown in the drawing, as the process begins, by checking the state of the transmission/reception circuit 32 with the CPU 34, it is determined if there is any updata intended for the particular sensor which is forwarded from the mobile console MC (steps 4801 and 4802). If there is any updata intended for the particular unit (step 4802-yes), the updata (reception command) is analyzed (step 4803), a corresponding command is executed (step 4804), and downdata is generated (step 4805). The contents of the process that is executed at this time may comprise the process of reading data designated for monitoring (such as ON/OFF state of the particular sensor unit, threshold level and so on), and generating downdata. The thus generated downdata is forwarded to the transmission/reception circuit 32 which forwards the data to the mobile console MC at an appropriate timing (step 2806).

Meanwhile, the timing control circuit 31 generates and cyclically issues a light emission timing signal associated with the particular sensor unit according to the reference timing signal passed along the control line CL, and this invokes an interruption routine of the CPU 34 so that a light emission process (step 4807) and a light reception process (step 4808) are executed one after the other. This achieves the sensing function of the optical fiber photoelectric sensor.

Although not shown in the drawing, the mobile console MC obtains the necessary data concerning the sensor unit designated by the operator by forwarding a monitor command of a prescribed format (FIG. 46(*b*)) to the corresponding sensor unit onto the updata bus UDB, and receiving the monitor data of a prescribed format (FIG. 46(*c*)) forwarded from the corresponding sensor unit from the downdata bus (DDB). The obtained data is displayed on the display unit of the mobile console MC.

Figure 49:
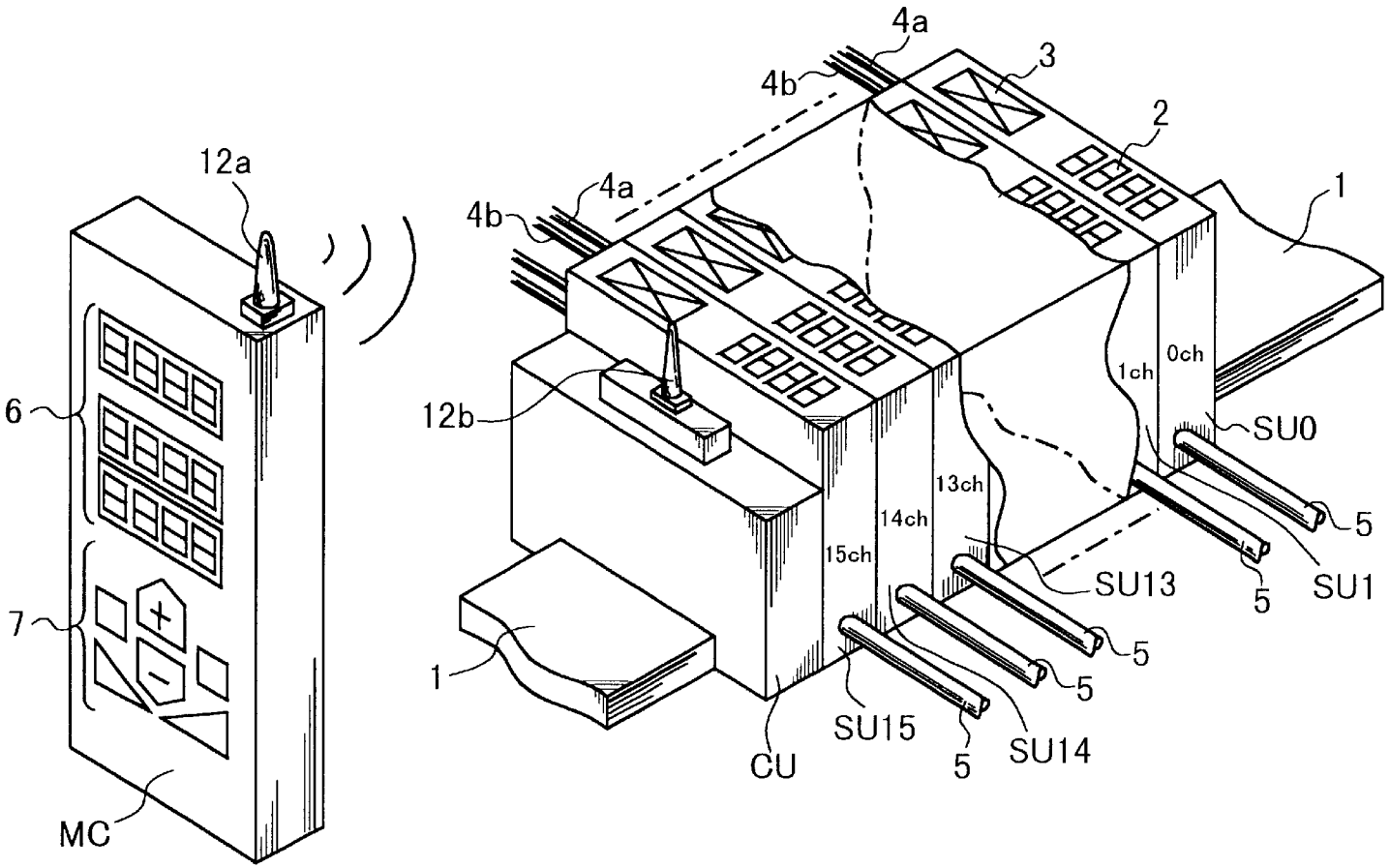
FIG. 49 is a diagram showing the relationship between a mobile console and a sensor system which is based on radio wave communication.

As another possible development, it is possible to conduct the communication between the mobile console MC and sensor units SU as a wireless communication. FIG. 49 shows an exemplary mobile console MC based on wireless communication. In this example, the medium for the wireless communication consists of radio wave. As shown in FIG. 49, the housing of the mobile console MC is provided with an antenna 12*a* for transmitting and receiving radio wave. The housing of the mobile console MC accommodates a radio wave transmission/reception circuit, and the connector unit CU is likewise provided with a radio wave transmission/reception circuit. The radio wave transmission/reception circuit of the connector unit CU is connected to the serial bus extending across the sensor unit array via a suitable buffer circuit so that the radio communication between the mobile console MC and sensor units SU is enabled.

Figure 50:
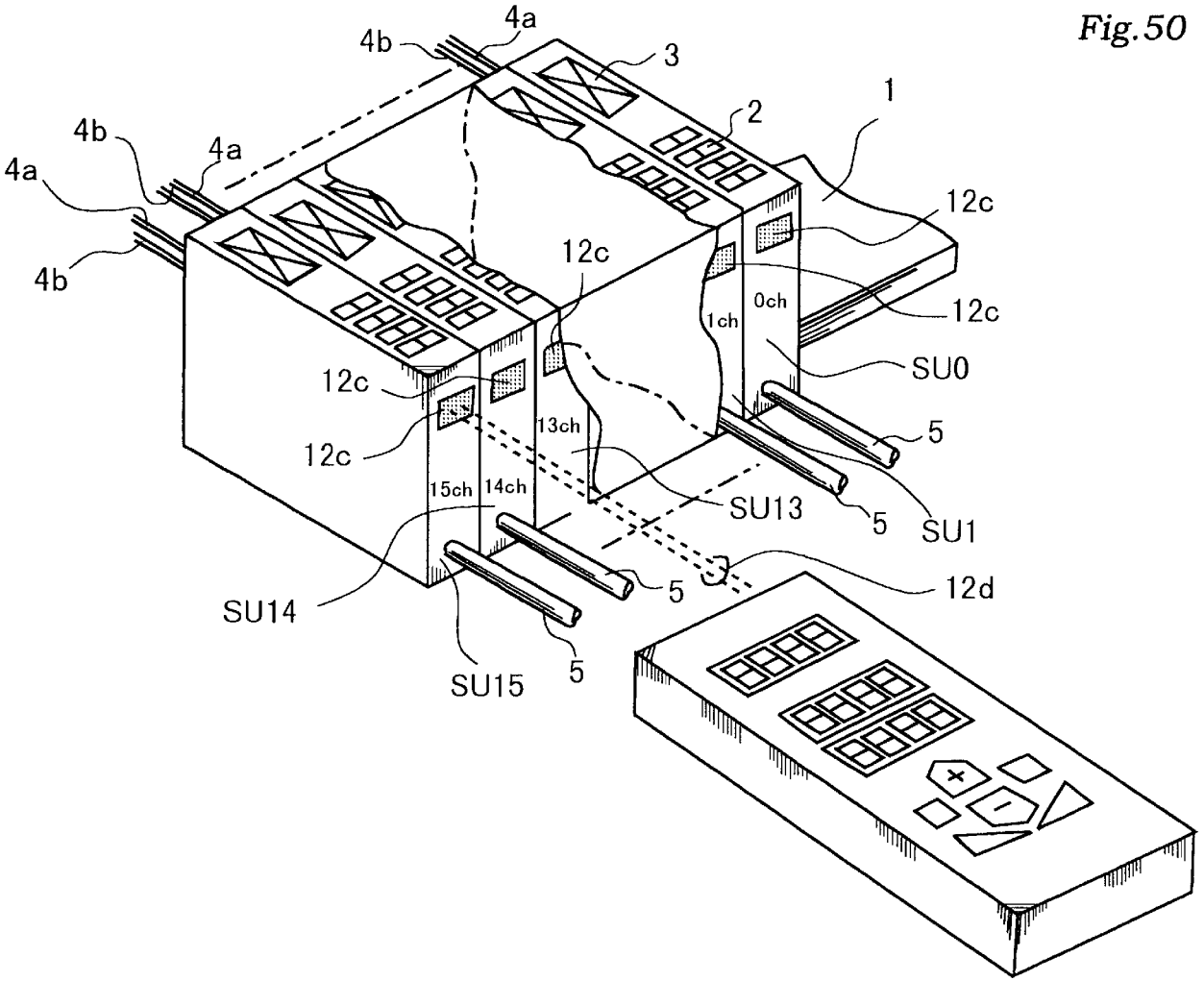
FIG. 50 is a diagram showing the relationship between a mobile console and a sensor system which is based on infrared light communication.

FIG. 50 shows another exemplary mobile console MC based on wireless communication. In this example, the medium for the wireless communication consists of infrared light. As shown in FIG. 50, the front face of the housing of each sensor unit is provided with an infrared light emitting/receiving window 12*c* for communication. Behind this infrared light emitting/receiving window 12*c* are arranged an infrared light emitting diode and light receiving element (which are not shown in the drawing). The upper end surface of the mobile console MC is also provided with an infrared light emitting/receiving window (hidden from view in the drawing) for communication. Also, behind this infrared light emitting/receiving window are arranged an infrared light emitting diode and light receiving element (which are not shown in the drawing) for the mobile console MC. Thus, by using these infrared light emitting/receiving windows, the infrared light communication (optical communication) between the mobile console MC and sensor units SU is enabled as indicated by the dotted lines 12*d* in the drawing.

In the case of the communication system using infrared light, it is possible to allow the mobile console MC to communicate to each of the sensor units SU, SU, . . . individually. In other words, instead of communicating with only one of the sensor units in the array and exchanging data with the remaining sensor units through a serial bus communication, the corresponding data can be exchanged between each individual sensor unit and the mobile console by placing the mobile console MC opposite the front face of the particular sensor unit and conducting an individual communication via the infrared light emission/reception window 12*c* of the sensor unit.

Figure 51:
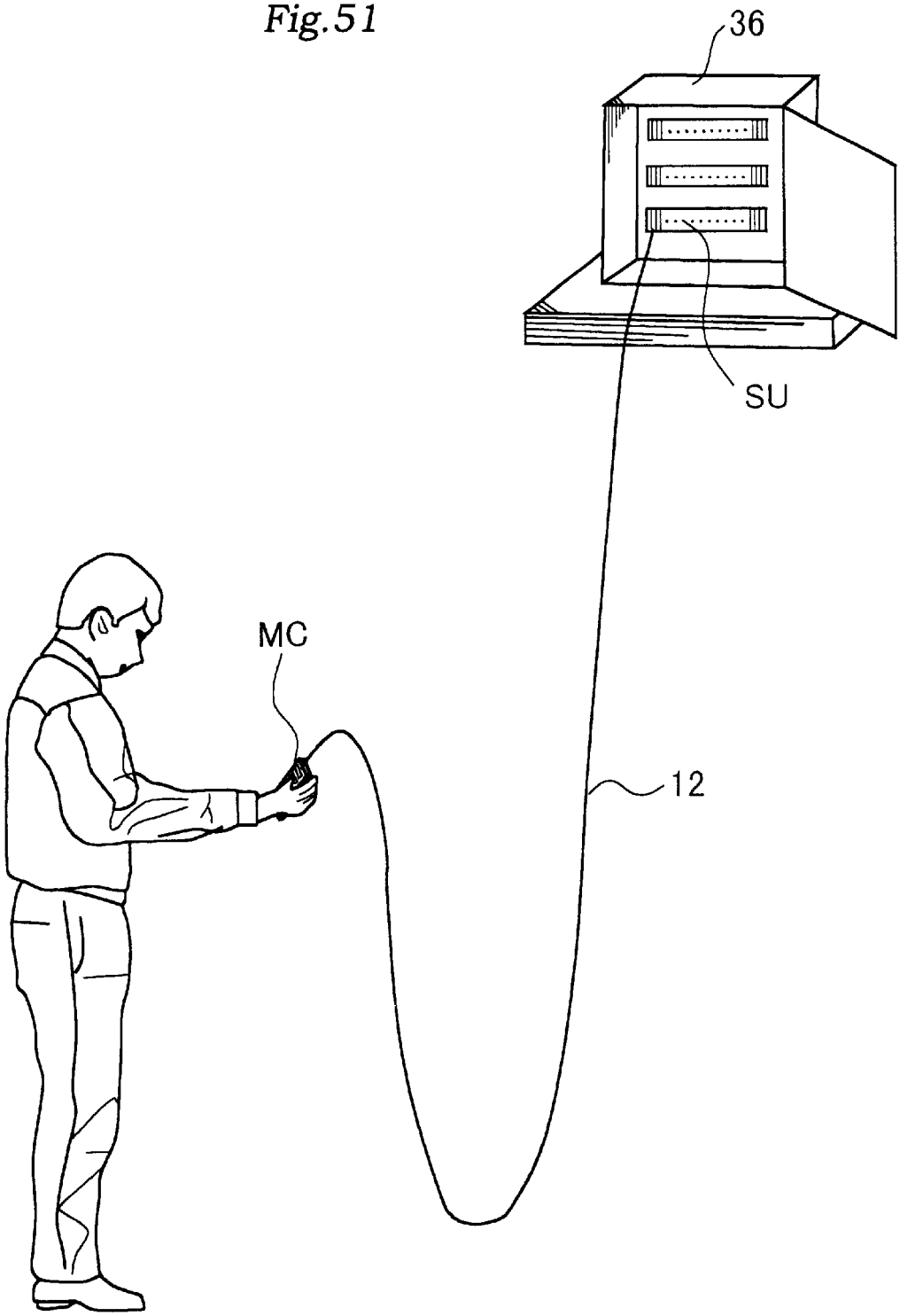
FIG. 51 is a diagram showing the work procedure when using the mobile console.
Figure 52:
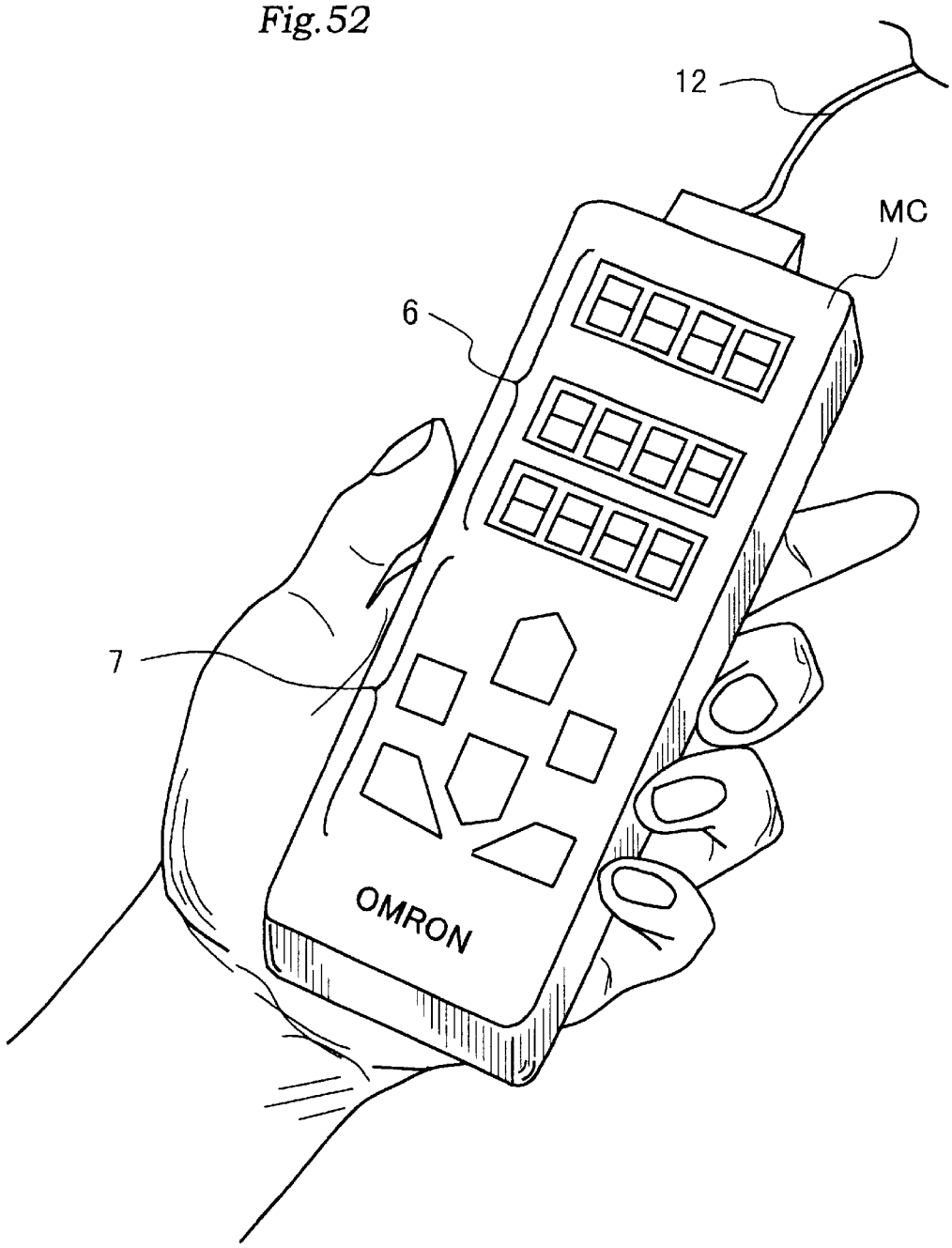
FIG. 52 is a schematic view showing the mode of holding the mobile console with a hand.

FIG. 51 shows an example of the sensor system adjustment work using the mobile console. As shown in the drawing, even when the control panel 36 accommodating the sensor system is placed in a narrow and poorly accessible location, because the mobile console MC can be moved around by virtue of the use of an electric cord or wireless communication, the setting and adjustment work for the sensor system can be conducted from a favorably accessible location which may be remote for the poorly accessible location of the sensor system. Also, the setting and adjustment work for the sensor system can be conducted while inspecting the positional relationship between each sensor head and the corresponding object to be detected which are located remotely from the sensor units. Furthermore, as shown in the enlarged view of FIG. 52, the housing of the mobile console of the present invention can be held with one hand and the other hand can be used for operating the mobile console MC. This improves the convenience and work efficiency of the system.

Figure 27:
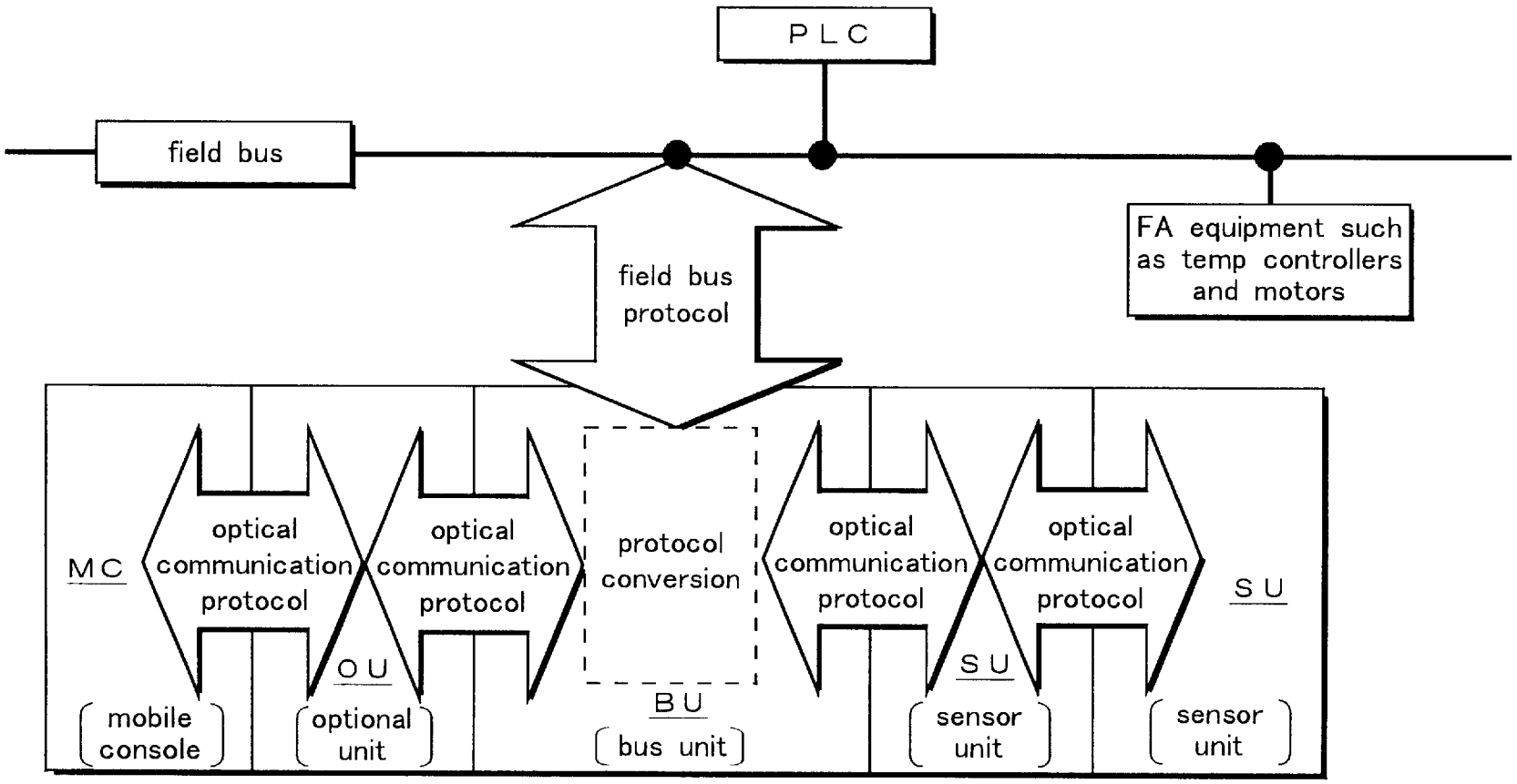
FIG. 27 is a diagram showing an exemplary application of the sensor system of the present invention.

Finally, an exemplary application of the sensor systems in the field of FA is shown in FIG. 27. In this example, the sensor unit array (SU, SU, . . . ) are connected to both a bus unit (BU) and a mobile console (MC). An arbitrary optional unit (OU) may be connected between the bus unit (BU) and the mobile console (MC). The field bus is connected to a programmable controller (PLC), FA personal computer (not shown in the drawing), and various items of FA equipment such as temperature controllers and electric motors as well as to the bus unit.

To form such a system, the bus unit (BU) and optional unit (OU) are each required to have a connector means on each side thereof so as to have the function to relay data. Steps 1745 and 1844 of FIGS. 17 and 18 are based on the assumption that the mobile console MC is placed to the left side of the bus unit BU.

According to this example, because a protocol conversion is performed between the optical communication protocol and the bus protocol, the sensor unit array (SU, SU, . . . ) and the FA equipment such as the mobile console MC and PLC can be connected in a highly organized manner, and a highly flexible control system can be achieved.

Figure 20:
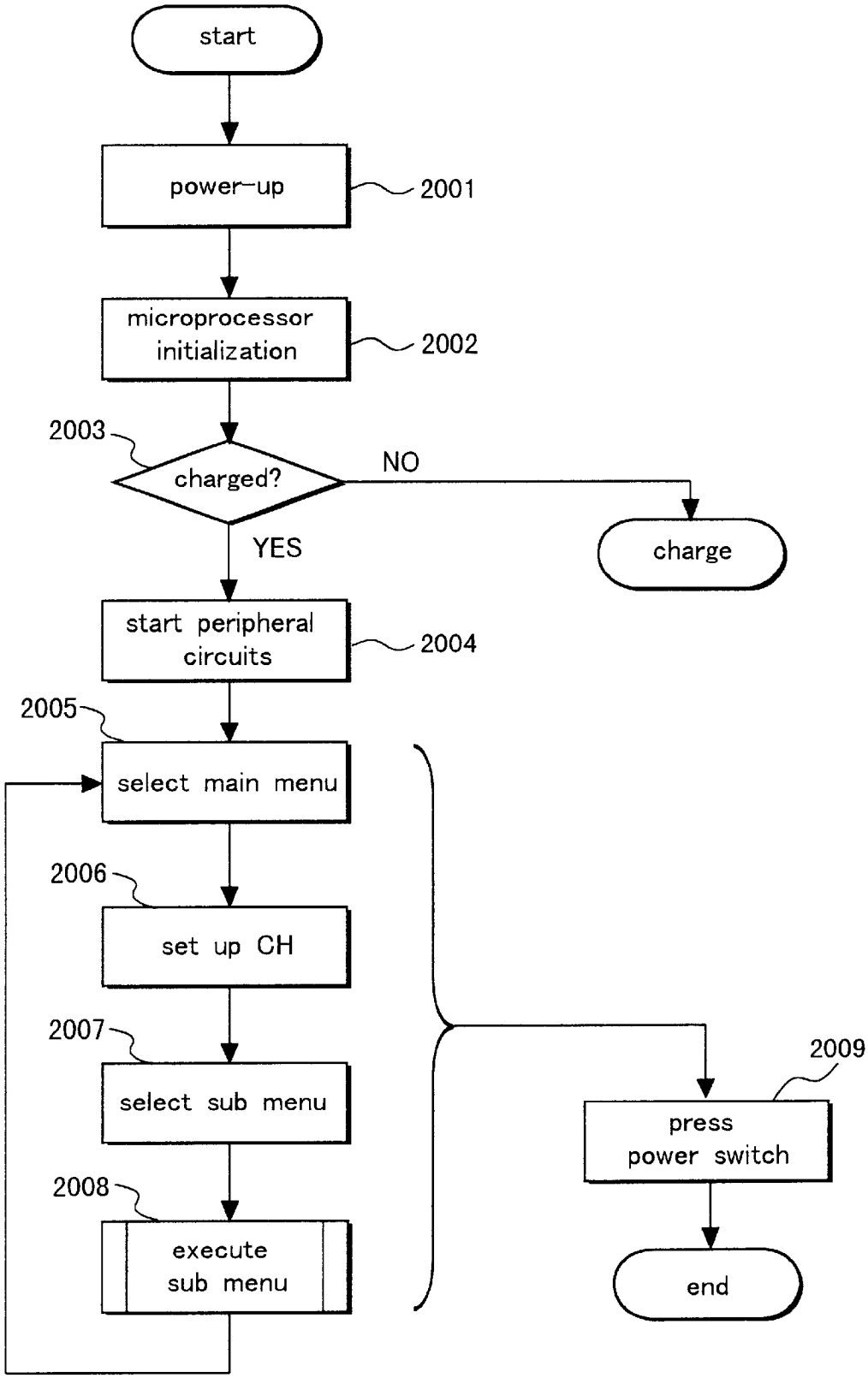
FIG. 20 is a flowchart showing the overall process at the mobile console.

FIG. 20 is a flowchart showing the overall process at the mobile console.

Referring to the drawing, upon power-up (step 2001), the microprocessor is initialized (step 2002), and the charged state of the battery is determined (step 2003). If the battery is determined to be properly charged (step 2003-yes), the peripheral circuits are activated (step 2004). Thereafter, the main menu selection process (step 2005), channel setting process (step 2006), sub menu selection process (step 2007) and sub menu process (step 2008) are executed in repetition.

If the power switch in pressed during the execution of these processes (step 2009), the execution of these processes is terminated.

The main menu selection process (step 2005) is executed through the manipulation of the keypad 7 provided on the mobile console MC. Likewise, the channel setting process (step 2006) and sub menu selection process (step 2007) are executed through the manipulation of the keypad 7.

Figure 21:
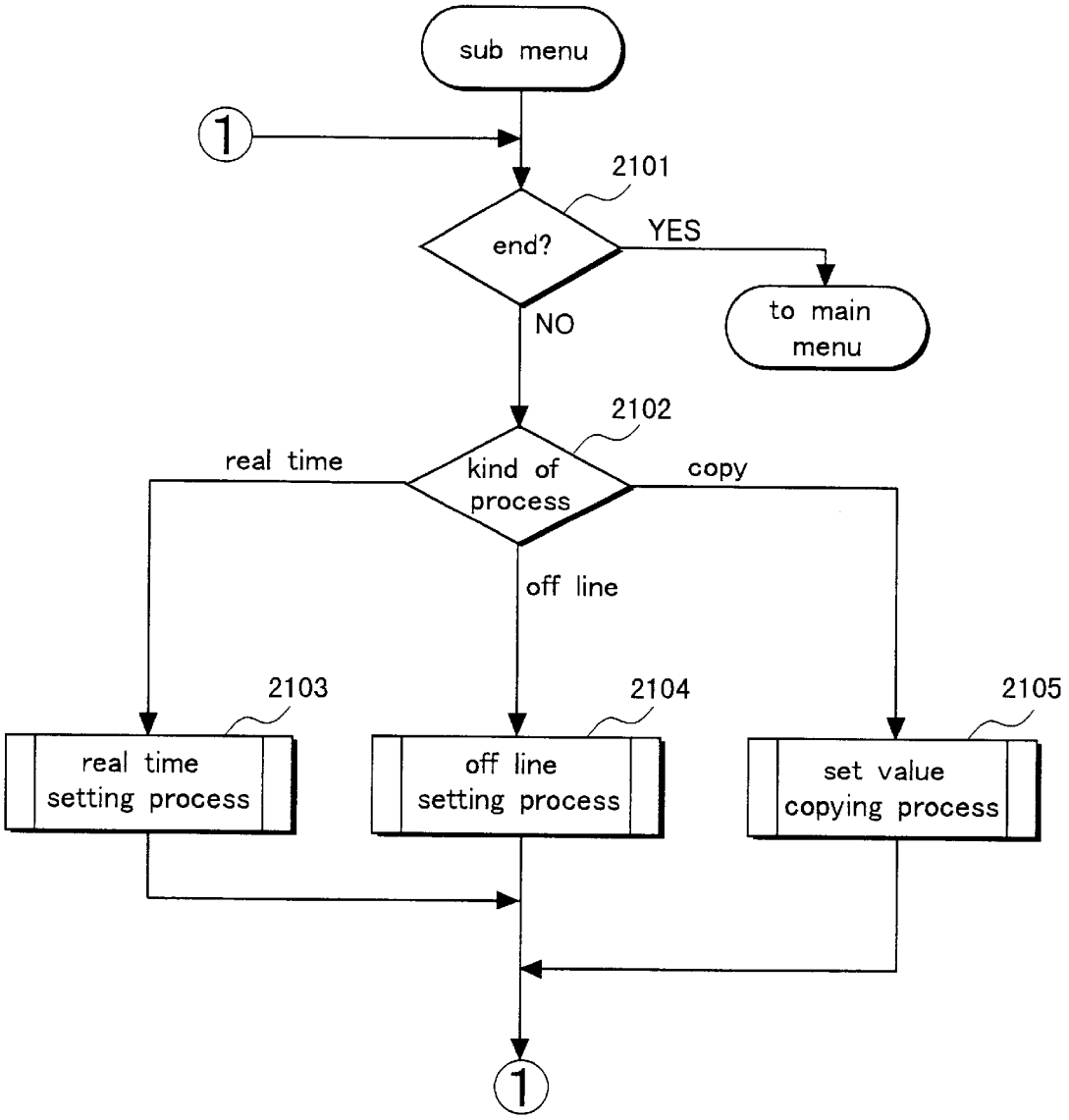
FIG. 21 is a flowchart showing the sub menu process.

FIG. 21 is a flowchart showing the overall control flow of the sub menu process.

As the process shown in the drawing starts, one of a real time setting process (step 2103), off line setting process (step 2104) and setting value copying process (step 2105) is executed according to the kind of the sub menu process selected in step 2102 as long as a prescribed ending process fails to be confirmed (step 2101-no).

Figure 22:
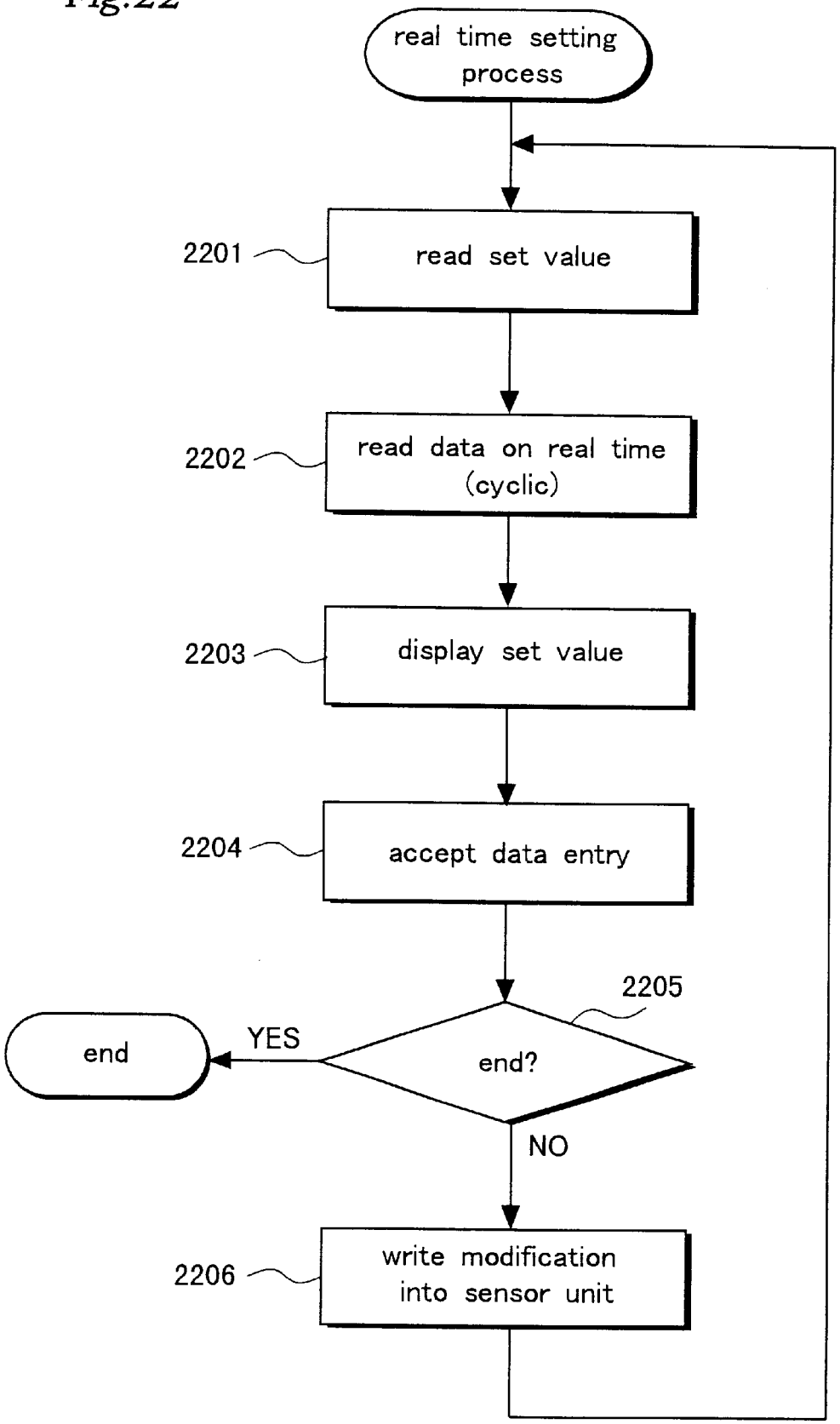
FIG. 22 is a flowchart showing the real time setting process.

FIG. 22 is a flowchart showing the control flow of the real time setting process.

As shown in the drawing, as the process begins, the setting values (such as the received light value data and threshold level data) are read as a part of the real time setting process (step 2201), and the real time data concerning the setting values is then read at a regular interval (step 2202).

The read real time data is displayed on the display unit 6 of the mobile console (step 2203), and the program flow waits for the data entry by the user (step 2204).

Under this condition, if any setting value is modified or a new setting value is entered (step 2205-no), the change in the setting value is written into the corresponding sensor unit SU according to the input (step 2206).

Thus, during the real time setting process, by operating the keypad as required while the data of each sensor unit SU is monitored, the setting values of each sensor unit can be modified on a real time basis. If the channel setting information designates all of the channels, it is possible to assign the same setting data to all of the sensor units at the same time by making use of the bucket brigade data transfer function (the same data is transferred to each of the channels). This is a significant improvement in the efficiency of the data setting work as compared to the conventional arrangement which required each of the sensor units to be set up individually.

Figure 23:
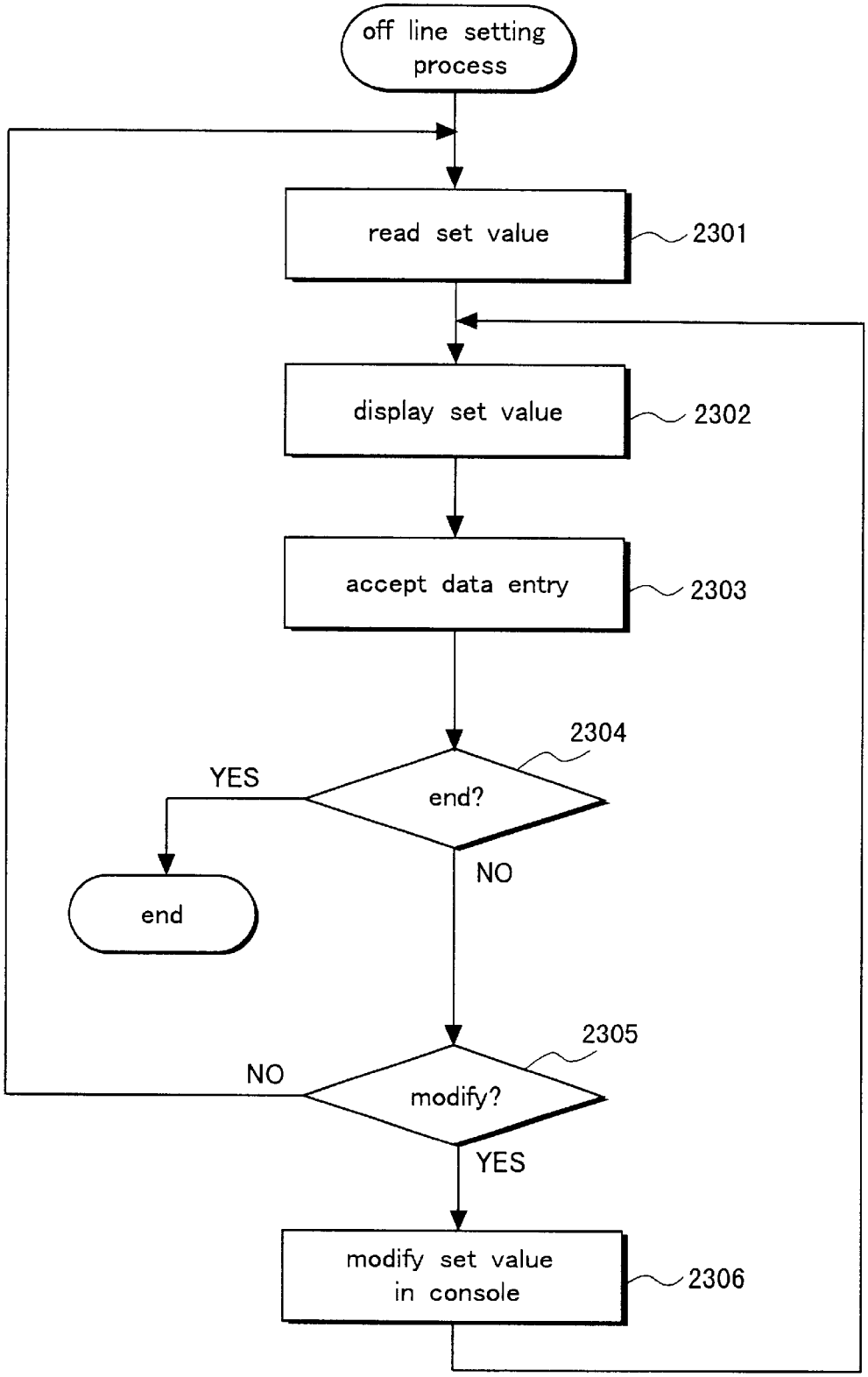
FIG. 23 is a flowchart showing the off line setting process.

FIG. 23 is a flowchart showing the control flow of the off line setting process.

As shown in the drawing, as the process begins, the off line process is executed as described in the following. The setting values on each sensor unit SU (which are already copied from the sensor unit and) stored in the mobile console are read (step 2301), and the read set values are displayed on the display unit 6 (step 2302) before the system proceeds to the state where the key entry by the user is awaited (step 2303).

When there is a key entry by the user under this condition, (step 2304-no), the current mode is identified (step 2305).

If the entry does not consist of "modify" (step 2305-no), the set values of the console are preserved as they are. If the entry indicates "modify" (step 2305-yes), the action to modify the set values of the console is executed (step 2306).

Thus, during the off line setting process, the modifying the setting values which are copied from each sensor unit and already stored in the mobile console are enabled as an off line process. When modifying the setting values from the console, the mobile console MC is not required to be connected to the sensor units (SU, SU, . . . ).

Figure 24:
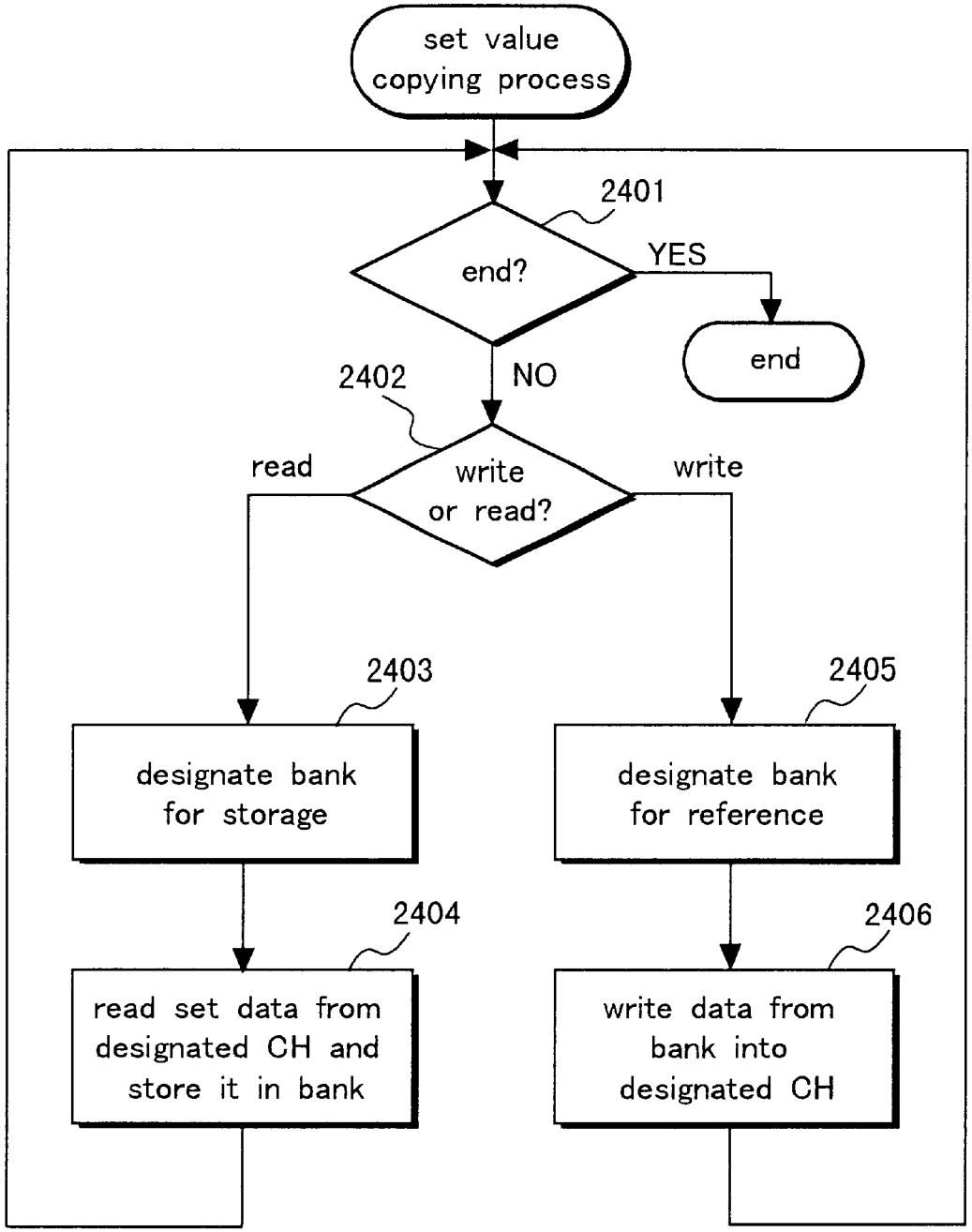
FIG. 24 is a flowchart showing the setting copying process.

FIG. 24 is a flowchart showing the control flow of the setting value copying process.

As shown in the drawing, once the setting value copying process is started, the corresponding process is executed depending on whether the operating mode is the write mode or read mode (step 2402) until an ending process is started (step 2401-no).

More specifically, if the read mode is identified (step 2402-read), the bank for storage is designated (step 2403), and the reading of the setting data from the designated channel and the storage of the data in the designated bank are executed (step 2404).

As shown in FIG. 26, the mobile console is provided with a number of memory banks (storage device) for storing the settings of the sensor units. Each channel region of each memory bank (1 to 10) stores such data as the unit ID, unit version, threshold level, monitor output range, timer setting, and various flags and check codes. The setting data is read from the designated channel in step 2404, and the read data is stored in the designated bank in step 2403.

On the other hand, if the result of the mode determination process (step 2402) indicates the write mode (step 2402-write), the bank for reference is designated (step 2405), and the data in the bank is written into the designated channel (step 2406).

In other words, the contents of the bank into which the data is stored in step 2404 are automatically copied to the sensor unit of the designated channel.

Therefore, when a plurality of control systems having identical contents are ordered to be manufactured, the work efficiency can be significantly improved by making use of this setting value copying process because there is no need to individually set up data on sensitivity and threshold levels on an array of sensor units for each of the systems.

Figure 25:
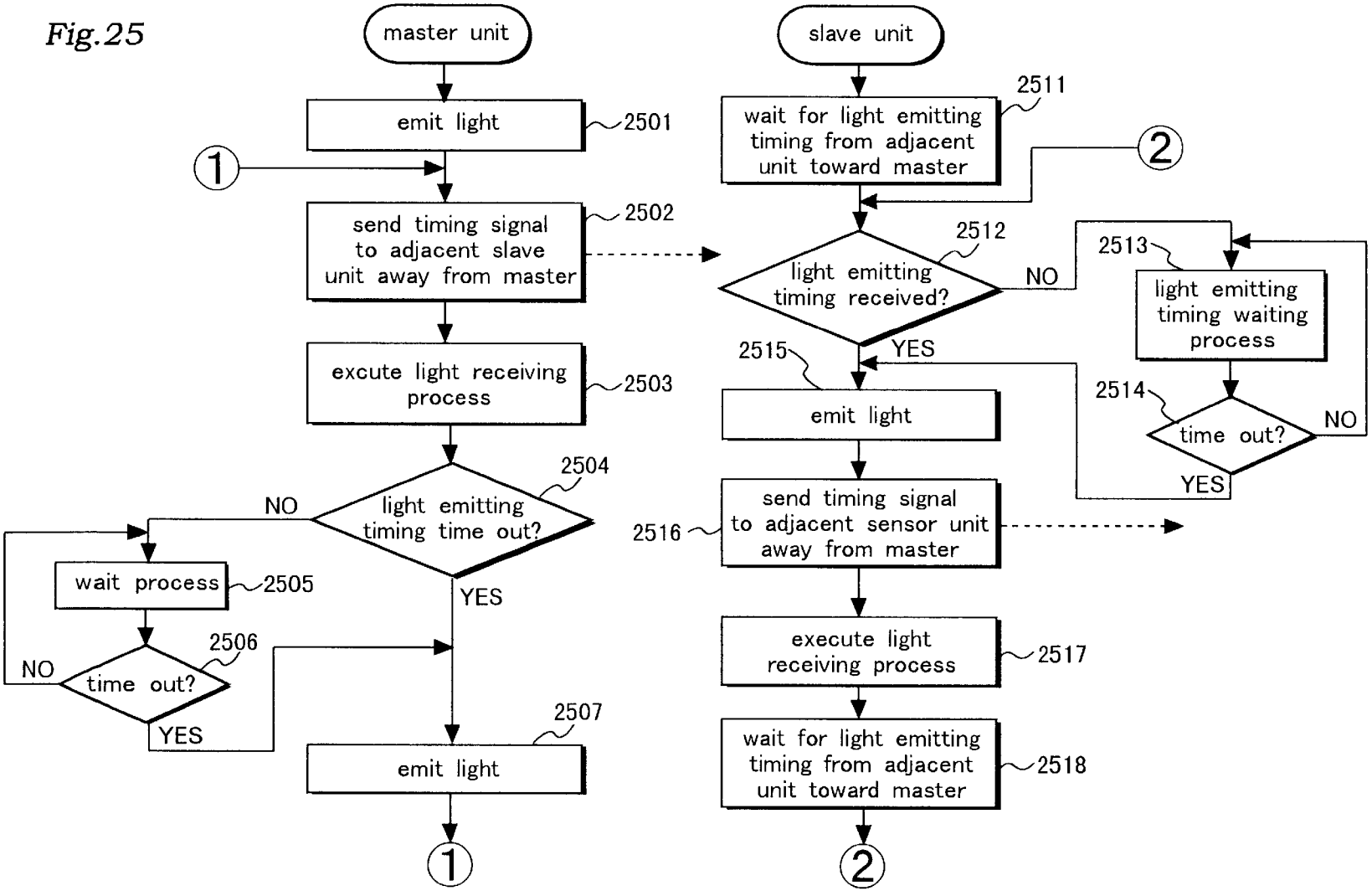
FIG. 25 is a flowchart showing the process of preventing mutual interferences between the master and sensor units.

FIG. 25 is a flowchart showing the process of the master and slave units for preventing mutual interferences.

The sensor units SU0 to SU15 described above are suitable for executing various data transfer processes in cooperation with the mobile console and bus unit, but may also execute a process for preventing mutual interferences by themselves without the aid of the mobile console and bus unit.

More specifically, in this case, the master unit repeats a light emitting process (steps 2501 and 2507) followed by a transmission of a timing signal to the adjacent sensor unit on the other side of the master unit (step 2502) at a regular interval. The execution of these processes is repeated every time the light emitting timing timer advances a prescribed time period (steps 2504, 2505 and 2506).

Each slave sensor unit constantly waits for the arrival of a light emitting timing signal from the adjacent sensor unit on the side of the master unit (step 2511), and executes a light emitting process (step 2516) every time a light emitting timing signal arrives (steps 2412, 2513 and 2514). Each time, the light emitting process is followed by the transmission of a timing signal to the adjacent sensor unit on the other side of the master unit (step 2516), and the execution of a light emitting process (step 2517).

Because the sensor units SU0 to SU15 according to the present invention are provided with the function to transfer data between them by themselves, they can be advantageously utilized in such a manner that the mutual interferences due to the overlapping of the light emitting timing between the sensor units can be effectively avoided.

The sensor units in the above described embodiments consisted of optical fiber photoelectric sensors, but the present invention is not limited by such an example, and may also use a wide range of sensor units such as proximate sensors and ultrasonic sensors using separated sensor heads.

Now is described a more concrete embodiment of the sensor system of the present invention which is formed by suitably combining sensor units SU, a bus unit, a mobile console MC and an optional unit OU having a desired function by focusing on the communication process which is executed by the system.

1. Outline

The outline of the sensor system given as the preferred embodiment of the present invention is described in the following in connection with the purpose of communication, the basic protocol for data communication, the IDs of the sensor units, the data communication between sensor units and the maximum number of connected sensor units.

1.1 Purposes of Communication

The sensor system uses the bucket brigade type data communication between the sensor units for the following purposes.

[Purpose 1]

To avoid interferences between the sensor units (SU) so as to shift the timing for sensing light emission between adjacent sensor units in a reliable manner, it is necessary to synchronize the timing of light emission between the sensor units, and the data communication between the sensor units is conducted for this purpose. In the following example, it is assumed that there are eight sensor units on one side (16 sensors in all on either side) which are required to be protected from mutual interferences.

[Purpose 2]

The data communication between the sensor units is conducted to allow the sensor units to be controlled from outside by forwarding the control data from the mobile console MC to each sensor unit, and to allow the state of each sensor unit to be monitored by returning the data from each sensor unit to the mobile console.

[Purpose 3]

The data communication between the sensor units is conducted to allow the control output data to be transferred from each sensor unit to the bus unit (BU). In the example given below, the number of sensor units that can be connected is up to 16. The delay time for the communication of the control output to the bus unit BU is 2.0 ms at most.

[Purpose 4]

The data communication between the sensor units is conducted to allow the control command from the optional unit which may consist of any optional control unit to be transmitted to each sensor unit, and to return data which corresponds to the control command.

1.2 Basic Protocol for Data Communication

The data communication is conducted as a non-synchronous serial communication using the UART equipped to the personal computer. Based on this serial communication, the light emission timing control, data transfer, handshake and communication control are executed.

1.3 ID of Each Sensor Unit

The ID (unique address) for each sensor unit is automatically allocated at the time of power-up. The allocation of the IDs is conducted in such a manner that the right most sensor unit is assigned with ch 0, and the channel number of the ID of each sensor unit increases by one in proportion to the distance from the right most sensor unit. The time required for allocating the IDs is less than 95 ms from the time of power-up, and the communication mode has moved on from the ID allocation mode to the normal mode in less than 100 ms from the time of power-up.

1.4 Data Transfer between the Sensors

The data transfer between the sensor units is accomplished in the manner of a bucket brigade in which the data from the adjacent sensor unit on one side is received as serial data, and it is then transmitted, either as it is or after being processed, to the adjacent sensor unit on the other side. The communication consists of bi-direction communication which can be conducted from either direction. Because the elements for light communication (light emitting elements LED and light receiving elements PD) are placed adjacent to one another, it is not possible to conduct data transmission and reception at the same time as far as one side of the sensor unit is concerned. Therefore, data transmission and reception are conducted as a time sharing procedure.

1.5 Maximum Number of Sensor Units That Can Be Connected

The maximum number of sensor units that can be connected in 16.

2. Hardware

The structure of the hardware in connection with the communication of the sensor system of the present invention is described in the following.

Figure 29:
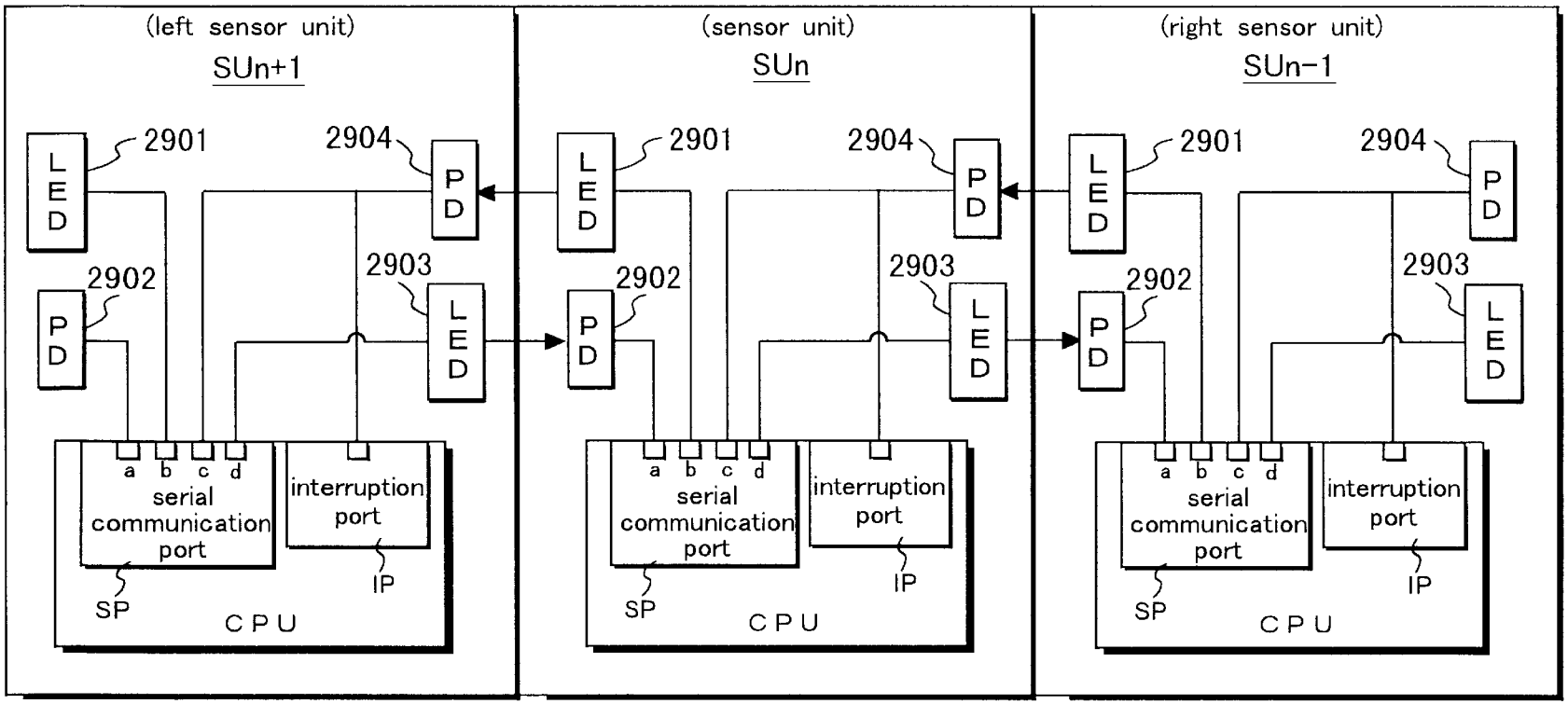
FIG. 29 is a diagram illustrating the hardware for communication.

FIG. 29 illustrates the simplified diagram of the communication hardware. The sensor unit $SU_{n+1}$, $SU_n$ and $SU_{n-1}$ are each incorporated with a CPU consisting of a microcomputer equipped with UART or a serial communication circuit. The CPU is provided with a serial communication port SP and an interruption port IP.

The serial port SP comprises a transmission port TX0 (denoted with symbol b), reception port RX0 (denoted with symbol a), transmission port TX1 (denoted with symbol d) and reception port RX1 (denoted with symbol c).

Referring to the centrally located sensor unit $SU_n$, its transmission port TX0 (denoted with symbol b) is connected to a LED (light emitting element) 2901 for transmitting data to the left adjacent sensor unit $SU_{n+1}$.

Likewise, the reception port RX0 (denoted with symbol a) of the sensor unit $SU_n$ is connected to a PD (light receiving element) 2902 for receiving data from the left adjacent sensor unit $SU_{n+1}$.

Likewise, the transmission port TX1 (denoted with symbol d) of the sensor unit $SU_n$ is connected to a LED (light emitting element) 2903 for transmitting data to the right adjacent sensor unit $SU_{n-1}$.

Likewise, the reception portion RX1 (denoted with symbol c) of the sensor unit $SU_n$ is connected to a PD (light receiving element) 2904 for receiving data from the right adjacent sensor unit $SU_{n-1}$.

Likewise, the interruption port IP of the CPU is connected to a PD (light receiving element) 2904 for receiving data from the right adjacent sensor unit $SU_{n-1}$. Thereby, the interruption of the CPU can be invoked by a light emitting timing signal from the right adjacent sensor unit $SU_{n-1}$.

Although not shown in the drawing, optical signal conversion circuits are interposed between the light emitting and receiving elements 2901 to 2904, and this creates a certain time delay. This time delay has some significance in the evaluation of the hardware.

3. Connection of Sensor Units

The connection structure of the sensor units in the sensor system of the present embodiment is described in the following in connection with the number of connected sensor units, the position for connecting the optional unit and the procedure for the address allocation of the sensor units.

3.1 Maximum Number of Sensor Units That Can Be Connected

Figure 30:
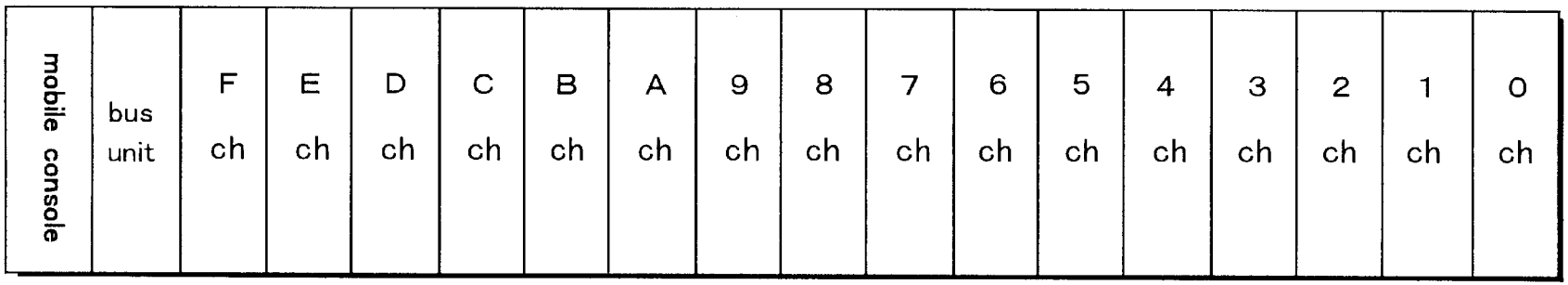
FIG. 30 is a diagram illustrating the state where a maximum number of units are connected in combination with a bus unit.

FIG. 30 shows the state when the maximum number of sensor units are connected along with the bus unit BU. As shown in the drawing, the maximum number is 16.

3.2 Connecting Position of Optional Unit (OU)

Figure 31:
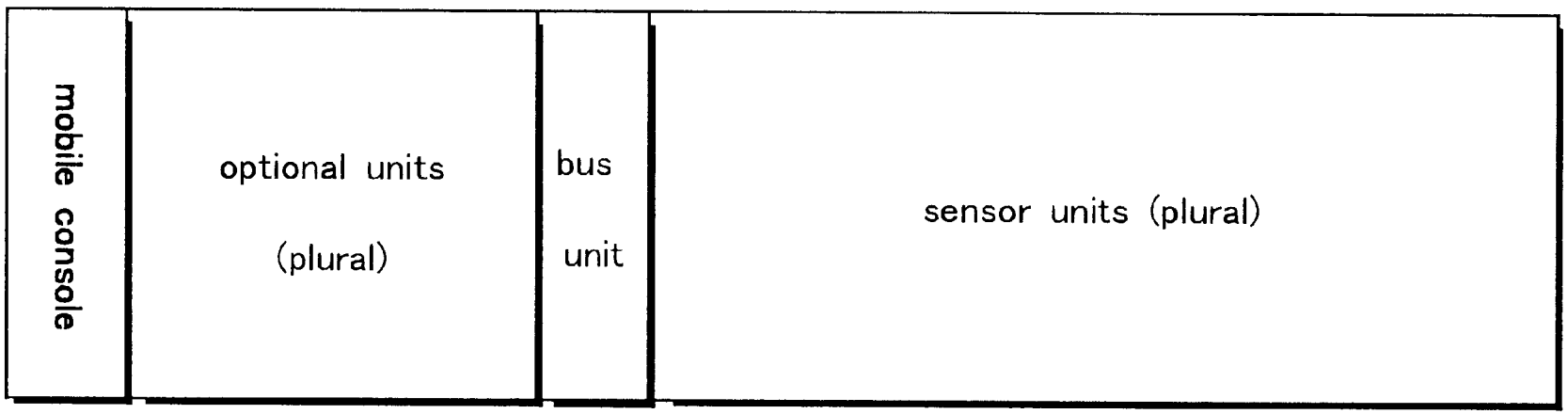
FIG. 31 is a diagram showing the layout of the sensor system including an optional unit.

FIG. 31 shows the unit layout when using an optional unit. As shown in the drawing, the sensor unit array (SU, SU, . . . ) are connected to the right end, and the optional unit OU is connected to the left end of the sensor unit array.

Also, when using a bus unit BU, the optional unit OU is connected to the left of the bus unit BU. The mobile console MC is connected to the left most position because it is used for adjustment purpose.

3.3 Procedure for Address Allocation of Sensor Units

Figure 32:
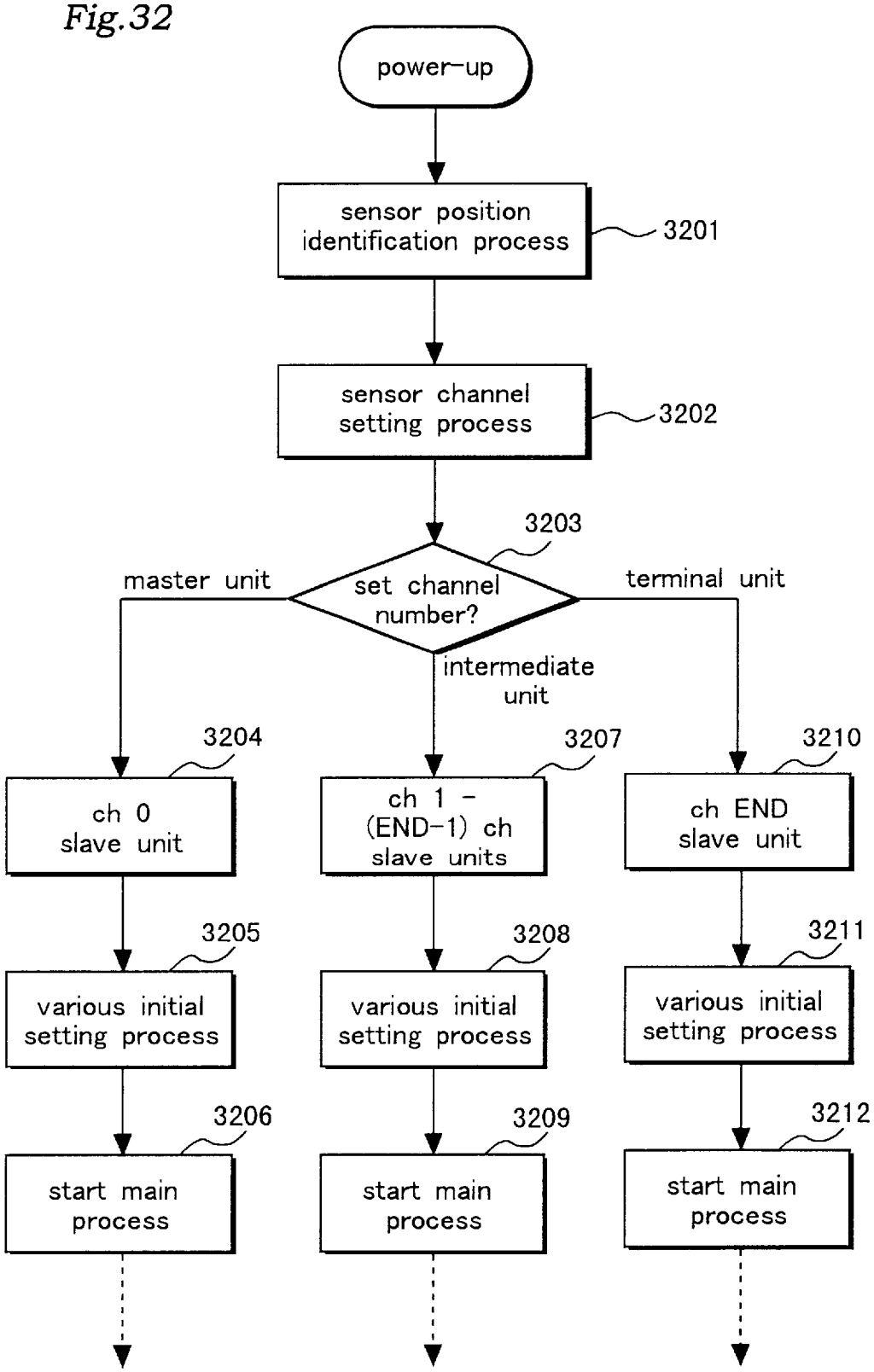
FIG. 32 is a flowchart generally showing the initial process.
Figure 34:
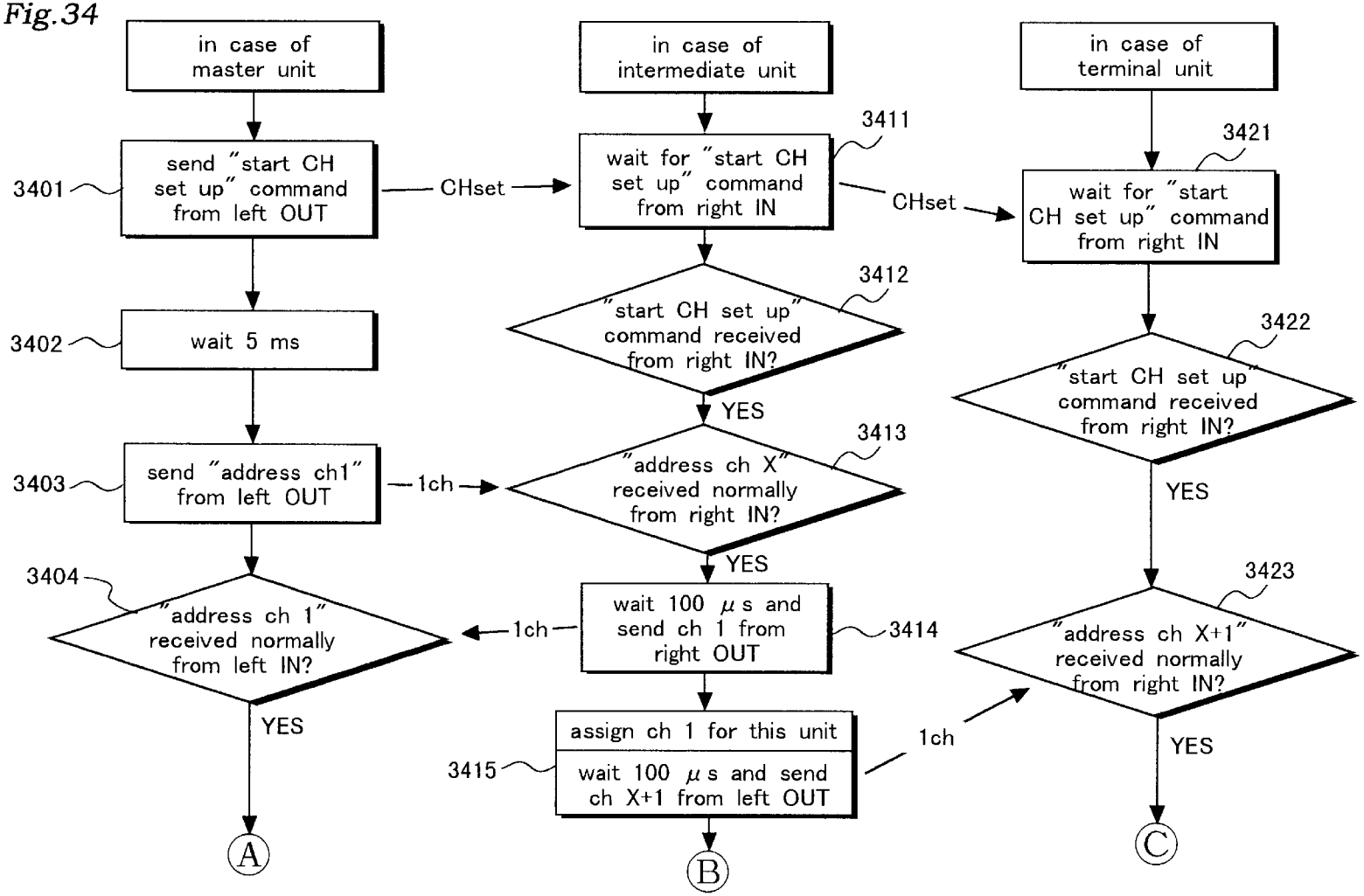
FIG. 34 is a diagram showing the sensor channel setting process (part 1)
Figure 35:
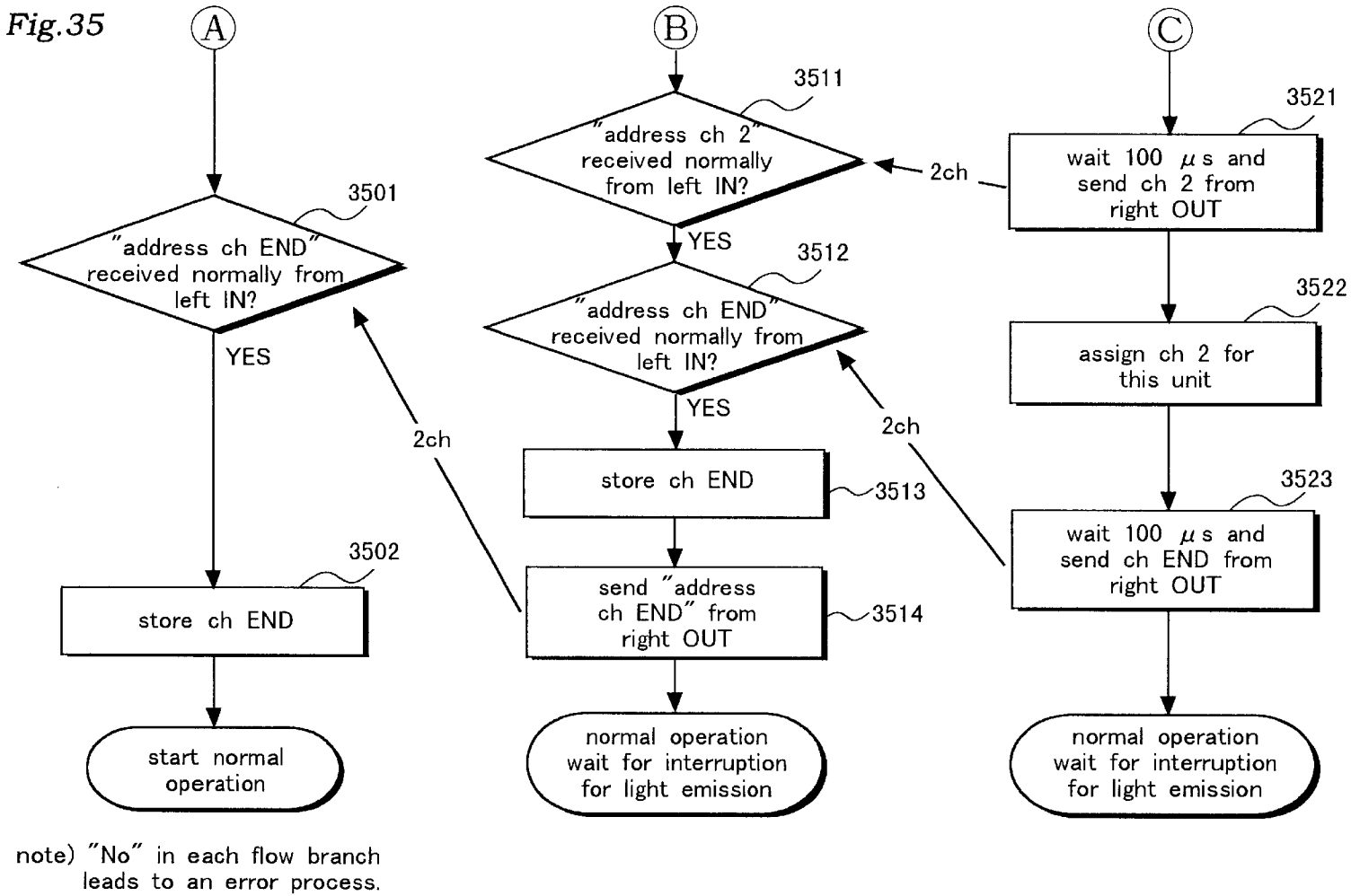
FIG. 35 is a diagram showing the sensor channel setting process (part 2)

FIG. 32 is a flowchart showing the initial control flow immediately after power-up, FIG. 33 is a flowchart showing the control flow of the sensor position identification process, FIGS. 34 and 35 are a flowchart showing the control flow of the sensor channel setting process, and FIG. 36 shows the structure of the transmission and reception data.

The address allocation procedure essentially consists of the identification by each sensor of its own address making use of a certain learning process by communicating with the adjacent sensor units immediately after power-up.

This address identification process is conducted not only by the sensor units SU but also by the optional unit OU. According to the present embodiment, if the power-up is delayed, and the ID identification fails to be executed on any particular sensor unit, the initially allocated IDs have a higher priority, and the group of sensor units which involved the delay in power-up are treated as a separate group of sensor units. The input and output data and light emitting timing signals from these sensors are ignored.

The data communication at the time of connecting sensor units is not required during the normal operation, and is based on the process of immediate transmission (after waiting 100 $\mu$s) and polling reception without any synchronization.

In other words, as shown in FIG. 32, as a part of the initialization process immediately following power-up, the sensor position identification process (step 3201) and the sensor channel setting process (step 3202) are executed in that order to set up the sensor channels. Then, depending on the kind of each particular sensor unit (step 3203), a master unit, intermediate unit and terminal unit (steps 3204, 3207 and 3210), following the corresponding process setting process (steps 3205, 3208 and 3211) is conducted, the control flow moves on to the corresponding main process (steps 3206, 3209 and 3212).

As shown in FIG. 33, in the sensor position identification process, first of all, it is determined if there is no signal input to the right IN (from the output end PD 2904 of the right adjacent sensor unit) for a time period of 50 $\mu$s (step 3301). If there is no signal input (step 3301-yes), while sending out a handshake signal #2 (HS2) to the right OUT (to the input end of the LED 2903 of the right adjacent sensor unit), the control flow awaits for a signal input to the left IN (from the output end of PD 2902 of the left adjacent sensor unit) (step 3302).

Conversely, if it is determined that there was a signal input to the right IN (from the output end of PD 2904 of the right adjacent sensor unit) within a time period of 50 $\mu$s (step 3301-no), a handshake signal #2 (HS2) is sent out to the right OUT (to the input end of the LED 2903 of the right adjacent sensor unit) after a time delay of 50 $\mu$s (step 3303), and while sending out a handshake signal #2 (HS2), it is determined if there is any signal input to the left IN (from the output end of PD 2902 of the left adjacent sensor unit) (step 3302).

Then, it is determined if there is no signal input to the left IN (from the output end of PD 2902 of the left adjacent sensor unit) within a time period of 50 $\mu$s (step 3304). If there is no signal input to the left IN (step 3304-yes), while sending out a handshake signal #1 (HS1) to the right OUT (to the input end of the LED 2901 of the left adjacent sensor unit), the control flow awaits for a signal input to the right IN (from the output end of PD 2904 of the eight adjacent sensor unit) (step 3306).

If it is determined that there was a signal input to the left IN (from the output end of PD 2902 of the left adjacent sensor unit) within a time period of 50 $\mu$s (step 3304-no), a handshake signal #1 (HS1) is sent out to the left OUT (input end of the LED 2901 to the left adjacent sensor unit) after a time delay of 50 $\mu$s (step 3305), and while sending out the handshake signal #1 (HS1), the control flow awaits for a signal input to the right IN (to the output end of PD 2904 of the right adjacent sensor unit) (step 3306).

Thereafter, provided that the position is not yet set (step 3307-yes) or the position is set and the right IN is not the command to start the channel setting, the position setting process (step 3309) is executed.

In the position setting process (step 3309), the particular sensor unit is identified as an intermediate sensor unit if the right IN is HS1 and the left IN is HS2, and the particular sensor is identified as a master sensor unit if there is no right IN and the left IN is HS1. The particular sensor unit is identified as an end or terminal sensor unit if the right IN is HS1 and there is no left IN. The particular sensor unit is identified as a stand-alone sensor unit if there is neither right IN nor left IN. For the duration of 40 ms, the above described processes are repeated (steps 3301 to 3309).

In the meantime, if the right IN is determined to be a channel setting start command in step 3308 (step 3308-yes) or if the 40 ms time period has elapsed (step 3310-yes), the sensor channel setting process is started (step 3311).

Referring to FIGS. 34 and 35, in the sensor channel setting process, first of all, the master sensor unit transmits a channel setting start command (CHset) to the adjacent slave (intermediate) sensor unit (step 3401), and after executing a delay process of 5 ms (step 3402), an "address ch 2" command is transmitted to the adjacent slave (intermediate) sensor unit. Then, the master sensor unit waits for the arrival of "address ch 2" from the adjacent slave (intermediate) sensor unit as a reception response (step 3404). Upon receiving "address ch 2" from the adjacent slave (intermediate) sensor as a reception response (step 3404-yes), the master sensor unit further waits for the arrival of "address ch 3", "address ch 4" through "address ch end". Once all the addresses are received (step 3501-yes), the channel numbers are stored (step 3502), and the program flow advances to the normal operation.

Meanwhile, each slave (intermediate) sensor unit waits for the arrival of a channel setting start command (CHset) (step 3411). Once a channel setting start command (CHset) is received, it is forwarded to the adjacent slave (intermediate or terminal) senor unit on the other side of the master sensor unit, and it is determined if the channel setting start command (CHset) was received normally (step 3412). If the channel setting start command (CHset) was received normally (step 3412-yes), the program flow then waits for the normal reception of "address ch 2" from the master unit (step 3413). Once "address ch 2" is received normally (step 3413-yes), following a waiting period of 100 $\mu$s, the particular slave unit sends "address ch 2" to the master sensor unit as a reception response (step 3414). Then, "address ch 2" is set as its own address, and after adding +1 to "address ch 2", the obtained "address ch 3" is transmitted to the adjacent slave sensor unit on the other side of the master sensor unit (step 3415). The program flow then waits for the response to the normal reception of "address ch 3" from the adjacent slave sensor unit on the other side of the master sensor unit (step 3511). Once "address ch 3" is received normally (step 3512-yes), the program flow awaits for the arrival of the responses to the normal reception of "address ch 4", "address ch 5" through "address ch end". Once all the addresses are normally received (step 3512-yes), they are stored (step 3513), and after sending all the received channel numbers to the master sensor unit (step 3514), the program flow advances to the normal operation state of waiting for the light emission process by interruption.

Each of the intermediate slave sensor units interposed between the master unit and the terminal unit performs the process of transferring "channel setting start command (CHset)" to the adjacent slave sensor unit on the other side of the master sensor unit (step 3411), the process of transmitting the "address ch (X)" received from the adjacent slave sensor unit on the side of the master sensor unit to the adjacent slave sensor unit on the side of the master sensor unit as a reception response (step 3414), the process of setting the "address ch (X)" as its own address (step 3415), transmitting the "address ch (X+1)" to the adjacent slave sensor unit on the other side of the master sensor unit by incrementing the "address ch (X) (step 3415)", the process of receiving the "address ch (X+1)" from the adjacent slave sensor unit on the other side of the master sensor unit as a reception response (step 3511), and the process of receiving the response to the channel assignment completion for the "address ch (X+1)", "address ch (X+2), "address ch (X+3)", . . . , "address ch End" from the adjacent slave sensor unit on the other side of the master sensor (step 3512-yes), storing them in the particular sensor, and transmitting all of the channel addresses to the adjacent slave sensor unit on the side of the master sensor (step 3514).

Meanwhile, the terminal sensor unit waits for the arrival of a "channel setting start command (CHset)" from the adjacent slave sensor unit on the side of the master sensor (step 3421), and determines if the arrived command has been received normally (step 3422). If the command has been received normally (step 3422-yes), the terminal sensor unit awaits for the reception of the channel number corresponding to its own address (step 3423). Once such a channel number is normally received (step 3423-yes), after a waiting period of 100 $\mu$s, the response to the address reception is transmitted to the slave unit on the side of the master sensor unit (step 3521), and the address is assigned as its own address (step 3522). Following another waiting period of 100 $\mu$s, all of the channel numbers "ALLch" are transmitted to the slave unit on the side of the master sensor unit (step 3523).

As a result of the master, intermediate and terminal sensor units repeating the above described actions, each of the units is assigned with a unique address.

4. Outline of Optical Communication Protocol

The outline of the optical communication protocol of the sensor system of the present embodiment is described in the following in connection with the kind of data that is handled by the optical communication, the communication specifications of the microcomputer, and the format of the data for communication.

4.1 Kind of Data That Is Handled by Optical Communication

In the sensor unit of the present embodiment, the data that is handled by the optical communication includes the control output, commands from the peripheral equipment (optional unit) such as a mobile console, data returning command to the peripheral equipment (optional unit), and the return control command.

4.2 Communication Specifications of Microprocessor

The UART of the microprocessor for the serial data communication function is used for the optical communication, and the ports TxD0/RxD0 and TxD1/RxD1 are used. An interruption port is used for triggering the light emitting timing.

4.2.1 Optical Transmission/Reception Format

FIG. 37 shows an exemplary transmission/reception format. As shown in FIG. 37(*a*), the control data T1 and T2 each include 12 bits including a start bit (one bit), character bits (9 bits), a parity bit (one bit) and a stop bit (one bit).

As shown in FIG. 37(*b*), the updata and downdata each include 1 bits including a start bit (one bit), character bits (9 bits) and a stop bit (one bit).

4.2.2 Baud Rate

The baud rate is 625 kbps, and transmitting 12 bits of data requires 19.2 μs.

4.3 Data Format for Communication

Figure 38:
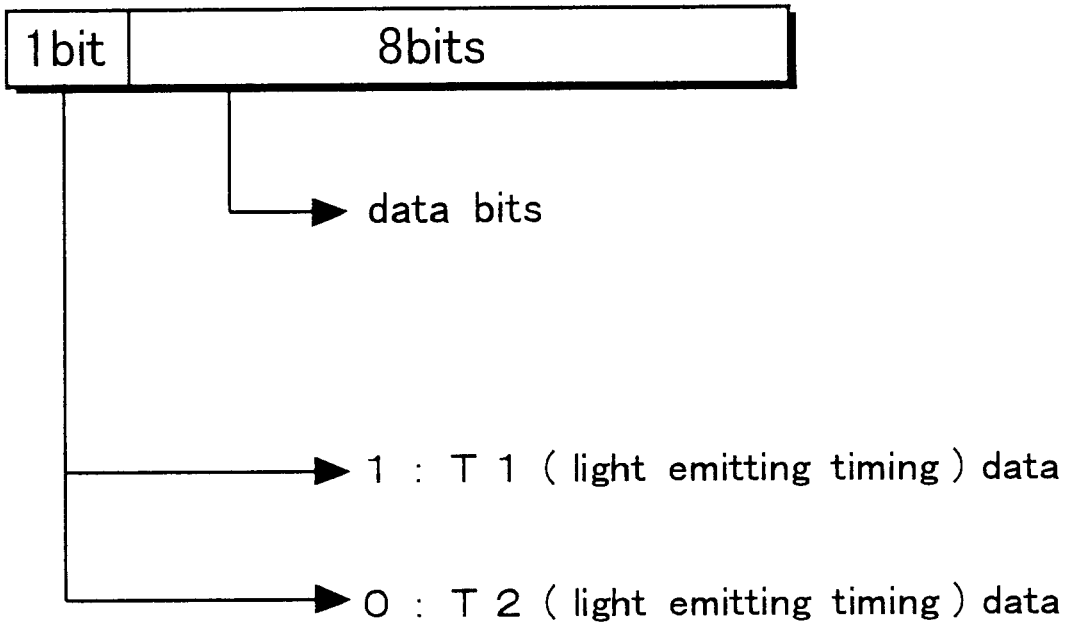
FIG. 38 is a diagram showing the specifications of the data for communication.

FIG. 38 shows the specifications of the data for communication. As shown in the drawing, the data has a length of 9 bits. The first single bit consists of an identification flag. If this bit is "1", the data is T1 (light emission timing) data. If this bit is "0", the data is T2 (light reception timing) data.

4.3.1 Specifications of T1/T2 Data

FIG. 39 shows the contents of control data T1/T2. As shown in the drawing, the first eight bits of the control data T1 correspond to the control output for channels 0 to 7 (the switching output of the photoelectric sensors in the case of the present embodiment). Likewise, the first eight bits of the control data T2 correspond to the control output for channels 8 to 15 (the switching output of the photoelectric sensors in the case of the present embodiment). The content of each bit is "1" if the control output is on, and "0" if the control output is off. Each sensor unit (SU) constantly transmits the state of the control output via the control data T1/T2.

4.3.2 Specifications of Down DATA and Up DATA

FIG. 40 shows the structure of Down DATA and Up DATA. As shown in the drawing, Down DATA and Up DATA essentially consist of 6-byte commands. Six bytes form a single packet, and the contents of each packet are illustrated in FIG. 40.

5. Optical Communication and Operation Cycles of Sensor Units

Each sensor unit has a basic operation cycle of 100 μs. However, more detailed operation cycle is dictated by the timing of receiving a light emission completion signal (start bit of T1/T2 signal) from the adjacent sensor unit on the side of the master sensor unit. If the light transmission by the sensor unit on the side of the master sensor unit is delayed due to external light, there will be a corresponding delay in the T1/T2 signal. Such a delay in the action of the sensor units affects the operation cycle for communication.

5.1 Timing for Light Emission

Each intermediate slave sensor units in the connected sensor unit array emits light upon detecting the rise of the start bit of the T1/T2 data forwarded from the sensor unit on the side of the master unit, and forwards the T1/T2 data to the sensor unit on the other side of the master unit immediately before emitting light.

5.2 Synchronization of Light Emission Timing in Optical Communication

The procedure for synchronizing the light emission timing in the optical communication is described in the following.

5.2.1 Ch 0 Unit

Ch 0 unit emits light at the interval of 100 μs according to a timer, and transmits the T1/T2 data immediately before emitting light. This process is repeated.

5.2.2 Units Other Than Ch 0 Unit

The T1/T2 signal is transmitted from the sensor unit on the side of the master unit. The start bit of this signal is detected from the interruption port, and following the transmission of the T1/T2 signal, starts a light emission. The delay time from the light emission of the preceding sensor unit is less than 10 μs. The transmission of the T1/T2 signal in this case consists of passing the T1/T2 signal form the sensor unit on the side of the master unit at the time of the previous light emission to the sensor unit on the other side of the master unit.

5.2.3 If Ch END Consists of Sensor Unit

The unit essentially performs the same functions as any one of the sensor units other than the ch 0 sensor unit. In the case of the ch END sensor unit also, the T1/T2 signal is transmitted to the left.

5.2.4 If ID of Sensor Unit is Greater Than 16

Because the sensor unit cannot put its own control output into the T1/T2 signal, the received T1/T2 data is simply transmitted to the subsequent sensor unit as it is. The sensor unit otherwise functions like any other sensor unit.

5.2.5 Case of Stand-Alone Sensor Unit

When using a sensor unit as a stand-along sensor unit, basically, as there is no need for any communication process, it essentially follows the action (master action) of the ch 0 sensor unit.

5.3 Transmission and Reception of T1/T2 Data 5.3.1 Reception Completion Timing for T1/T2 Data The confirmation of the completion flag for the reception of T1/T2 data is performed in t1 μs from the start of light emission.

5.3.2 Identification of T1/T2 Data

The identification of T1/T2 data is performed on the upper most bit of the 9-bit data. "1" means a T1 signal, and "0" means a T2 signal.

5.3.3 When There is No INT Interruption Due to Noises

If the INT interruption due to the light emission from the sensor unit on the side of the master unit fails to be identified for the period of t2 μs from the previous interruption due to the influences of noises or the like, "S-Err" is displayed, and the operation is terminated. In this case, if desired, a channel reallocation may be automatically conducted.

5.3.4 Influences of Noises on Interruption Port

To reduce the possibility of erroneously conducting a light transmitting process upon receiving a signal from the interruption port due to the influences of noises or the like, the light emission interruption is denied during the duration of the light receiving/transmitting interruption process. Therefore, an interruption demand flag is cleared only after an interruption process is completed.

5.3.5 Case of T1/T2 Communication (Reception) Error

In case of a reception error of T1/T2 data, the previously received T1/T2 data is transmitted.

5.4 Communication Process for Ch 0 and Ch END Units From a Side Having No Adjacent Unit 5.4.1 Process Contents for Ch 0

Upon detecting the master sensor unit following power-up, the 0 ch sensor unit is not required to communicate with the right sensor unit (on the side of the master unit). Therefore, upon completion of the master unit detection process (upon starting the ID allocation process), the ch 0 sensor unit does no reception process for reception from the right side.

5.4.2 Process Contents for Ch END

Normally, there is no unit on the left side of the ch END unit, but because it is possible that a mobile console is connected to the left side, the process of confirming the reception completion flag for the left input (SLIN) is constantly executed.

6. Command Data Transmission for Optical Communication

Each sensor unit essentially responds to a command in a passive manner. Therefore, as long as there is no command issuing from the mobile console, bus unit or optional unit, there will be no process of executing or transmitting command data. Only when a command is received from any one of them, the sensor unit transmits return data.

6.1 Mobile Console Data

The data transmitted in the data communication contains 6-byte commands.

6.1.1 Detection of U-Data/D-Data in Each Sensor Unit

It is necessary to detect the presence of Up Data and Down Data in each operation cycle. The reception completion flag for U-Data and D-Data is according to the following timing, and a corresponding process is executed once a reception completion is determined. Up Data is determined in to us following the rise of a light emission pulse. Down Data is determined in t2 $\mu$s following the rise of a light emission pulse.

6.1.2 6-Byte Commands

Figure 41:
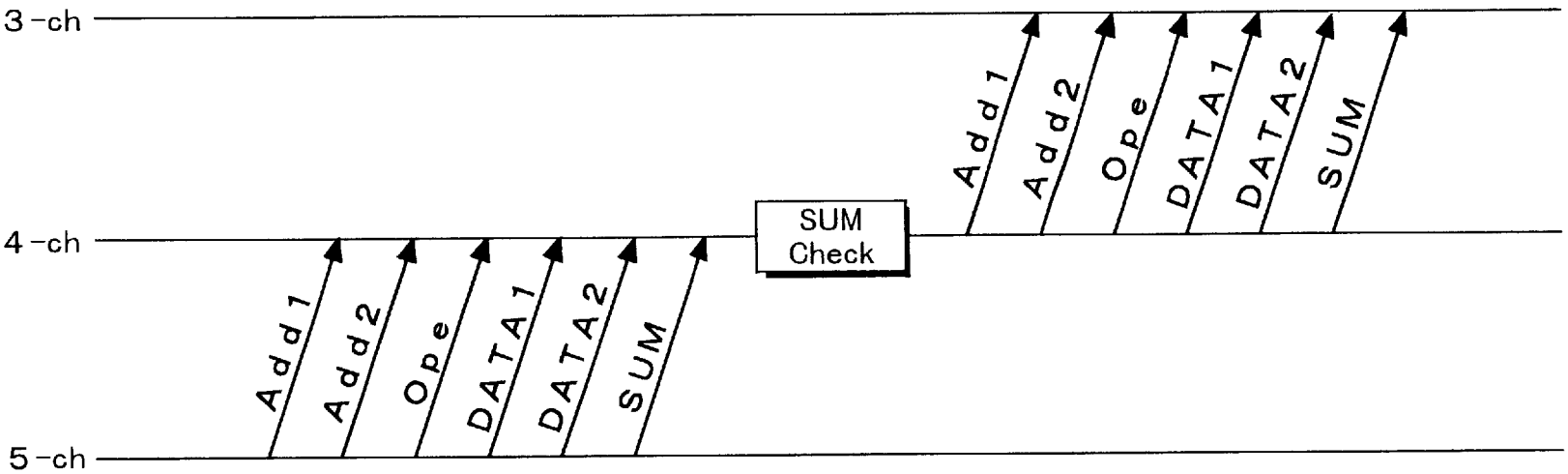
FIG. 41 is a diagram showing the control flow of a 6-byte command.

FIG. 41 shows the control flow of a 6-byte command. As shown in the drawing, a 6-byte command is intended for setting up each sensor unit. The structure of this command type is described in 5.3.2. The data is transferred by simultaneously transferring the six bytes.

More specifically, as shown in FIG. 41, when a 6-byte command is transmitted, the SUM Check data attached to the command conducts a sum check, and if no problem exists, data is transmitted to the subsequent sensor unit. When an error is detected, all the processes concerning the communication data are cleared, and the normal process is resumed. There will be no processes such as a resend request.

6.1.2.1 Exemplary Data Communication Process

Figure 42:
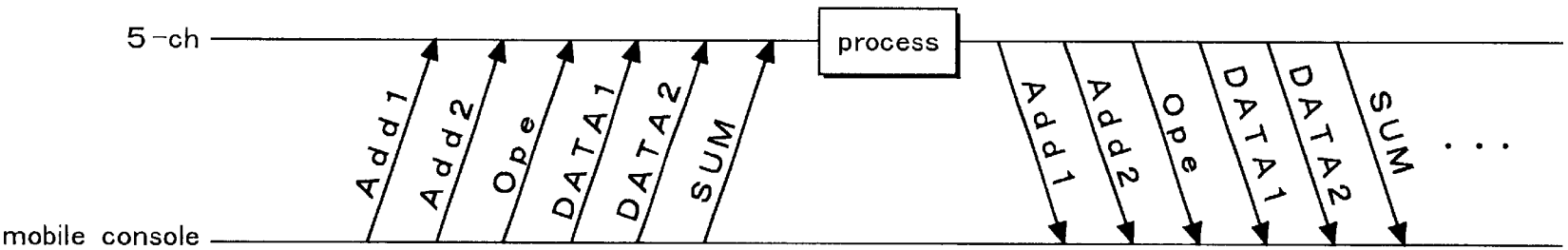
FIG. 42 is a diagram showing the concept of data communication.

The basic concept of a data communication process is illustrated in FIG. 42. As shown in the drawing, during the time a command is transmitted from the mobile console to the ch 5 unit, the data is transmitted from the mobile console to the ch 5 sensor unit via the slave sensor units in the manner of a bucket brigade. The particular sensor conducts a process corresponding to the command, and returns the data. Because the target address is transmitted first, the command would not be transmitted to the sensor which is further toward the master sensor unit than the target address. The data is subjected to an error check at each sensor unit, and a high level of data reliability is accomplished. thereafter, a process corresponding to the command is executed, and a reply to the command is transmitted (the process time varies depending on the command).

6.2 Relation to Mobile Console

Figure 43:
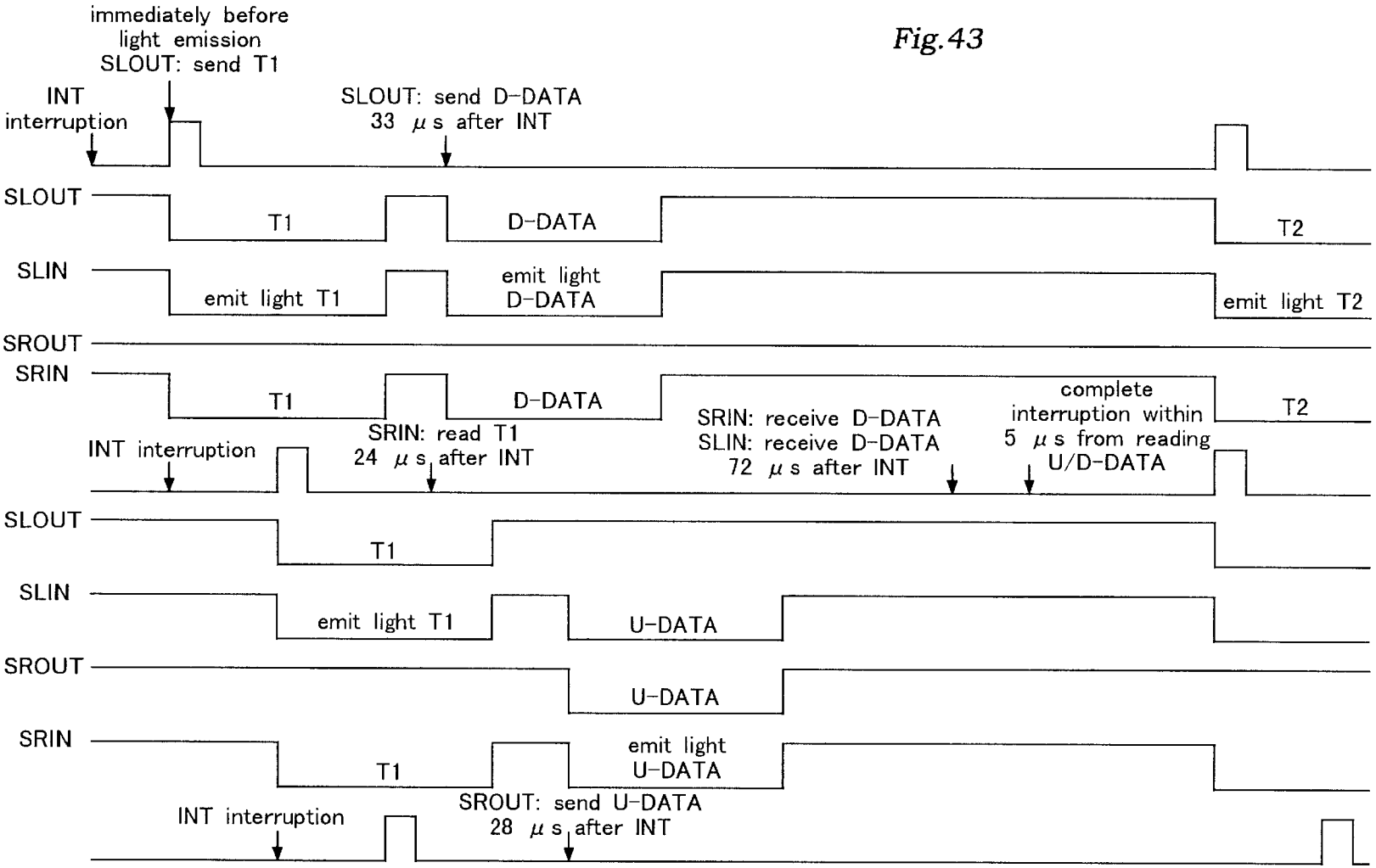
FIG. 43 is a timing chart showing the concept of data communication.

The mobile console publishes UP-DATA by using the ch 0 T1/T2 signal as a trigger. The sensor unit starts a communication process with the mobile console following the determination of a serial transmission completion flag of UP-DATA. Finally, FIG. 43 is a detailed timing chart for the communication process.

As can be appreciated from the foregoing description, the present invention simplifies the work involved in the setting and adjustment of the sensor units which form a sensor system of this kind, and the convenience of the sensor system can be improved.

Although the present invention has been described in terms of preferred embodiments thereof, it is obvious to a person skilled in the art that various alterations and modifications are possible without departing from the scope of the present invention which is set forth in the appended claims.

What is claimed is:

1. A sensor system, comprising a plurality of sensor units which are adapted to be placed closely one next to another and each assigned with an individual address, and a mobile console which is adapted to be connected to at least one of the sensor units, each of the sensor units comprising:

an output circuit for forwarding an output signal to an electric cord;

connector means provided on each side for allowing communication with a corresponding one of the adjacent sensor units; and data relaying means for relaying data received from one of the adjacent sensor units via one of the connector means to the other adjacent sensor unit via the other connector means so as to permit a bi-directional data communication from the mobile console to the sensor units or from the sensor units to the mobile console in the manner of a bucket brigade.

2. A sensor system according to claim 1, wherein each sensor unit comprises monitoring data transmission means for transmitting monitoring data intended for the mobile console to one of the adjacent sensor units, and the mobile console comprises monitoring, data display means for receiving monitoring data transmitted from one of the sensor units and displaying the received monitoring data so as to permit a state of the sensor unit to be monitored from the mobile console.

3. A sensor system according to claim 1, wherein the mobile console comprises setting data transmission means for transmitting setting data intended for each designated one of the sensor units to one of the sensor units, and each sensor unit comprises data setting means for executing a setting operation according to the setting data received from one of the adjacent sensor units if the received setting data is intended for the particular sensor unit so as to permit the setting operation at the sensor unit to be executed from the mobile console.

4. A sensor system according to claim 1, wherein the mobile console comprises command data transmission means for transmitting command data intended for each designated one of the sensor units to one of the sensor units, and each sensor unit comprises command executing means for executing an action associated with the command if the received command data is intended for the particular sensor unit and contains a command, thereby allowing the action of the sensor to be executed according to a command from the mobile console.

5. A sensor system according to claim 4, wherein the command comprises a monitor command, and the action comprises an action to read data on an monitoring item designated by the monitor command, and to return the read data to the mobile console as monitoring data.

6. A sensor system according to claim 4, wherein the command comprises a data setting command, and the action comprises an action to write data attached to the data setting command to a designated setting item of the sensor unit.

7. A sensor system according to claim 4, wherein the command comprises a disable command, and the action comprises an action to disable a manipulation of the sensor unit for a designated function.

8. A sensor system according to claim 4, wherein the command comprises a concealed function executing command which allows a concealed function to be executed, the concealed function being unable to be invoked by a key operation from the sensor unit.

9. A sensor system, comprising a plurality of sensor units which are adapted to be placed closely one next to another and each assigned with an individual address, and a bus unit which is adapted to be connected to at least one of the sensor units, each of the sensor units comprising:

connector means provided on each side for allowing communication with a corresponding one of the adjacent sensor units; and data relaying means for transferring data received from one of the adjacent sensor units via one of the connector means to the other adjacent sensor unit via the other connector means;

the bus unit comprising protocol conversion means for converting a communication protocol between sensor unit communication system and field bus communication system which is connected to programmable equipment, so as to permit a bi-directional data communication between the programmable equipment on a field bus and the sensor unit in the manner of a bucket brigade.

10. A sensor system according to claim 9, wherein each sensor unit comprises command executing means which, if the data received the adjacent sensor unit is intended for the particular sensor unit and contains a command, executes a certain action corresponding to the command, thereby allowing the action of the sensor unit to be executed according to a command from equipment on the field bus.

11. A sensor unit, comprising:

an output circuit for forwarding an output signal to an electric cord;

connector means provided on each side for allowing communication with a corresponding one of adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command.

12. A sensor system according to claim 11, wherein the command comprises a monitor command, and the action comprises an action to read data on an monitoring item designated by the monitor command, and to return the read data to the source of the command as monitoring data.

13. A sensor system according to claim 11, wherein the command comprises a data setting command, and the action comprises an action to write data attached to the data setting command to a designated setting item of the sensor unit.

14. A sensor system according to claim 11, wherein the command comprises a disable command, and the action comprises an action to disable a manipulation of the sensor unit for a designated function.

15. A sensor unit according to claim 11, wherein the command comprises a concealed function executing command, and the action comprises an action to allow a concealed function to be executed, the concealed function being unable to be invoked by a key operation from the sensor unit.

16. A mobile console adapted to be connected to one of a plurality of sensor units each adapted for a bi-directional communication with adjacent sensor units and a data relaying function, comprising:

command means for entering various commands;

display means for displaying various items of data;

monitor command transmitting means for transmitting a monitor command, and including a detected value, and a set sensitivity level or a threshold level as monitoring items capable of being designated by said monitor command, to a designated sensor unit in response to a command entered from the command means; and monitoring data display means for displaying the detected value, and the set sensitivity level or the threshold level, on the display means that is returned from the designated sensor unit in response to the transmission of the monitor command.

17. A mobile console adapted to be connected to one of a plurality of sensor units each adapted for a bi-directional communication with adjacent sensor units, each sensor unit having a data relaying function, and an output circuit for transmitting output signals to an electric cord, comprising:

connector means for connecting to one of the sensor units via a separate path from the electric cord using said data relaying function;

command means for entering various commands;

display means; and setting command transmission means for transmitting a setting command for setting a set sensitivity level, or a threshold level, to a designated sensor unit in response to a command from the command means.

18. A mobile console comprising a function key for setting or adjustment operation, and adapted to be connected to one of a plurality of sensor units each adapted for a bi-directional communication with adjacent sensor units and a data relaying function for data, comprising:

command means for entering various commands;

display means for displaying various items of data; and disable command transmission means for transmitting a disable command associated with disabling the manipulation of a prescribed key for setting or adjustment operation to a designated sensor unit in response to a command from the command means.

19. A mobile console adapted to be connected to one of a plurality of sensor units each adapted for a bi-directional communication with adjacent sensor units and a data relaying function, comprising:

command means for entering various commands;

display means for displaying various items of data; and concealed function executing command transmitting means for transmitting a concealed function executing command to a designated sensor unit, the concealed function being unable to be invoked by a key operation from the sensor unit.

20. A sensor system, comprising a plurality of sensor units which are adapted to be placed closely one next to another and each assigned with an individual address, each of the sensor units comprising:

an output circuit for forwarding an output signal to an electrical cord;

connector means provided on each side for allowing communication with a corresponding one of the adjacent sensor units; and data relaying means for relaying data received from one of the adjacent sensor units via one of the connector means to the other adjacent sensor unit via the other connector means so as to permit a bi-directional data communication between the sensor units in the manner of a bucket brigade.

21. A bus unit adapted to be connected to one of a plurality of sensor units each adapted for a bi-directional communication with adjacent sensor units and a data relaying function, comprising:

protocol conversion means for converting a communication protocol between a sensor unit communication system and field bus communication system which is connected to programmable equipment, so as to permit a bi-directional data communication between the equipment such as a programmable controller and personal computer on a field bus and the sensor unit.

22. A sensor system according to claim 1, wherein the sensor units comprise photoelectric sensor units.

23. A sensor system according to claim 9, wherein the sensor units comprise photoelectric sensor units.

24. A sensor unit according to claim 11, wherein the sensor unit comprises a photoelectric sensor unit.

25. A mobile console according to claim 16, wherein the sensor units comprise a photoelectric sensor unit.

26. A mobile console according to claim 17, wherein the sensor units comprise photoelectric sensor units.

27. A mobile console according to claim 18, wherein the sensor units comprise photoelectric sensor units.

28. A mobile console according to claim 19, wherein the sensor units comprise photoelectric sensor units.

29. A sensor system according to claim 20, wherein the sensor units comprise photoelectric sensor units.

30. A bus unit according to claim 21, wherein the sensor units comprise photoelectric sensor units.

31. A sensor system according to claim 1, wherein the connector means comprises a light emitting element and a light receiving element.

32. A sensor system according to claim 9, wherein the connector means comprises a light emitting element and a light receiving element.

33. A sensor unit according to claim 11, wherein the connector means comprises a light emitting element and a light receiving element.

34. A sensor system according to claim 20, wherein the connector means comprises a light emitting element and a light receiving element.

35. A mobile console which is provided commonly for a number of sensor units arranged one next to another and each provided with a communication function, each sensor unit provided with an output circuit for transmitting output signals to an electric cord, comprising;

connector means for connecting to a sensor unit via a separate path from the electric cord using said communication function;

command means;

display means; and control means for taking out data corresponding to a detected value, and a set sensitivity level or a threshold level, on each designated sensor unit from the sensor unit by communication according to a command entered from the command means, and displaying the data on the display means.

36. A mobile console according to claim 35, wherein the communication with the sensor units is conducted via a single sensor unit or a common transmission line.

37. A mobile console according to claim 36, wherein the single sensor unit or common transmission line communicates via wire transmission using an electric cord, or wireless transmission using infrared light, radio wave and ultrasonic radiation so as to allow the data of the sensor units to be monitored remotely.

38. A mobile console according to claim 35, further comprising a housing provided with a keypad serving as the command means and a display unit serving as the display means, the housing being so dimensioned and configured as to allow the keypad to be manipulated with one hand while holding the housing with the other hand.

39. A sensor unit, comprising;

connector means provided on each side for allowing communication with a corresponding one of the adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command;

wherein the command comprises a monitor command, and the action comprises an action to read data on a monitoring item designated by the monitor command, to return the read data to the source of the command as monitoring data, and a detected value, and a set sensitivity level or a threshold level are capable of being designated as the monitoring items.

40. A sensor unit, comprising:

connector means provided on each side for allowing communication with a corresponding one of adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command;

wherein the command comprises a set sensitivity level, or a threshold level attached to a data setting command, and the action comprises an action to write data attached to the data setting command to a designated setting item of the sensor unit.

41. A sensor unit, comprising:

a function key for setting or adjustment operation;

connector means provided on each side for allowing communication with a corresponding one of adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command;

wherein the command comprises a disable command which is associated with disabling the manipulation of a prescribed key for setting or adjustment operation, and the action comprises an action to disable a manipulation of the sensor unit for a designated function.

42. A sensor unit, comprising:

connector means provided on each side for allowing communication with a corresponding one of adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command;

wherein the command comprises a concealed function executing command, and the action comprises an action to allow a concealed function to be executed, the concealed function being unable to be invoked by a key operation from the sensor unit.

43. A sensor system according to claim 9, wherein each of the sensor units comprise:

control output generating means for executing a sensing action and generating control output upon receipt of a prescribed timing signal from an adjacent sensor unit positioned to the opposite side of the bus unit; and control output data relaying means for reflecting control output information of the particular sensor unit in control output data received from the adjacent sensor unit positioned to the opposite side of the bus unit and transmitting the control output data to an adjacent sensor unit positioned to the bus unit side, thereby allowing the control outputs from each of the sensor units to be transmitted to a programmable equipment on the field bus via the bus unit.

44. A sensor unit, comprising:

an output circuit for forwarding an output signal to an electric cord;

connector means provided on each side for allowing communication with a corresponding one of adjacent sensor units;

control output generating means for executing a sensing action and generating control output upon receipt of a timing signal from an adjacent sensor unit positioned to the opposite side of a bus unit; and control output data relaying means for reflecting control output information of the particular sensor unit in control output data received from the adjacent sensor unit positioned to the opposite side of the bus unit and transmitting the control output data to an adjacent sensor unit positioned to the bus unit side.

45. A mobile console adapted to be connected to one of a plurality of sensor units each adapted for a bi-directional communication with adjacent sensor units, each sensor unit having a data relaying function, and an output circuit for transmitting output signals to an electric cord, comprising:

connector means for connecting to one of the sensor units via a separate path from the electric cord using said data relaying function;

command means for entering various commands;

display means;

monitor command transmitting means for transmitting a monitor command for monitoring a set sensitivity level or a threshold level, to a designated sensor unit in response to a command entered from the command means; and monitoring data display means for displaying the set sensitivity level or the threshold level, on the display means that is returned from the designated sensor unit in response to the transmission of the monitor command.

46. A mobile console which is provided commonly for a number of sensor units arranged one next to another and each provided with a communication function, each sensor unit provided with an output circuit for transmitting output signals to an electric cord, comprising;

connector means for connecting to a sensor unit via a separate path from the electric cord using said communication function;

command means;

display means; and control means for taking out data corresponding to a set sensitivity level or a threshold level, on each designated sensor unit from the sensor unit by communication according to a command entered from the command means, and displaying the data on the display means.

47. A sensor unit, comprising;

connector means provided on each side for allowing communication with a corresponding one of the adjacent sensor units;

data relaying means for relaying data received from one of the adjacent sensor units via one of the connector means to the other adjacent sensor unit via the other connector means; and command executing means which, if the data received from the adjacent sensor unit via one of the connector means is intended for the particular sensor unit and contains a command, executes a certain action corresponding to the command;

wherein the command comprises a monitor command for monitoring a set sensitivity level or a threshold level, and the action comprises an action to read data on monitoring item designated by the monitoring command, and to return the read data to the source of the command as monitoring data.

* * * * *

UNITED STATES PATENT AND TRADEMARK OFFICE

CERTIFICATE OF CORRECTION

PATENT NO. : 6,717,515 B1
DATED : April 6, 2004
INVENTOR(S) : Kazunori Osako et al.

It is certified that error appears in the above-identified patent and that said Letters Patent is hereby corrected as shown below:

Column 42,
Line 46, please add the following claims:

48. A sensor system, comprising a plurality of sensor units which are adapted to be placed closely one next to another and each assigned with an individual address, and a mobile console which is adapted to be connected to at least one of the sensor units, each of the sensor units comprising:

connector means provided on each side for allowing communication with a corresponding one of the adjacent sensor units;

timing signal transmitting means for transmitting a timing signal for sensing action received from one of the adjacent sensor units via the connector means on one side, to the adjacent sensor unit via connector means on the other side in a delayed manner; and data relaying means for receiving data comprising monitoring data, setting data, or data including commands from one of the adjacent sensor units via one of the connector means, or transferring the received data to the other adjacent sensor unit via the other connector means, within a time period from the time of transmission of a timing signal to the time of reception of the next timing signal, so as to permit a bi-directional data communication from the mobile console to the sensor units or from the sensor units to the mobile console in the manner of a bucket brigade while executing sensing action having the timing shifted between sensor units.

---

49. A sensor system, comprising a plurality of sensor units which are adapted to be placed closely one next to another and each assigned with an individual address, and a bus unit which is adapted to be connected to at least one of the sensor units, each of the sensor units comprising:

connector means provided on each side for allowing communication with a corresponding one of the adjacent sensor units;

timing signal transmitting means for transmitting a timing signal for sensing action received from one of the adjacent sensor units via the connector means on one side, to the adjacent sensor unit via connector means on the other side in a delayed manner; and data relaying means for receiving data comprising monitoring data, setting data, or data including commands from one of the adjacent sensor units via one of the connector means, or transferring the received data to the other adjacent sensor unit via the other connector means, within a time period from the time of transmission of a timing signal to the time of reception of the next timing signal;

the bus unit comprising protocol conversion means for converting a communication protocol between a sensor unit communication system and a field bus communication system which is connected to a programmable equipment, so as to permit a bi-directional data communication between the programmable equipment on a field bus and the sensor unit in the manner of a bucket brigade while executing sensing action with shifted timing between sensor units.

---

UNITED STATES PATENT AND TRADEMARK OFFICE

CERTIFICATE OF CORRECTION

PATENT NO. : 6,717,515 B1
DATED : April 6, 2004
INVENTOR(S) : Kazunori Osako et al.

It is certified that error appears in the above-identified patent and that said Letters Patent is hereby corrected as shown below:

Column 42 (cont'd),

50. A sensor unit, comprising:

connector means provided on each side for allowing communication with a corresponding one of adjacent sensor units;

timing signal transmitting means for transmitting a timing signal for sensing action received from one of the adjacent sensor units via the connector means on one side, to the adjacent sensor unit via connector means on the other side in a delayed manner;

data relaying means for receiving data comprising monitoring data, setting data, or data including commands from one of the adjacent sensor units via one of the connector means, or transferring the received data to the other adjacent sensor unit via the other connector means, within a time period from the time of transmission of a timing signal to the time of reception of the next timing signal; and command executing means which, if the data received the adjacent sensor unit via one of the connector means is intended for the particular sensor unit and contains a command, executes a certain action corresponding to the command.

---

51. A mobile console adapted to be connected to one of a plurality of sensor units each adapted for a bi-directional communication with adjacent sensor units, a data relaying function relaying timing signal data for sensing action and a data relaying function for monitoring data or data including commands, comprising:

command means for entering various commands;

display means for displaying various items of data;

monitor command transmitting means for transmitting a monitor command within a time period from the reception of a timing signal from the sensor unit to the reception of the next timing signal, and including a detected value, and a set sensitivity level or a threshold level as monitoring items capable of being designated by said monitor command, to a designated sensor unit in response to a command entered from the command means; and monitoring data display means for receiving the detected value, and the set sensitivity level or the threshold level, that is returned from the designated sensor unit in response to the transmission of the monitor command within a time period from the time of reception of a timing signal from the sensor unit to the time of reception of the next timing signal, and displaying the detected value, and the set sensitivity level or the threshold level on the display means.

---

52. A mobile console adapted to be connected to one of a plurality of sensor units each adapted for a bi-directional communication with adjacent sensor units, each sensor unit having a data relaying function relaying timing signal data for sensing action and a data relaying function for data including commands, comprising:

command means for entering various commands;

display means; and setting command transmission means for transmitting a setting command for setting a set sensitivity level, or a threshold level, to a designated sensor unit in response to a command from the command means within a time period from the time of reception of a timing signal from the sensor unit to the time of reception of the next timing signal.

---

UNITED STATES PATENT AND TRADEMARK OFFICE

CERTIFICATE OF CORRECTION

PATENT NO. : 6,717,515 B1
DATED : April 6, 2004
INVENTOR(S) : Kazunori Osako et al.

It is certified that error appears in the above-identified patent and that said Letters Patent is hereby corrected as shown below:

Column 42 (cont'd),

53. A sensor system, comprising a plurality of sensor units which are adapted to be placed closely one next to another and each assigned with an individual address, each of the sensor units comprising:

connector means provided on each side for allowing communication with a corresponding one of the adjacent sensor units;

timing signal transmitting means for transmitting a timing signal for sensing action received from one of the adjacent sensor unit via the connector means on one side, to the adjacent sensor unit via connector means on the other side in a delayed manner; and data relaying means for receiving data comprising monitoring data, setting data, or data including command from one of the adjacent sensor units via one of the connector means, or transferring the received data to the other adjacent sensor unit via the other connector means, within a time period from the time of transmission of a timing signal from the sensor unit to the time of reception of the next timing signal, so as to permit a bi-directional data communication between the sensor units in the manner of a bucket brigade while executing sensing action with shifted timing between sensor units.

54. A bus unit adapted to be connected to one of a plurality of sensor units each adapted for a bi-directional communication with adjacent sensor units and a data relaying function, comprising:

protocol conversion means for receiving a timing signal for sensing action from the sensor unit, transmitting or receiving data comprising monitoring data, setting data, or data including commands within a time period from the time of reception of the timing signal to the time of reception of the next timing signal, and converting a communication protocol between a sensor unit communication system and field bus communication system which is connected to a programmable equipment, so as to permit a bi-directional data communication between the programmable equipment on a field bus and the sensor unit while executing sensing action with shifted timing between sensor units.

Signed and Sealed this

Twenty-fourth Day of August, 2004

JON W. DUDAS
*Director of the United States Patent and Trademark Office*